US010546448B2

(12) United States Patent
Mizue

(10) Patent No.: US 10,546,448 B2
(45) Date of Patent: Jan. 28, 2020

(54) GAMING MACHINE, CONTROL METHOD FOR MACHINE, AND PROGRAM FOR GAMING MACHINE

(71) Applicant: Konami Gaming, Inc., Las Vegas, NV (US)

(72) Inventor: Hayato Mizue, Las Vegas, NV (US)

(73) Assignee: Konami Gaming, Inc., Las Vegas, NV (US)

( * ) Notice: Subject to any disclaimer, the term of this patent is extended or adjusted under 35 U.S.C. 154(b) by 200 days.

(21) Appl. No.: 15/233,456

(22) Filed: Aug. 10, 2016

(65) Prior Publication Data

US 2018/0047248 A1 Feb. 15, 2018

(51) Int. Cl.
*G07F 17/32* (2006.01)
*G07F 17/34* (2006.01)

(52) U.S. Cl.
CPC ..... *G07F 17/3213* (2013.01); *G07F 17/3209* (2013.01); *G07F 17/3225* (2013.01); *G07F 17/3246* (2013.01); *G07F 17/34* (2013.01); *G07F 17/32* (2013.01)

(58) Field of Classification Search
CPC ..... G07F 17/32; G07F 17/34
See application file for complete search history.

(56) References Cited

U.S. PATENT DOCUMENTS 6,227,971 B1 * 5/2001 Weiss ..... G07F 17/3244 273/143 R
2004/0048646 A1 * 3/2004 Visocnik ..... G07F 17/32 463/16
2004/0198485 A1 10/2004 Loose et al.
2006/0058097 A1 * 3/2006 Berman ..... G07F 17/3244 463/20
2008/0167115 A1 * 7/2008 Singer ..... G07F 17/32 463/20
2013/0102375 A1 * 4/2013 Aoki ..... G07F 17/32 463/20

(Continued)

OTHER PUBLICATIONS

International Search Report and Written Opinion (International Application No. PCT/US2017/045453; dated Oct. 12, 2017; 11 pages.

(Continued)

*Primary Examiner* — James S. McClellan
(74) *Attorney, Agent, or Firm* — Howard & Howard Attorneys PLLC

(57) ABSTRACT

A gaming machine provides an operation unit, a display unit, and a control unit. The operation unit is an operation of the player. The display unit is operably coupled to the operation unit and is configured to display a symbol display area. The symbol display area including a plurality of cells arranged in a grid having a plurality of rows and a left plurality of columns and a right plurality of columns. Each column in the left plurality of columns being associated with a mirror column in the right plurality of columns. The control unit is operably coupled to the operation unit, the display unit is configured to initiate a game in response to player operation, and to establish an outcome of the game. Upon detection of a trigger condition, the symbols displayed in the cells of one of the columns are copied to the cells in a mirror column.

33 Claims, 53 Drawing Sheets

(56) References Cited

U.S. PATENT DOCUMENTS

| | | | | |
|---|---|---|---|---|
| 2013/0303260 | A1* | 11/2013 | Louie | G07F 17/34 463/21 |
| 2014/0094265 | A1* | 4/2014 | Aoki | G07F 17/34 463/20 |
| 2015/0348363 | A1 | 12/2015 | Johnson et al. | |
| 2016/0133094 | A1 | 5/2016 | Thomas et al. | |
| 2016/0351006 | A1* | 12/2016 | Igesund | G07F 17/3213 |
| 2017/0193756 | A1* | 7/2017 | Schmidt | G07F 17/34 |

OTHER PUBLICATIONS

International Preliminary Report on Patentability (International Application No. PCT/2017/045453; dated Feb. 21, 2019; 9 pages.

* cited by examiner

FIG. 4A

| 71 | 72 | 73 | 74 | 75 |
|---|---|---|---|---|
| PicB | Wild | PicB | PicD | J |
| Q | Wild | PicA | Q | PicA |
| K | Wild | J | A | 10 |
| Wild | Trigger | Q | PicB | 9 |
| Wild | 9 | PicD | PicD | J |
| Wild | J | Wild | Q | PicA |
| K | PicC | J | A | 10 |
| PicA | Trigger | Q | Wild | 9 |
| 9 | A | PicA | Wild | Wild |
| Trigger | PicA | K | Wild | Wild |
| J | Wild | Trigger | Trigger | Wild |
| PicC | Wild | PicC | inn | PicC |
| Wild | Wild | A | inn | Trigger |
| Wild | inn | J | inn | 10 |
| Wild | inn | inn | inn | inn |
| A | inn | inn | inn | inn |
| Q | inn | inn | J | inn |
| PicD | inn | Wild | Q | inn |
| J | A | Wild | PicC | inn |
| inn | J | Wild | A | PicA |

70

60

GAMING MACHINE, CONTROL METHOD FOR MACHINE, AND PROGRAM FOR GAMING MACHINE

TECHNICAL FIELD

The present invention relates to a gaming machine, a control method for a gaming machine, and a program for a gaming machine.

BACKGROUND ART

A gaming machine represented by a slot machine is highly popular among casino customers as a device that provides gaming that is easy to enjoy, and recent statistics report that sales from gaming machines account for the majority of casino earnings. Initial slot machines were simple devices, wherein an inserted coin is received, a configured reel rotates and stops mechanically according to a handle operation, and a win or a loss is determined by a combination of symbols stopped on a single pay line. However, recent gaming machines, such as mechanical slot machines driven by a highly accurate physical reel via a computer controlled stepping motor, video slot machines that display a virtual reel on a display connected to a computer, and various gaming machines that apply similar technology to other casino games are quickly advancing. For the manufacturers that develop these gaming machines, an important theme is to provide an attractive game that strongly attracts casino customers as players, and improves the functionality of the gaming machine.

SUMMARY OF INVENTION

In one aspect of the present invention, a gaming machine is provided. The gaming machine includes an operation unit, a display unit, and a control unit. The operation unit is configured to receive an operation of a player. The display unit operably is coupled to the operation unit and is configured to display a symbol display area. The symbol display area includes a plurality of cells arranged in a grid. The grid has a plurality of rows and a plurality of columns. The grid further including a left plurality of columns and a right plurality of columns. Each column in the left plurality of columns is associated with a mirror column in the right plurality of columns. The control unit is operably coupled to the operation unit and the display unit and is configured to initiate a game in response to player operation and to establish an outcome of the game. The control unit, in response to initiation of the game, is configured to:

randomly select a plurality of symbols associated with the symbol display area, each symbol in the plurality of symbols being associated with one of the plurality of cells in the grid, the plurality of symbols forming an interim outcome;

determine if a trigger condition has occurred in one of the columns in the left plurality of columns;

if the trigger condition has occurred in one of the columns in the left plurality of columns, copy the symbols in the one of the columns in the left plurality of columns to the mirror column in the right plurality of columns;

determine if the trigger condition has occurred in one of the columns in the right plurality of columns;

if the trigger condition has occurred in one of the columns in the right plurality of columns, copy the symbols in the one of the columns in the right plurality of columns to the associated column in the left plurality of columns, the copied symbols and any remaining symbols in the interim outcome forming the outcome of the game; and, award a payout to the player as a function of the outcome of the game.

In another aspect of the invention, a control method for a gaming machine provides a game to a player. The gaming machine includes an operation unit, a display unit, and a control unit. The operation unit is configured to receive an operation of a player. The display unit operably is coupled to the operation unit and is configured to display a symbol display area. The symbol display area includes a plurality of cells arranged in a grid. The grid has a plurality of rows and a plurality of columns. The grid further including a left plurality of columns and a right plurality of columns. Each column in the left plurality of columns is associated with a mirror column in the right plurality of columns. The control unit is operably coupled to the operation unit and the display unit and is configured to initiate a game in response to player operation and to establish an outcome of the game. The method including the steps of:

randomly selecting a plurality of symbols associated with the symbol display area, each symbol in the plurality of symbols being associated with one of the plurality of cells in the grid, the plurality of symbols forming an interim outcome;

determining if a trigger condition has occurred in one of the columns in the left plurality of columns;

if the trigger condition has occurred in one of the columns in the left plurality of columns, copying the symbols in the one of the columns in the left plurality of columns to the mirror column in the right plurality of columns;

determining if the trigger condition has occurred in one of the columns in the right plurality of columns;

if the trigger condition has occurred in one of the columns in the right plurality of columns, copying the symbols in the one of the columns in the right plurality of columns to the associated column in the left plurality of columns, the copied symbols and any remaining symbols in the interim outcome forming the outcome of the game; and, awarding a payout to the player as a function of the outcome of the game.

In still another aspect of the present invention, a program for a gaming machine provides a game to a player. The gaming machine includes an operation unit, a display unit, and a control unit. The operation unit is configured to receive an operation of a player. The display unit operably is coupled to the operation unit and is configured to display a symbol display area. The symbol display area includes a plurality of cells arranged in a grid. The grid has a plurality of rows and a plurality of columns. The grid further including a left plurality of columns and a right plurality of columns. Each column in the left plurality of columns is associated with a mirror column in the right plurality of columns. The control unit is operably coupled to the operation unit and the display unit and is configured to initiate a game in response to player operation and to establish an outcome of the game. The program of the gaming machine performing the steps of:

randomly selecting a plurality of symbols associated with the symbol display area, each symbol in the plurality of symbols being associated with one of the plurality of cells in the grid, the plurality of symbols forming an interim outcome;

determining if a trigger condition has occurred in one of the columns in the left plurality of columns;

if the trigger condition has occurred in one of the columns in the left plurality of columns, copying the symbols in the one of the columns in the left plurality of columns to the mirror column in the right plurality of columns;

determining if the trigger condition has occurred in one of the columns in the right plurality of columns;

if the trigger condition has occurred in one of the columns in the right plurality of columns, copying the symbols in the one of the columns in the right plurality of columns to the associated column in the left plurality of columns, the copied symbols and any remaining symbols in the interim outcome forming the outcome of the game; and, awarding a payout to the player as a function of the outcome of the game.

BRIEF DESCRIPTION OF DRAWINGS

FIG. 4A is a figure showing an exemplary symbol arrangement showing the order of symbols displayed on the primary display area, according to an embodiment of the present invention.

DETAILED DESCRIPTION OF EMBODIMENTS

A gaming machine, according to an embodiment of the present invention, referencing the attached figures is described in detail below. Further, duplicated descriptions will be omitted for identical attached symbols in identical or corresponding parts in each figure.

With reference to the drawings, and in operation, the present invention is directed towards a gaming machine, a control method for a gaming machine, and a program for a gaming machine that provides a game to a player. In one embodiment, the game includes a primary game and a feature game. As will be discussed in further detail below, the primary and/or bonus game, upon the occurrence of an appropriate triggering condition, may copy symbols from a column/reel of a grid (see below) to a mirror column/reel on the grid.

Figure 1A:
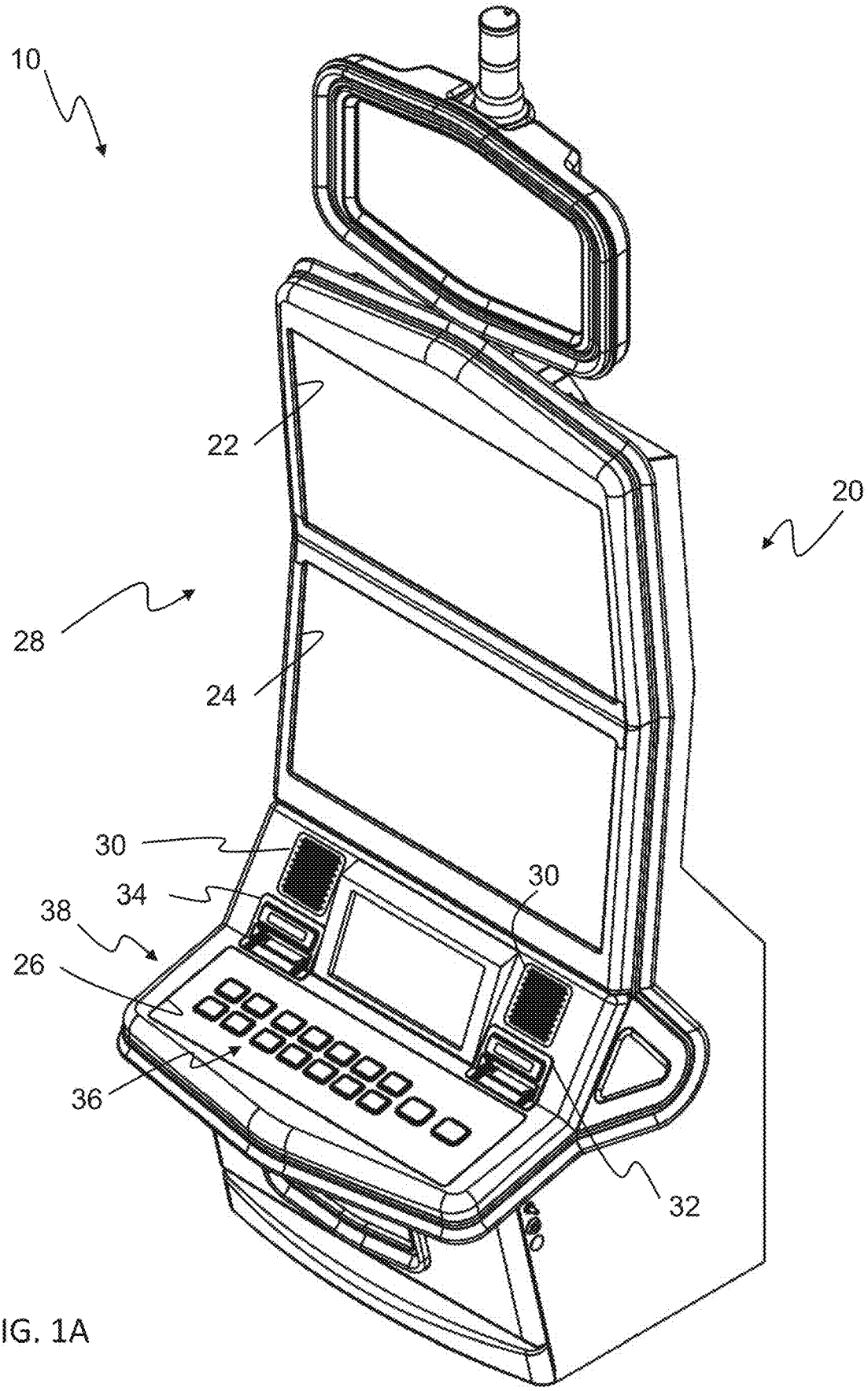
FIG. 1A is a perspective view of the gaming machine, according to the first embodiment.
Figure 1B:
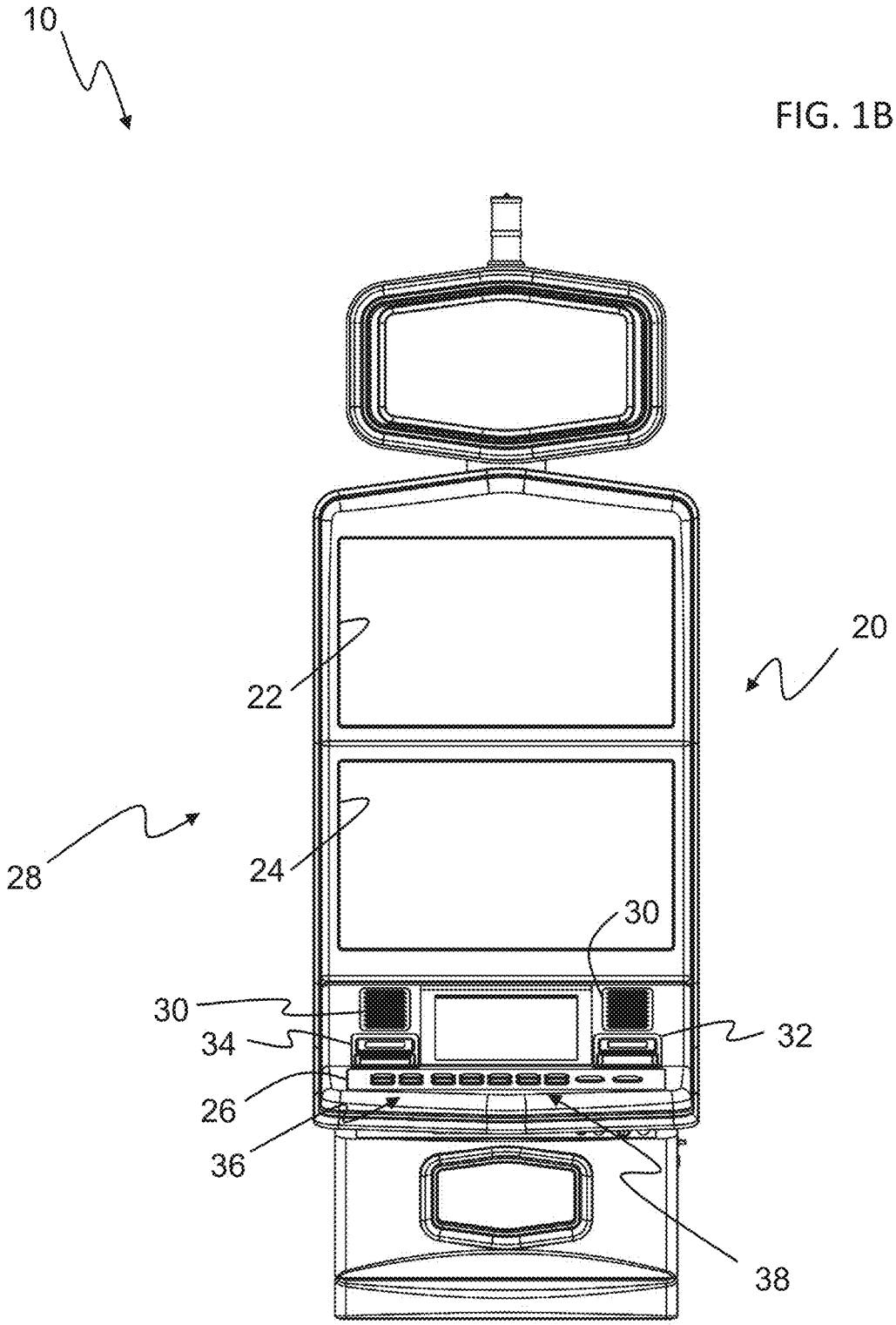
FIG. 1B is a front view of the gaming machine of FIG. 1A.

The gaming machine according to the present embodiment, receives a predetermined game value from the player, generates a game result, and provides a payout to the player according to the game result. FIG. 1A and FIG. 1B are a perspective view and a front view, respectively, of a gaming machine 10, according to the present embodiment. As shown in FIG. 1, this gaming machine 10 provides a cabinet 20 providing an upper display 22, a lower display 24, a control panel 26 and may also house a player tracking or ranking unit 57 (see FIG. 2). The cabinet 20 also houses a control unit 50 (see FIG. 2) that controls each part (see below). The control unit 50 also implements a random number generator (RNG) that is used during operation of the game. Each configuration is described below.

The upper display 22 and the lower display 24 may be flat panel display devices, such as both liquid crystal display devices and organic EL display devices and the like, and by controlling via each control unit 50, the game screen mentioned below functions as a display unit 28 provided to the player.

Speakers 30 are provided on the left and right of the cabinet 20, and by controlling via the control unit 50, sound is provided to the player. On the control panel 26, a bill/ticket identification unit 32, the printer unit 34, and an operation unit 36 are provided.

The player tracking unit 57 may be housed on the center of the front surface of the third cabinet 20. The player tracking unit 57 has a card reader that recognizes a player identification card, a display that presents data to the player, and a keypad that receives input by the player. This type of player tracking unit 57 reads information recorded on the player identification card inserted by the player into the card reader, and displays the information and/or information acquired by communicating with the external system on the display, by cooperatively operating with the control unit 50 mentioned below or an external system. Further, input from the player is received by the keypad, the display is changed according to the input, and communication with the external system is carried out as necessary.

The bill/ticket identification unit 32 is disposed on the control panel 26 in a state where the insertion opening that a bill/ticket is inserted into is exposed, an identification part that identifies a bill/ticket by various sensors on the inside of the insertion opening is provided, and a bill/ticket storage part is provided on the outgoing side of the identification part. The bill/ticket identification unit 32, receives and identifies bills/tickets (including vouchers and coupons) that are the game value as a game executing value, and notifies the control unit 50 mentioned below.

The printer unit 34 is disposed on the control panel 26 in a state where the ticket output opening that a ticket is output from is exposed, a printing part that prints predetermined information on a printing paper on the inside of the ticket output opening is provided, and a housing part that houses the printing paper inside the paper inlet side of the printing part is provided. The printer unit 34, under the control of the control unit 50 mentioned below, prints information on paper and outputs a ticket according to credit payout processing from the gaming machine 10. The output ticket can use the payout credit as game play by being inserted into the bill/ticket identification unit 32 of another gaming machine, or, can be exchanged for cash by a kiosk terminal inside of the casino or a casino cage.

The operation unit 36 receives the operation of the player. The operation unit 36 includes a group of buttons 38 that receives various instructions from the player on the gaming machine 10. The operation unit 36, for example, may include a spin button and a group of setting buttons. The spin button receives an instruction to start (start rotating the reel) the game listed below. The group of setting buttons 38 includes a group of bet buttons, a group of line-designation buttons, a max bet button, and a payout button and the like. The group of bet buttons receives an instruction operation regarding the bet amount of credits (bet number) from the player. The group of line-designation buttons receive an instruction operation that designate a pay line (referred to as an effective line below) subjected to a line judgment below from the player. The max bet button receives an instruction operation regarding the bet of the maximum amount of credits that can be bet at one time from the player. The payout button receives an instruction operation instructing a credit payout accumulated in the gaming machine 10.

Figure 2:
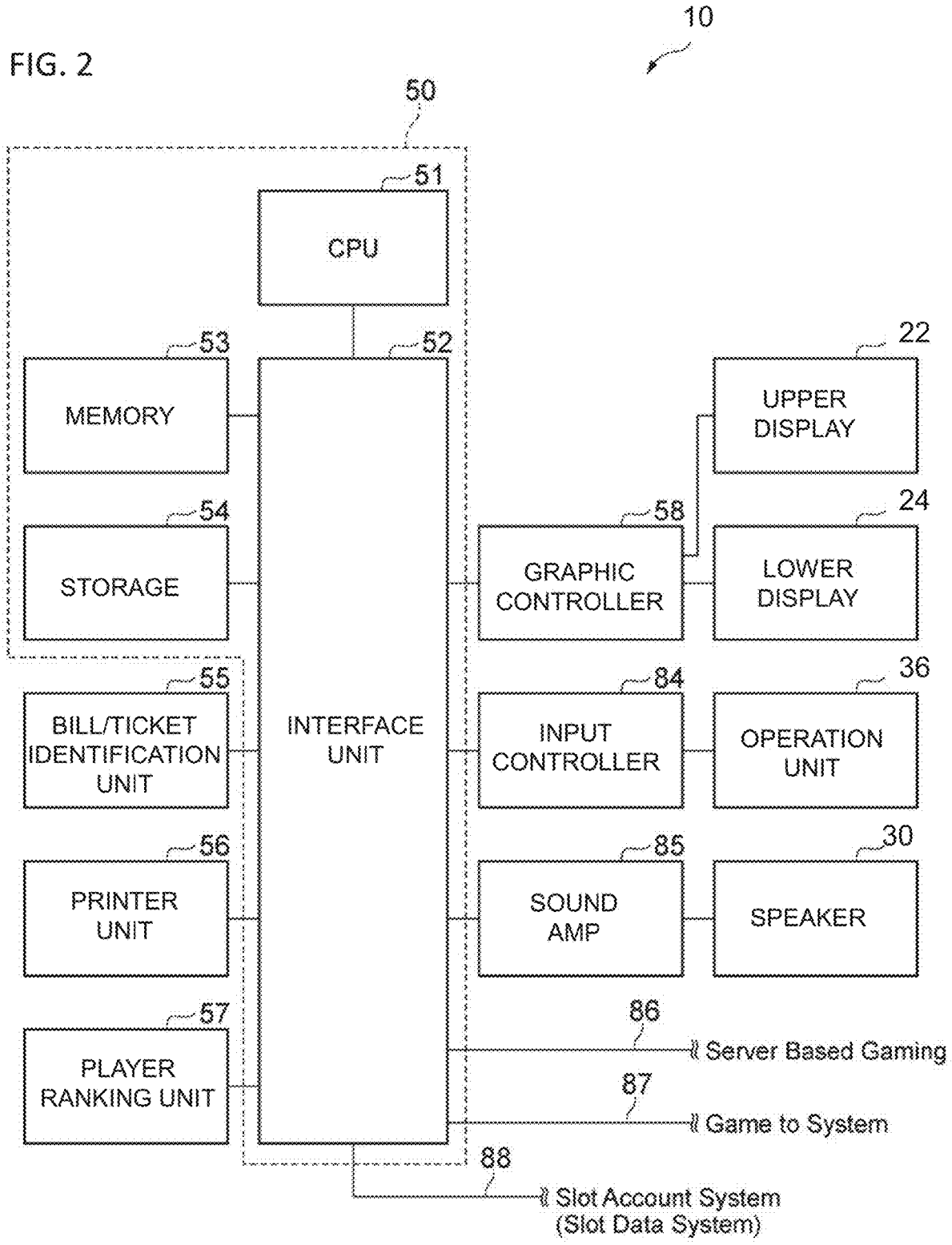
FIG. 2 is a functional block diagram of the gaming machine in FIG. 1.

With reference to FIG. 2, further on the inside of cabinet 20, a control board equipped with a central processing unit 51 (abbreviated as CPU below) that configures the control unit 50, an interface unit (or part) 52, a memory 53 and a storage 54 and the like are incorporated. The control board is configured so that communication is possible through the interface unit 52 and each of the components equipped on the cabinet 20, controls the operation of each part by executing the program recorded in the memory 53 or the storage 54 of the CPU 51, and provides a game to the player.

FIG. 2 shows a functional block diagram of the gaming machine 10, according to the present embodiment. The gaming machine 10 provides the control unit 50. The control unit 50 is configured as the interface unit 52 including a chip set providing communication functions of the CPU 51, a memory bus connected to a CPU, various expanding buses, serial interfaces, USB interfaces, Ethernet (registered trademark) interfaces and the like, and a computer unit where the CPU 51 provides the addressable memory 53 and the storage 54 through the interface unit 52. The memory 53 can be configured to include RAM that is a volatile storage medium, ROM that is a nonvolatile storage medium, and EEPROM that is a rewritable nonvolatile storage medium. The storage 54 provides the control unit 50 as an external storage device function, can use reading devices such as a memory card that is a removable storage medium, and a magneto optical disk and the like, and can use hard disks.

On the interface unit 52, in addition to the CPU 51, the memory 53, and the storage 54, a bill/ticket identification unit 55, a printer unit 56, the player tracking unit 57, a graphic controller 58, an input controller 84, and a sound amp 85 are connected. That is, the control unit 50 is connected to the operation unit 36 through the input controller 84, and connected to the upper display 22 and/or the lower display 24 through the graphic controller 58. Further, when illumination that provides decorative lighting to the gaming machine 10 is provided, the illumination is controlled under the control of the control unit 50 on the interface unit 52, and an illumination controller that provides a decorative lighting effect may be connected.

The control unit 50, which includes memory 53 and storage 54, controls each part by executing a program stored in the memory 53 and the storage 54, and provides a game to the player. Here, for example, the memory 53 and storage 54 may be configured to store a program and data of an operating system and subsystem that provide the basic functions of the control unit 50 to the EEPROM of the memory 53, and stores a program and data of an application that provides a game to the storage 54. According to such a configuration, it can be easy to change or update a game by replacing the storage 54. Further, the control unit 50 may be a multiprocessor configuration that has a plurality of CPUs.

Each block connected to the control unit 50 is described below. The bill/ticket identification unit 55 corresponds to the bill/ticket identification unit 32, receives bills/tickets in the insertion opening, and notifies the control unit 50 of identifying information corresponding to the assortment of bills or the payout processing of credits. The bill/ticket identification unit 55 notifies the information to the control unit 50, and the control unit 50 increases the usable credit amount inside of the game according to the notified content. The printer unit 56 corresponds to the printer unit 34, and under the control of the control unit 50 that receives an operation of the payout button of the group of setting buttons 38, information corresponding to the credit payout processing from the gaming machine 10 is printed and output on a printed ticket.

The player ranking (or tracking unit) unit 57 cooperatively operates with the control unit 50, and sends and receives information and the like of the player from the casino management system. The graphic controller 58 controls the upper display 22 and the lower display 24, under the control of the control unit 50, and displays a display image that includes various graphic data. The sound amp 85 drives the speakers 30 under the control of the control unit 50, and provides various sounds such as an announcement, sound effects, BGM and the like.

Further, the interface unit 52, has various communication interfaces for communicating with the exterior of the gaming machine 10, for example the interface unit 52 can communicate with an external network by Ethernet 86, 87, and a serial output 88. In the present embodiment, one example shows when there is communication between a well-known server side gaming network (Server Based Gaming of FIG. 2), a G2S network (Game to System of FIG. 2), and a slot information system (Slot Data System of FIG. 2), respectively.

Figure 3A:
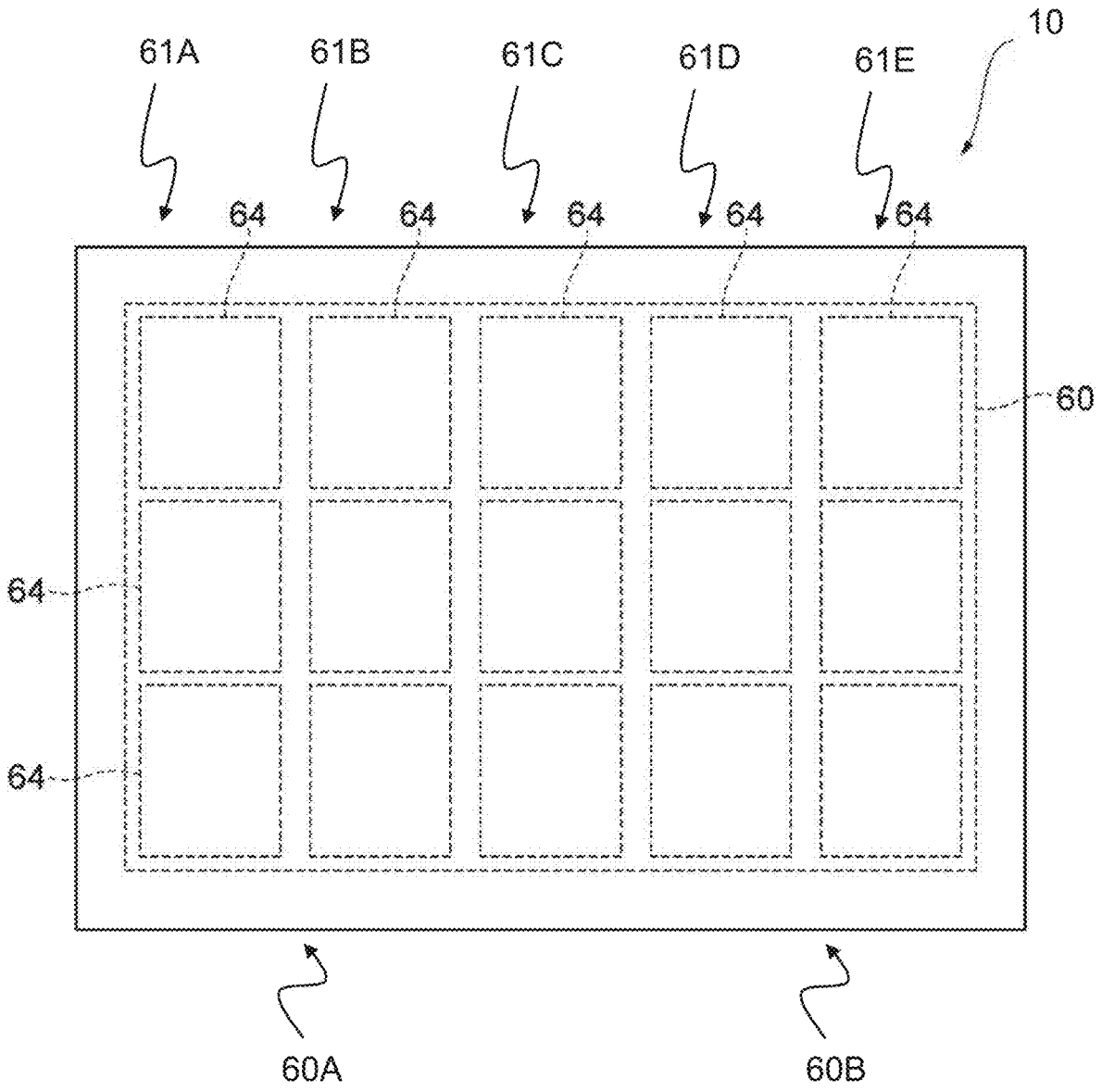
FIG. 3A is a first diagrammatic illustration of a primary display area of the gaming machine in FIG. 1, according to an embodiment of the present invention.
Figure 3B:
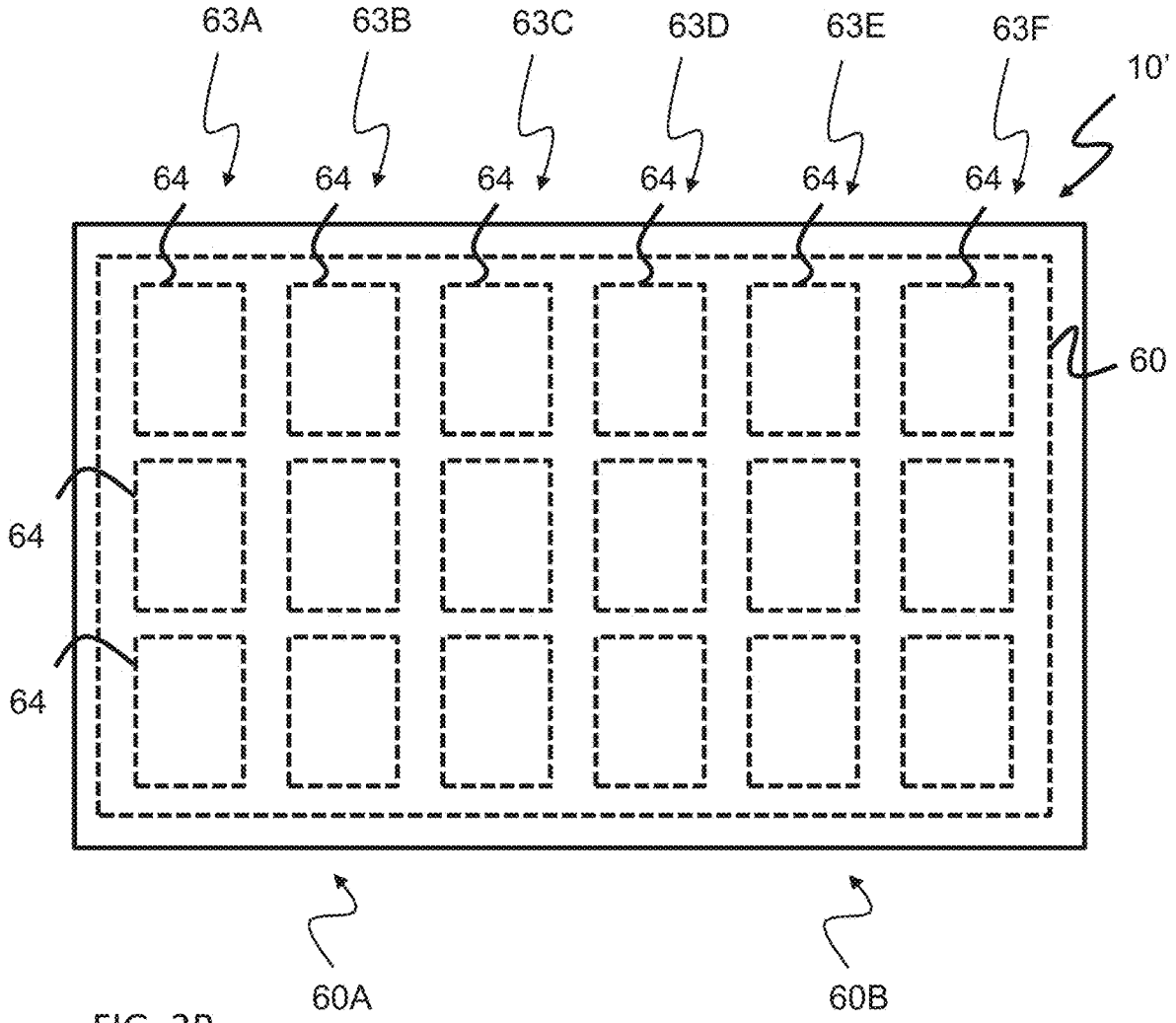
FIG. 3B is a first diagrammatic illustration of a primary display area of the gaming machine in FIG. 1, according to a second embodiment of the present invention.

FIG. 3A and FIG. 3B schematically show a game screen provided by the gaming machine 10, according to first and second embodiments. Such a game screen is displayed on the display unit 28 (the upper display 22 and/or the lower display 24) by the control unit 50 executing a predetermined program. In the illustrated embodiment, the game screen is displayed on the lower display 24.

In one aspect of the present invention, the gaming machine 10 provides a game to the player. The game may include a primary game and a bonus or feature game. For instance, the primary game may be a video slot game, and the bonus game may be the awarding of a number of free games or spins in response to the occurrence of a trigger condition, e.g., during the primary game. During either the primary game or the bonus game, in response to a predetermined trigger all or some of the symbols in one of the columns or reels of the game screen are copied to a mirror column or reel (see below). The copying of all or some of the symbols from one column/reel to a mirror column/reel may be referred to as the "Mirror Copy" Feature. The Mirror Copy Feature may be provided in the primary game and/or the bonus game.

In one embodiment, the Mirror Copy Feature is provided in the primary game. The bonus game is triggered during the primary game (see below) and may include one or more free spins.

The game of the present invention utilizes a determination or display area or grid 60 during the game. The present embodiment shows the state of displaying the game screen on the lower display 24. As shown in FIG. 3A, this game screen has a determination area 60 for displaying symbols. By using such a game screen, the gaming machine 10 of the present embodiment operates as a slot machine that pays a payout according to a winning combination of symbols displayed on the determination area 60.

The display unit 28 displays a plurality of symbols in the display area 60. The determination area, or grid, 60 has a plurality of rows (r) and columns (c). The determination area 60 is configured by a plurality of cells 64 that are the stop position of symbols.

In some embodiments of the present invention, the grid 60 includes an odd number of columns. In other embodiments of the present invention, the grid 60 includes an even number of columns. The columns are grouped into a left plurality of columns 60A and a right plurality of columns 60B. If the grid 60 includes an odd number of columns, a center column is not included in either the left plurality of columns 60A or the right plurality of columns 60B.

In the embodiment shown in FIG. 3A, the display area 60 includes 15 cells 64 disposed in a grid shape of 3 rows and 5 columns. The left plurality of columns 60A includes a first column 61A and a second column 61B. The right plurality of columns 60B includes a fourth column 61D and a fifth column 61E. The first column 61A is mirrored with the fifth column 61E. The second column 61B is mirrored with the fourth column 61D. A third or center column 61C is not included in either the left plurality of columns 60A or the right plurality of columns 60B.

In the embodiment shown in FIG. 3B, the display area 60 includes 18 cells 64 displayed in a grid shape of 3 rows and 6 columns. The left plurality of columns 60A includes a first column 63A, a second column 63B, and a third column 63C. The right plurality of columns 60A includes a fourth column 63D, a fifth column 63E, and a sixth column 63F. The first column 63A is mirrored with the sixth column 63F. The second column 63B is mirrored with the fifth column 63E. The third column 63C is mirrored with the fourth column 63D.

In the next several embodiments, the present invention will be described with respect to a 3×5 grid, however, it should be noted that the present invention is not limited to a grid with any specific size and/or shape. Furthermore, the below discussion describes a game having a primary game and a bonus game. The Mirror Copy Feature is provided in the primary game and the bonus game, which may be triggered in the primary game, may include one or more free spins. The Mirror Copy Feature may also be provided in the bonus game.

Figure 3C:
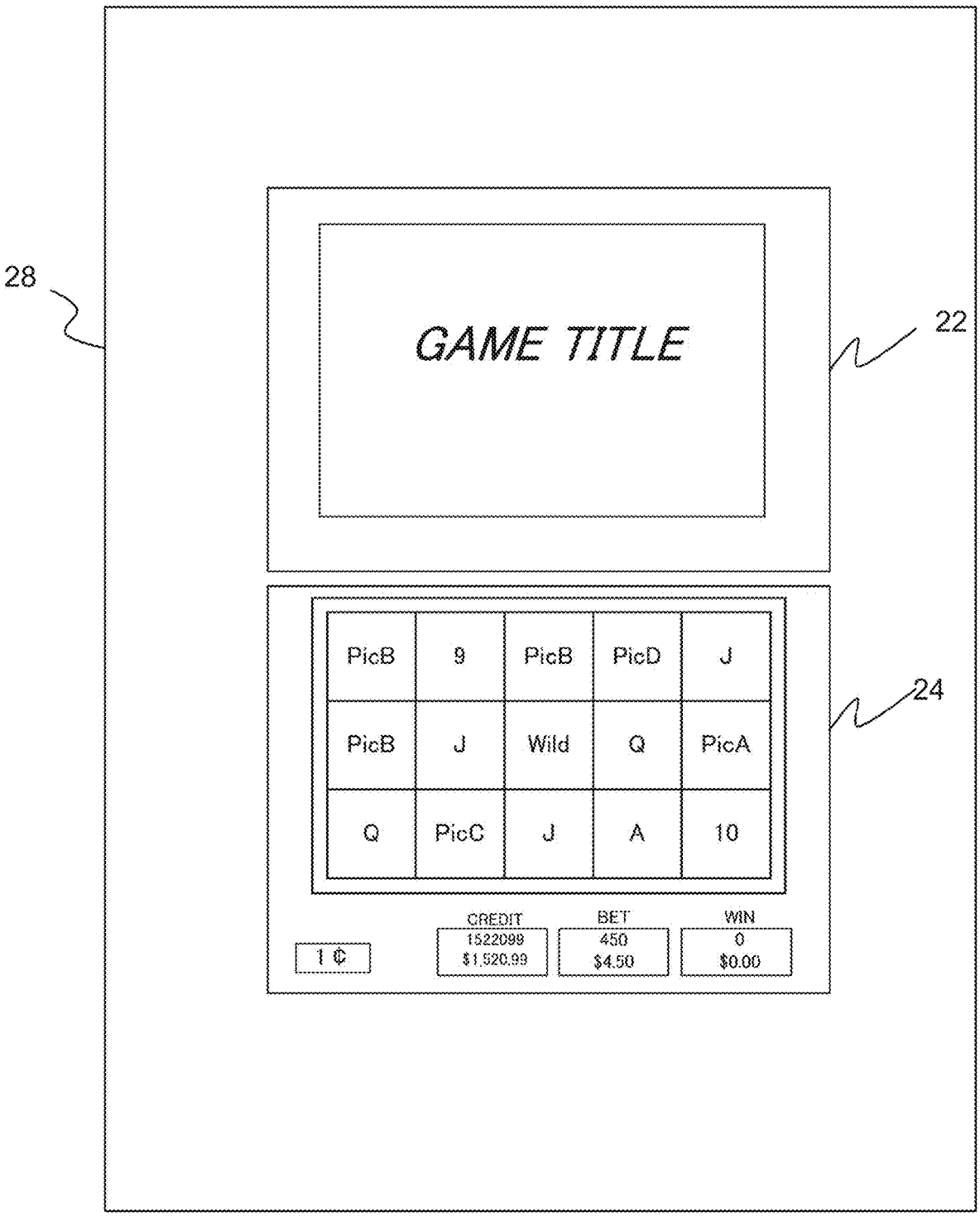
FIG. 3C is a diagrammatic illustration of the primary display area and a secondary display area of the gaming machine in FIG. 1, according to an embodiment of the present invention.

With reference to FIG. 3C, the determination area or grid 60 is displayed on the lower display 24. The upper display 22 may be used to display animations during the feature animations. Further, the display unit 28 can display a decorative area, and an area that displays credit amount, bet number, and a credit amount obtained by winning (WIN number) and the like, outside of the determination area 60. On each of the plurality of cells 64 of the display area 60, one symbol is stopped and displayed.

Figure 4B:
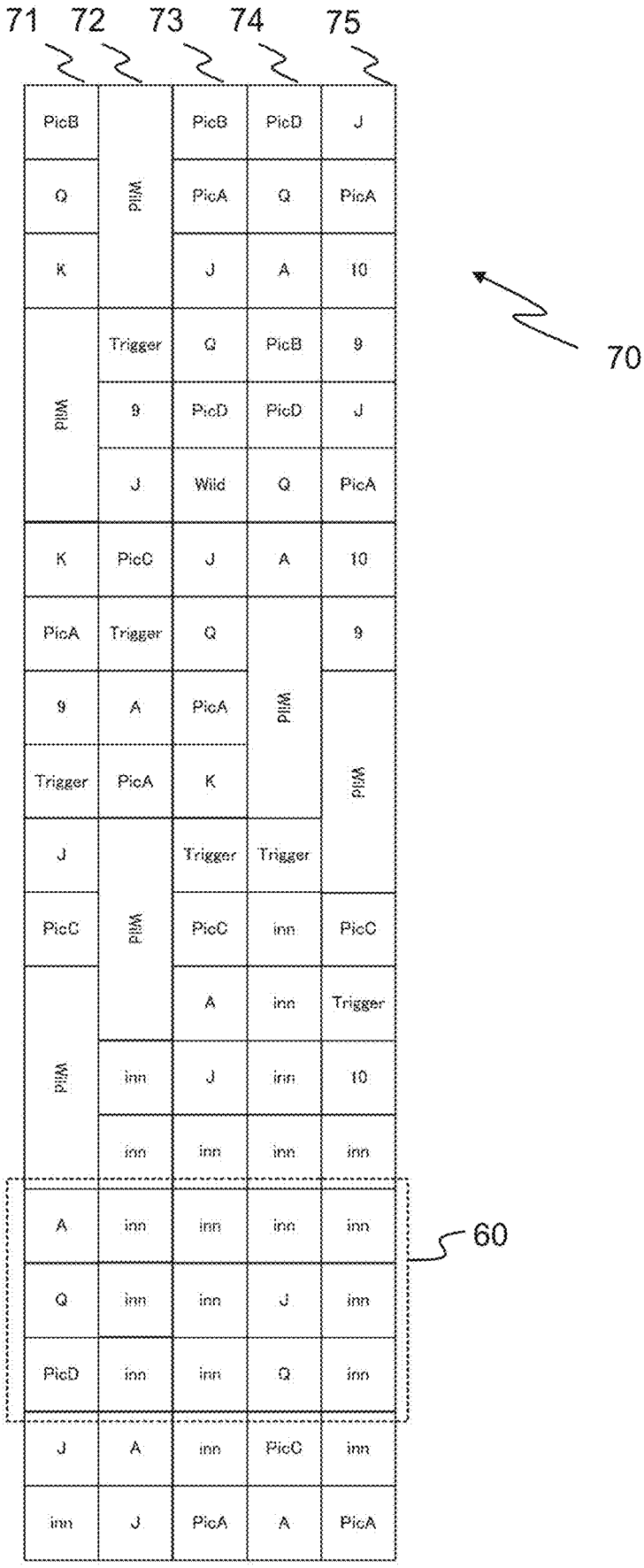
FIG. 4B is a figure showing an exemplary symbol arrangement showing the order of symbols displayed on the primary display area, according to another embodiment of the present invention.

On each cell 64 of the display area 60, as shown in FIGS. 4A and 4B, a symbol is displayed based on the symbol arrangement of virtual reel strips 71 to 75 configured of a virtual reel set 70. That is, the cells 64 of the display area 60 correspond to the virtual reel strips 71 to 75 by column, and the symbols disposed on predetermined parts of each virtual reel strip 71 to 75 are displayed. Furthermore, as mentioned below, by moving (scrolling or spinning) each symbol by column based on the symbol arrangement of the virtual reel strips 71 to 75, the symbols displayed in the cells 64 of the determination area 60 change, and by stopping the movement (scrolling or spinning) by columns, the symbols are stopped. Here, the virtual reel strips 71 to 75 are data where the control unit 50 uses a program having the memory 53 or the storage 54, and data showing the symbol arrangement (i.e., the order of symbols on each reel) regulated by each cell column. Further, the virtual reel set 70 is a general term for such virtual reel strips 71 to 75.

Figure 5:
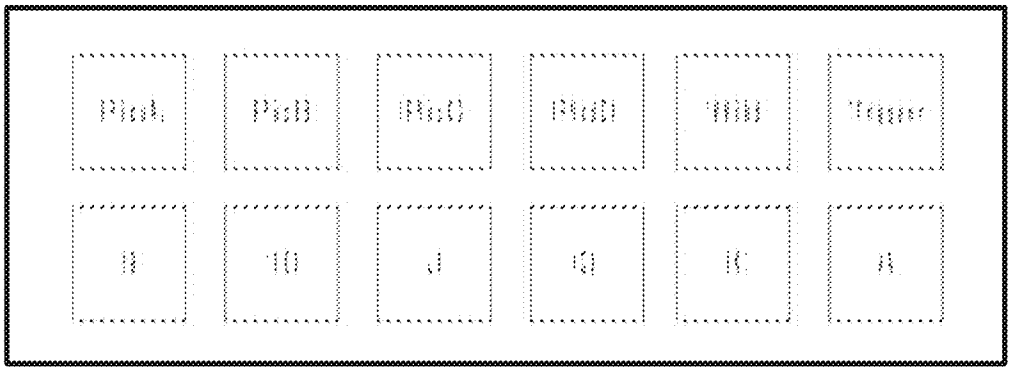
FIG. 5 is a figure showing the symbols displayed on the display area, according to an embodiment of the present invention.

Each virtual reel strip 71 to 75, in the examples of FIG. 4A and FIG. 4B, is configured by 20 symbols in respective symbol positions, and those symbols are aligned in an order defined by each reel. FIG. 5 is the details of symbols of the figure shown in FIG. 4A. Each virtual reel strip 71 to 75 includes symbols selected from a symbol set of 12 varieties shown in FIG. 5. This symbol set includes card symbols ("9", "10", "J", "Q", "K", and "A") that imitate playing cards as regular symbols, and picture symbols ("PIC-a", "PIC-b", "PIC-c", and "PIC-d") that show a pattern. Further, this symbol set includes a wild symbol ("Wild") that is substituted as another symbol when a win is determined and a trigger or symbol ("Trig") that is used to determine if a feature or feature game is to be played (see below). Each of these symbols have a different rank from each other regarding their value when winning, their rank gradually raises in this order: "9", "10", "J", "Q", "K", "A", "PIC-d", "PIC-c", "PIC-b", "PIC-a". A combination of symbols that includes high-ranking symbols when winning, can obtain a larger winning payout compared to a combination of low-ranking symbols when winning. Further, each virtual reel strip 71 to 75 may include one or more variable symbols ("inn") that is transformed into one of the other symbols, e.g., "9", "10", "J", "Q", "K", "A", "PIC-d", "PIC-c", "PIC-b", "PIC-a", (see FIG. 5) for each game or spin.

In the embodiment of FIG. 4A, one or more of the reel strips 71-75 associated with the columns 61A-61E, 63A-63F may include a plurality of adjacent symbol positions that contain an identical symbol. In the illustrated embodiment, the identical symbol is a wild symbol. Further in the illustrated embodiment, the first, second, fourth and fifth reel strips 71, 72, 74, 75 include two pluralities of adjacent symbol positions containing a wild symbol and the third reel strip 73 includes a single plurality of adjacent symbol positions containing wild symbol.

In one embodiment, the plurality of adjacent symbol positions may include a number of symbol positions equal to, less than, or greater than the number of rows in the grid 60.

In the embodiment of FIG. 4B, the plurality of adjacent symbol position may include a single large symbol to represent the identical symbol in the adjacent symbol position.

In general, the control unit 50 starts a game (either the primary game or a free spin in the bonus game), determines the stop position of each virtual reel strip 71 to 75 randomly, the virtual reel strips 71 to 75 move from a current position, and the operation to stop on a stop position uses the display unit 28 (for example, the lower display 24) and is expressed. Due to this, in the display or determination area 60, the symbols included on the virtual reel strips 71 to 75 are continuously moved (scrolled or spun) in the vertical direction of the display area 60, and one symbol of one cell 64 aligned in an order of the symbol based on the symbol arrangement is stopped so that it is displayed.

The control unit 50 changes and stops the plurality of symbols displayed on the display unit 28 according to the operation of the player received by the operation unit 36, and a payout may be paid according to the stopped symbols inside the determination area 60.

In the display area 60, a pay line is set that is used when winning is determined. The pay line is set to be extended over the column on the right end from the cells of the column of the left end, and is a line that combines the plurality of cells 64 determining a win. The number of effective lines within the set pay line is selected by the operation of a group of line designation buttons included in the group of setting buttons 38 of the operation unit 36 for the player. The control unit 50, in regards to the result of a game that is a combination of symbols, determines a win when a predetermined number of identical symbols is surpassed and aligned on a set pay line, and pays a payout to the player according to the type and number of symbols. On the gaming machine 10 of the present embodiment, a predetermined number of pay lines (LINE 1-40) of cells with three rows and five columns in the display area 60 is set (see FIG. 6). The system for determining a win may determine a win when a predetermined number of identical symbols from cells of the column on the left end are aligned on a set pay line, may determine a win when a predetermined number of identical symbols from cells of the column on the right end are aligned on a set pay line, and may determine a win when a predetermined number of identical symbols are aligned on a continuous column on a predetermined pay line.

Figure 6:
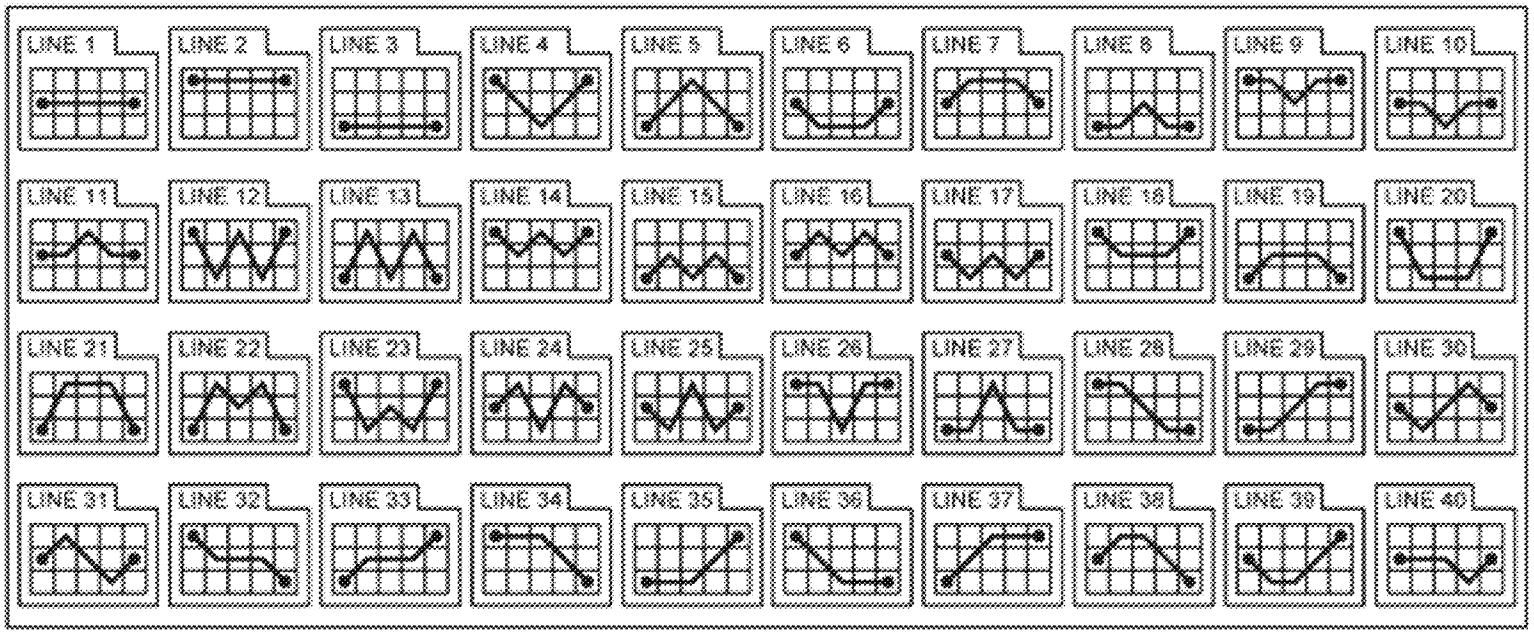
FIG. 6 is a figure showing one example of a pay line set on the determination area in FIG. 3.

It should be noted that pay lines shown other than (or in addition to) the pay lines shown in FIG. 6 may be used. In general, the pay lines shown in FIG. 6 start in the first column and end in the last column, and include one cell per column. However, one or more pay lines could include one or more cells in the same column and may include a vertical pay line.

The gaming machine 10 of the present embodiment may provide two types of games, a primary game (also referred to as a main game) and a special game (referred to as a bonus game, or feature game, and includes providing one or more free games or spins that do not consume game value) provided when predetermined conditions are satisfied. Concerning a primary game and a feature game, the symbols displayed in the display area 60 configure a combination of symbols that are the result of a game, and determine a win.

In one embodiment of the present invention, the gaming machine 10 includes the operation unit 36, a display unit 22, 24 and a control unit 50. The operation unit is configured to receive an operation of a player (see above). The display unit is operably coupled to the operation unit and is configured to display a symbol display area. The symbol display area includes a plurality of cells 64 arranged in a grid 60. As discussed above, the grid 60 has a plurality of rows and a plurality of columns. The grid 60 includes a left plurality of columns 60A and a right plurality of columns 60B. Each column in the left plurality of columns 60A is associated with a mirror column in the right plurality of columns 60B.

The control unit 50 is operably coupled to the operation unit and the display unit and is configured to initiate a game in response to player operation and to establish an outcome of the game. The control unit 50, in response to initiation of the game, being randomly selects a plurality of symbols associated with the symbol display area or grid 60. Each symbol in the plurality of symbols is associated with one of the plurality of cells 64 in the grid 60. The plurality of symbols forms an interim outcome.

In some embodiments, each symbol in the interim outcome may be randomly selection. In the illustrated embodiment, the game is a video slot game. As discussed above, each column has an associated reel strip. In randomly selecting the symbols in the interim outcome, the control unit 50 randomly determines a stop position (using a random number generator or RNG) for each reel strip and displays the interim outcome in a manner to simulate rotating reels. The symbols in each column in interim outcome is a function of the associated reel strip and the randomly determined stop position.

The control unit 50 determines if a trigger condition has occurred in one of the columns in the left plurality of columns. If the trigger condition has occurred in one of the columns in the left plurality of columns, the symbols in the one of the columns in the left plurality of columns are copied to the mirror column in the right plurality of columns.

The control unit 50 determines if a trigger condition has occurred in one of the columns in the right plurality of columns. If the trigger condition has occurred in one of the columns in the right plurality of columns, the symbols in the one of the columns in the right plurality columns to the associated column in the left plurality of columns.

In the illustrated embodiments, all of the symbols in a column are copied to the mirror or associated column. However, it should be noted that in some embodiments less than all symbols in the column may be copied.

The copied symbols and any remaining symbols in the interim outcome form the outcome of the game. It should be noted that if the trigger condition has not occurred in any of the columns, then no symbols are copied and the interim outcome forms the outcome of the game. The control unit 50 may award a payout to the player as a function of the outcome of the game and a pay table.

In one embodiment the trigger condition is the appearance a predetermined symbol or symbols in the interim outcome. The predetermined symbol may be randomly determined (and unknown) to the player, i.e., a mystery trigger.

As discussed above, the associated reel strip of at least one column in the left plurality of columns includes an identical symbol in a plurality of adjacent symbol positions and the associated reel strip of at least one column in the right plurality of columns includes the identical symbol in a plurality of adjacent symbol positions. In other embodiments, the trigger condition may be the appearance or occurrence of one or a plurality of the identical symbols in the interim outcome. In one embodiment, the trigger condition is at least one of the identical symbols in the plurality of adjacent symbol positions occurring in the interim outcome. In another embodiment, the trigger condition is at least one of the identical symbols in the plurality of adjacent symbol positions occurring in the interim outcome. In still another embodiment, trigger condition is the occurrence of the identical symbol from the plurality of adjacent symbol positions in all of the cells 64 of a column (see below). In one embodiment, the identical symbol in the plurality of adjacent symbol position may be randomly determined. In another embodiment the identical symbol is a wild symbol.

It should be noted that the trigger condition may be any suitable condition or set of conditions that may occur in the game, or occur independent of the game, e.g., from an outside source such as a player tracking system. The trigger condition may be a mystery trigger event, i.e., an event which while related to the main game, is not visible or part of or shown within the outcome of the game.

In some embodiments of the present invention, the virtual reels stop in a predetermined order, for example, from left to right.

In one embodiment, if the trigger condition occurs in one of the columns of the left plurality of columns, the symbols may be copied to the mirror column while the reel associated with the mirror column is still spinning, i.e., before the reel has stopped. It should be noted that in this embodiment, if the trigger condition occurs in one of the right plurality of columns, the symbols are copied to the associated left column whose reel has already stopped spinning. It should be noted that if symbols are copied before the reel in the target column has stopped spinning the control unit 50 virtually spins and stops the underlying reason (see below).

In another embodiment, the symbols are copied only after all reels have stopped.

As discussed above, the game may also include a bonus game. The bonus game may include one or more free spins. In one embodiment, the bonus game is triggered by the occurrence of one or more predetermined symbols, e.g., a scatter symbol in the interim outcome. For example, the bonus game may be triggered if 3 or more scatter symbols occur in the interim outcome. In the event that the Mirror Copy Feature results in one or more scatter symbols in the interim outcome not being visible to the player, the control unit 50 may be configured to display the scatter symbol on top of any copied symbol. In general, the control unit 50: (1) copies the symbols to the target column, (2) stops the underlying reel, and (3) displays the scatter symbol on top of the copied symbols.

In another aspect of the present invention, the control unit 50 is further configured to display an animation illustrating the copying of any symbols (from one column to another column). As will discussed in more detail below, the animation may include:

- creating a duplicate image of the symbols to be copied above or near the associated originating column,
- folding the duplicate image over the grid to an opposite side of the grid, and
- overlaying the copied symbol onto the cells of the grid of the associated column.

Figure 7A:
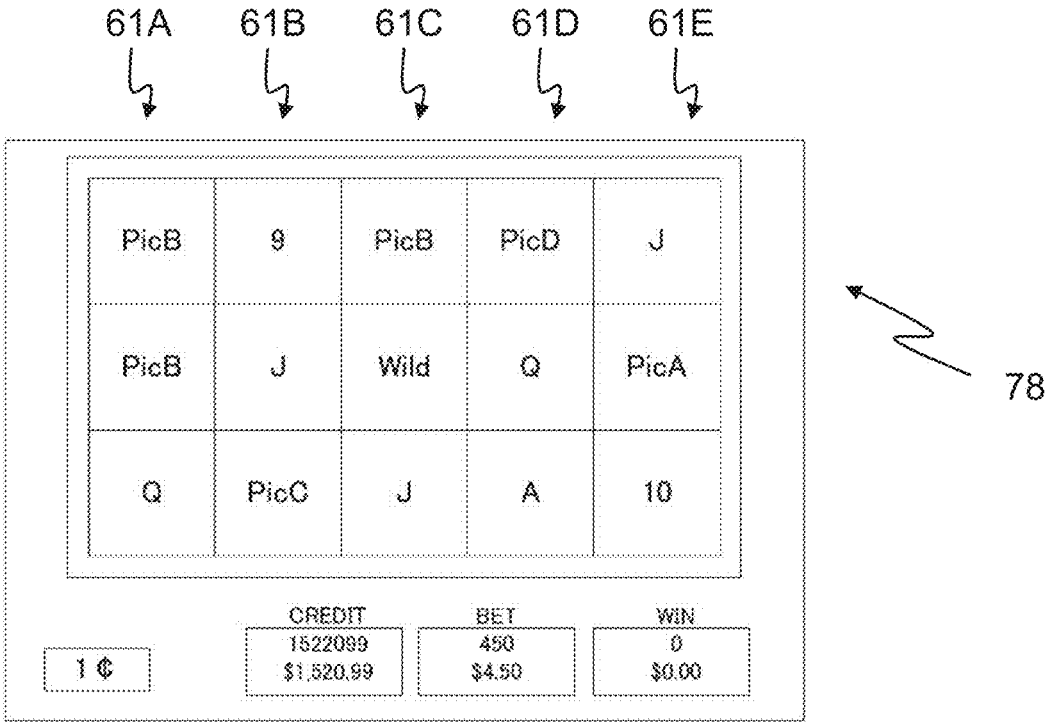
FIGS. 7A-7G are diagrammatic illustrations of the display area of the gaming machine in FIG. 1 during a game, according to an embodiment of the present invention.

With particular reference to FIGS. 7A-7G, a display screen 78 of a first instance of a game according to an embodiment of the present invention will be discussed. As mentioned above, the present invention may provide a main game and a bonus game. The main game or the bonus game may be a video slot game, and may be played on a primary determination area or grid 60. As shown in FIG. 7A, in the first embodiment, a 3×5 grid of cells 64 may be used.

Figure 7B:
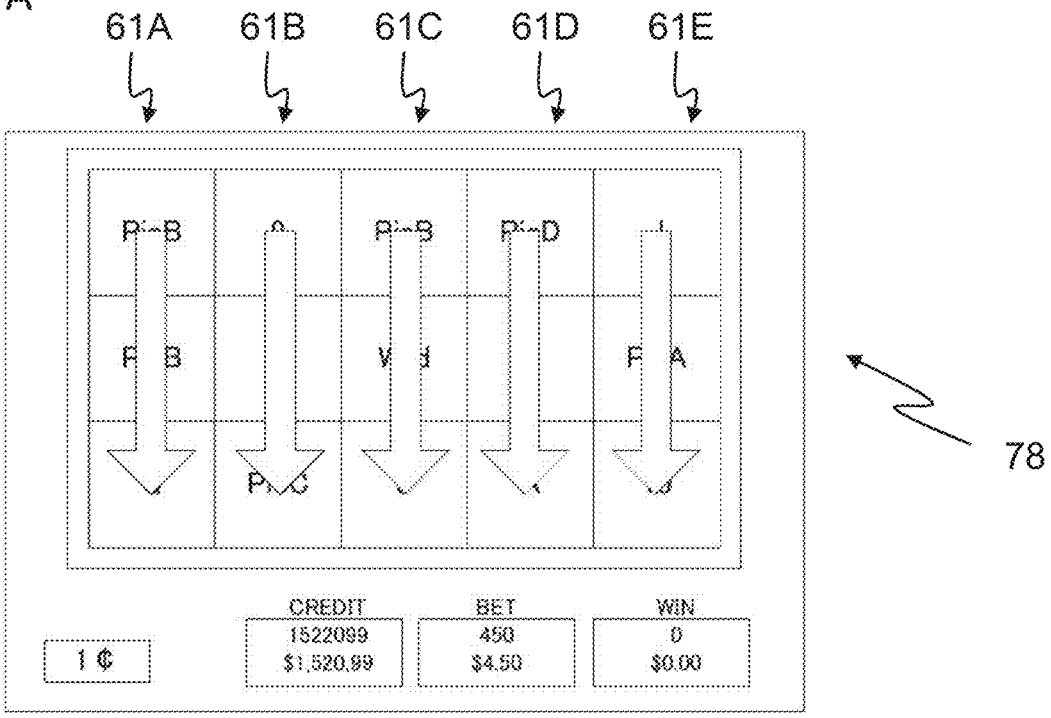
Figure 7C:
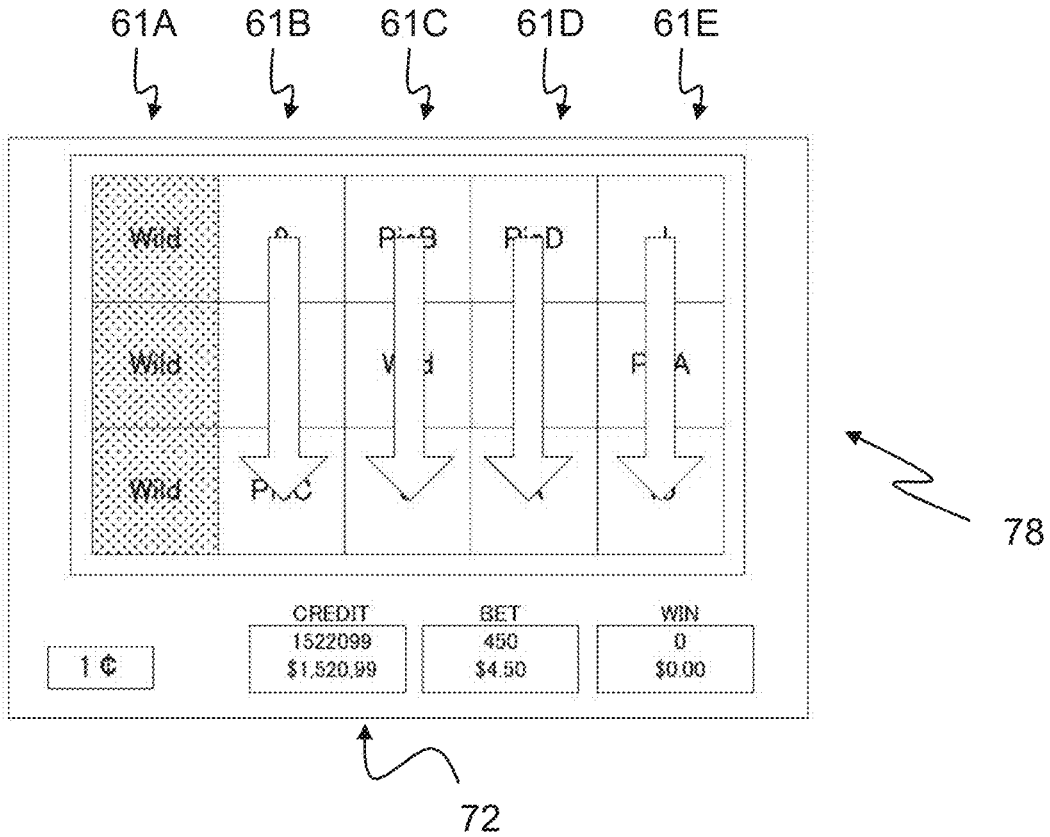
Figure 7D:
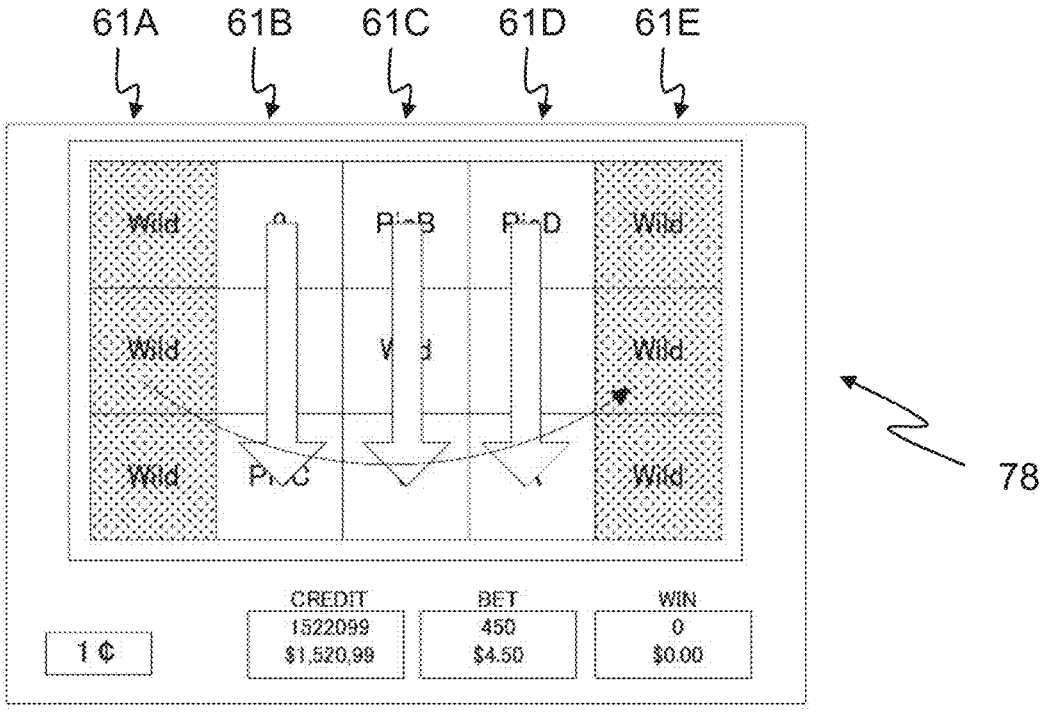

The Mirror Copy Feature may be provided in the main game and/or the bonus game. In the display screen 78 of FIG. 7A, the symbols in the cells 64 prior to initiation of the game (or spin) are shown. In FIG. 7B, the reels associated with the columns 61A-61B start spinning in a downward direction (as represented by the arrows). In FIG. 7C, the reel associated with the first column 61A has stopped spinning. The reels associated with the second through fifth reels 61B-61E are still spinning. In the illustrated embodiment, all of the cells 64 of the first column contain a Wild symbol, thus the Mirror Copy Feature is triggered. As shown in FIG. 7D, while the reels associated with the second through fifth reels 61B-61E are still spinning, the symbols in the cells 64 of the first column are copied into the cells 64 of the mirror column, i.e., the cells 64 of the fifth column 61E. While not visible, the reel associated with the fifth column 61E is still spinning.

Figure 7E:
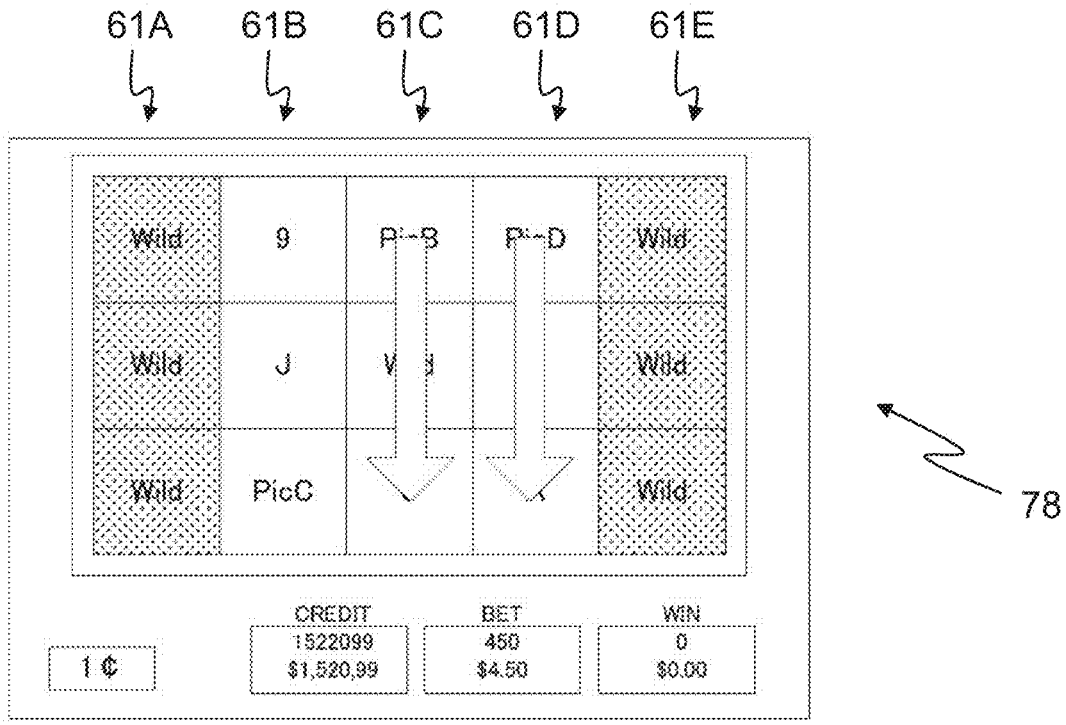

In FIG. 7E, the reel associated with the second column 61B has stopped spinning. The reels associated with the third and fourth column 61C and 61D are still spinning. While not visible, the reel associated with the fifth column 61E may also be spinning. Since, the cells 64 of second column 61B do not contain Wild symbols, the Wild Copy Feature is not triggered with respect to the second column 61B.

Figure 7F:
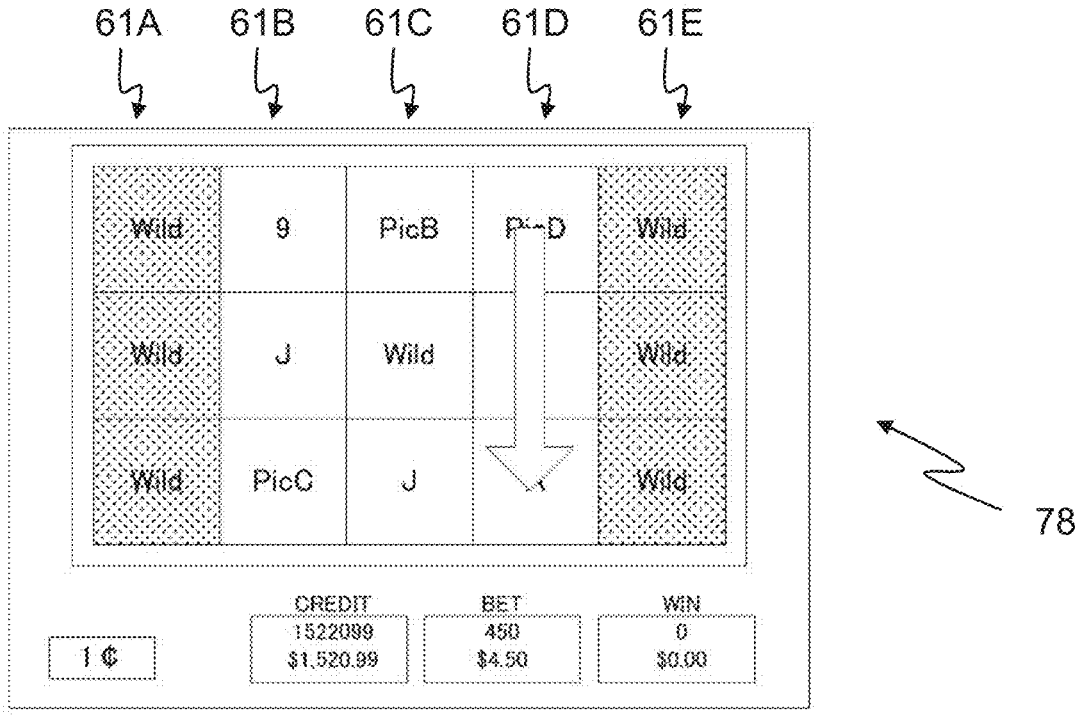

In FIG. 7F, the reel associated with the third column 61C has stopped spinning. The reel associated with the fourth column 61D is still spinning. While not visible, the reel associated with the fifth column 61E may also be spinning. Since the grid 60 includes an odd number of columns, the third column is not considered part of the left plurality of columns 60A or the right plurality of columns 60, and thus, does not have a mirror or associated column.

Figure 7G:
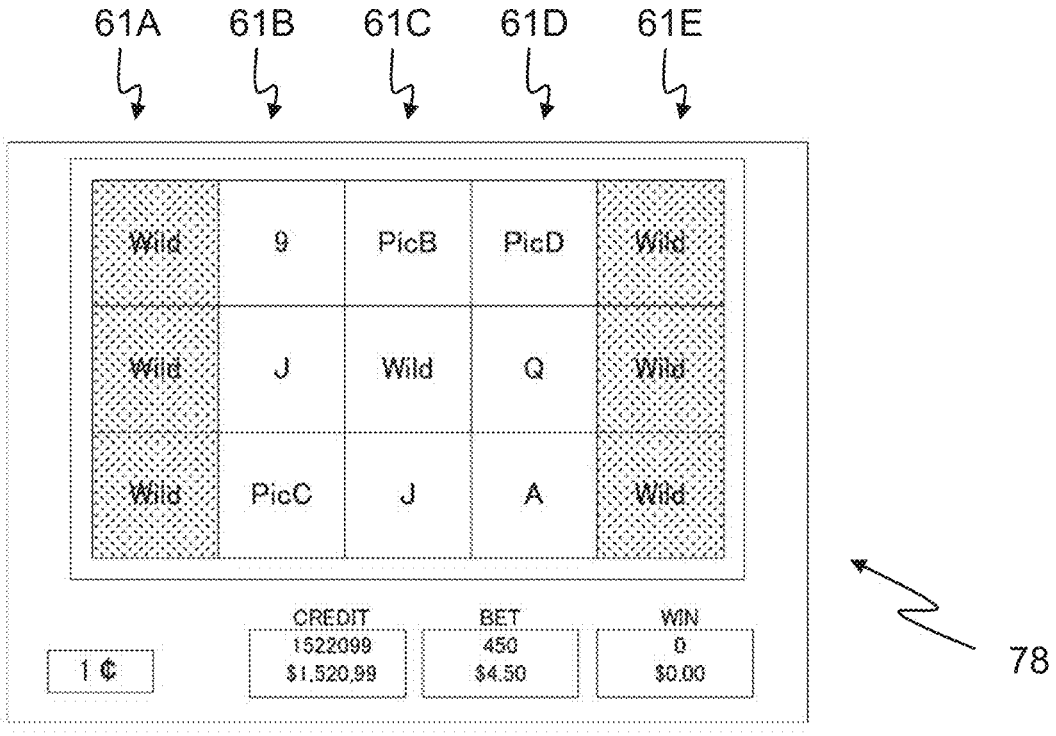

In FIG. 7G, the reel associated with the fourth column 61D has stopped spinning. While not visible, the reel associated with the fifth column 61E may also be spinning. Since, the cells 64 of fourth column 61D do not contain Wild symbols, the Wild Copy Feature is not triggered with respect to the fourth column 61D. The reel associated with the fifth column is then stopped behind the copied Wild symbols (if it is still spinning). The symbols in the grid 60 (the copied Wild symbols in the fifth column 61E and any remaining (or visible) symbols from the interim outcome. The outcome of the game is then evaluated and any award is paid to the player.

Figure 8A:
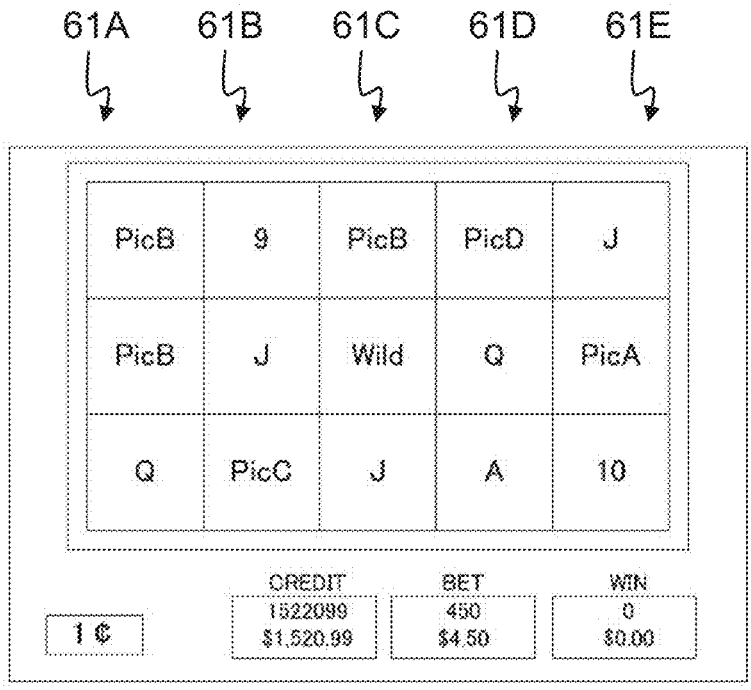
FIGS. 8A-8I are diagrammatic illustrations of the display area of the gaming machine in FIG. 1 during a game, according to another embodiment of the present invention.
Figure 8B:
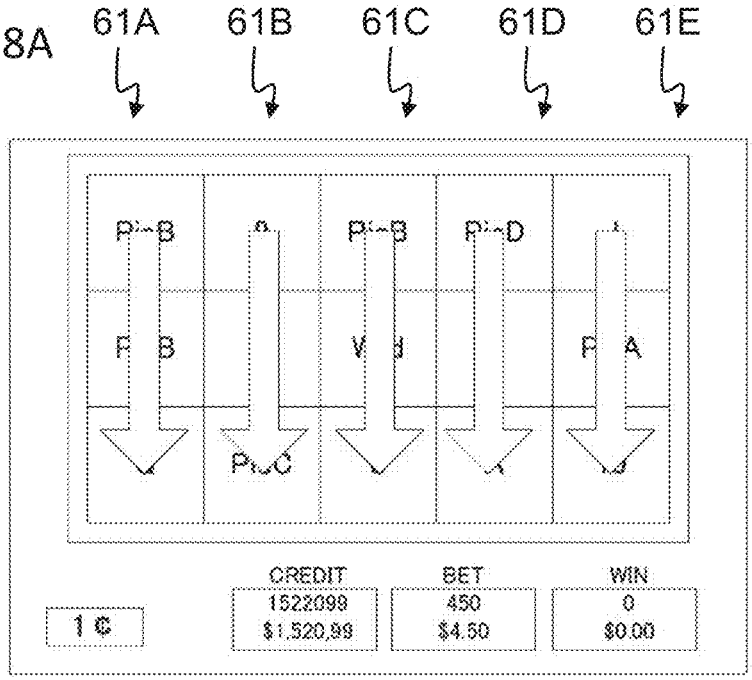

With particular reference to FIGS. 8A-8I, a display screen 78 during a second instance of the first embodiment of the present invention will be discussed. In the display screen 78 of FIG. 8A, the symbols in the cells 64 prior to initiation of the game (or spin) are shown. In FIG. 8B, the reels associated with the columns 61A-61B start spinning in a downward direction (as represented by the arrows).

Figure 8C:
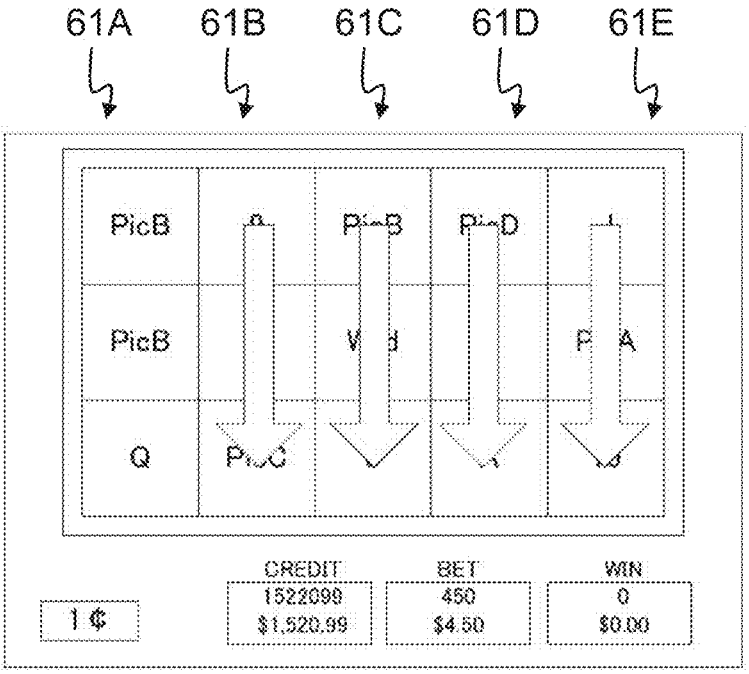

In FIG. 8C, the reel associated with the first column 61A has stopped spinning. The reels associated with the second through fifth reels 61B-61E are still spinning. Since, the cells 64 of first column 61A do not contain Wild symbols, the Wild Copy Feature is not triggered with respect to the first column 61A.

Figure 8D:
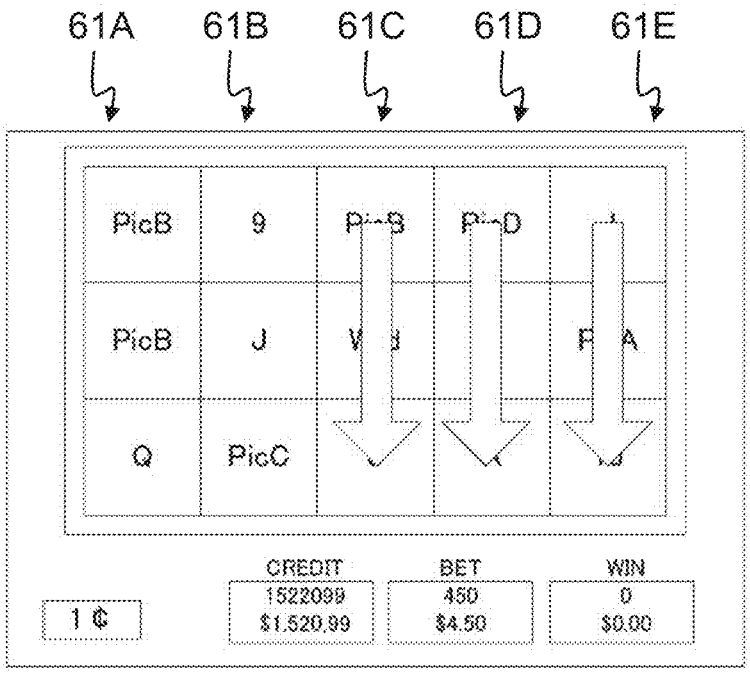

In FIG. 8D, the reel associated with the second column 61B has stopped spinning. The reels associated with the third, fourth and fifth columns 61C, 61D, 61E are still spinning. Since, the cells 64 of second column 61B do not contain Wild symbols, the Wild Copy Feature is not triggered with respect to the second column 61B.

Figure 8E:
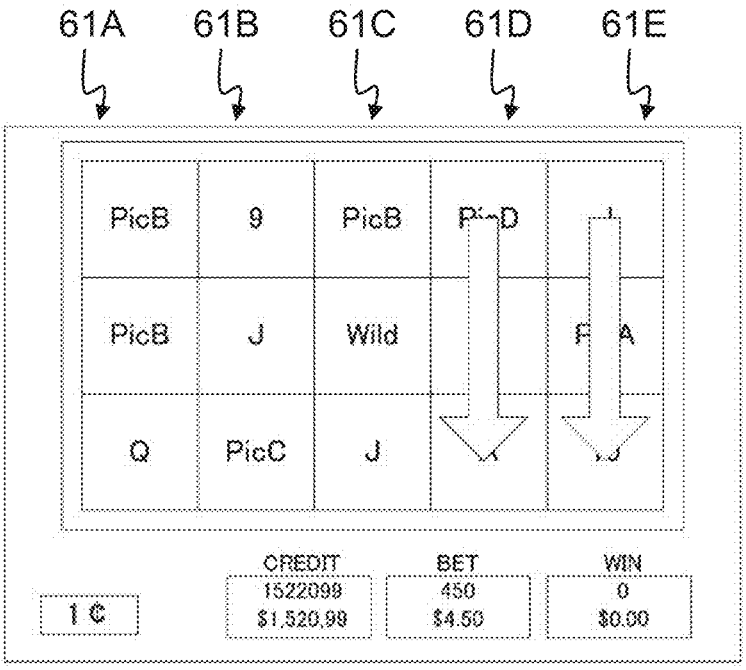

In FIG. 8E, the reel associated with the third column 61C has stopped spinning. The reels associated with the fourth and fifth columns 61D, 61E are still spinning. Since the grid 60 includes an odd number of columns, the third column 61C is not considered part of the left plurality of columns 60A or the right plurality of columns 60, and thus, does not have a mirror or associated column.

Figure 8F:
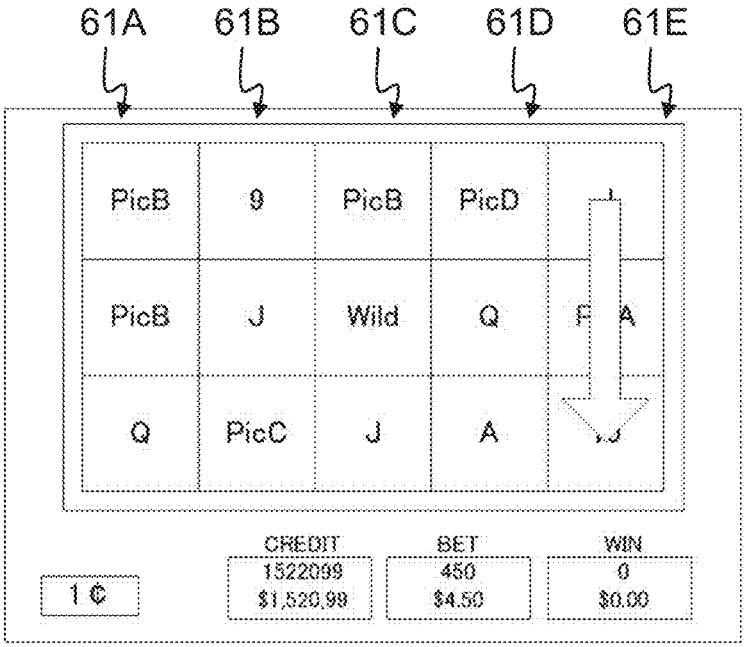

In FIG. 8F, the reel associated with the fourth column 61C has stopped spinning. The reel associated with the fifth columns 61E is still spinning. Since, the cells 64 of fourth column 61C do not contain Wild symbols, the Wild Copy Feature is not triggered with respect to the fourth column 61C.

Figure 8G:
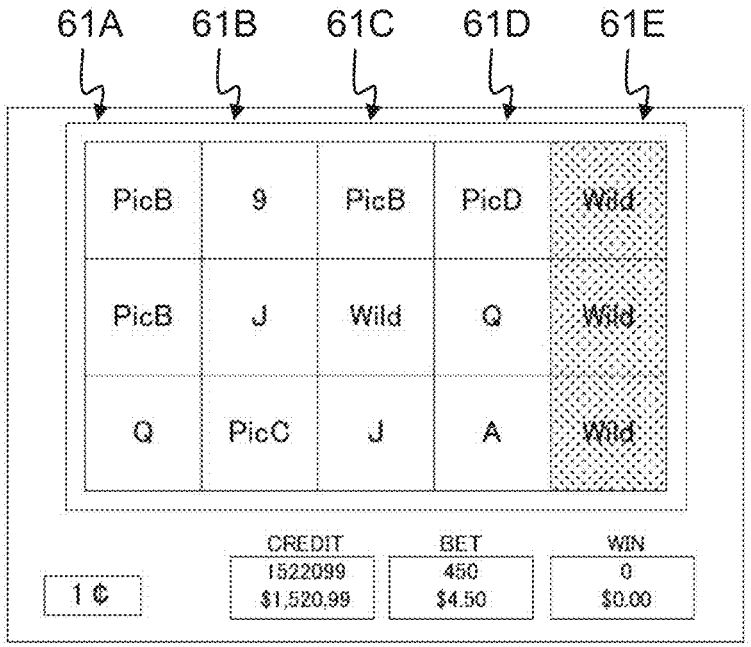
Figure 8H:
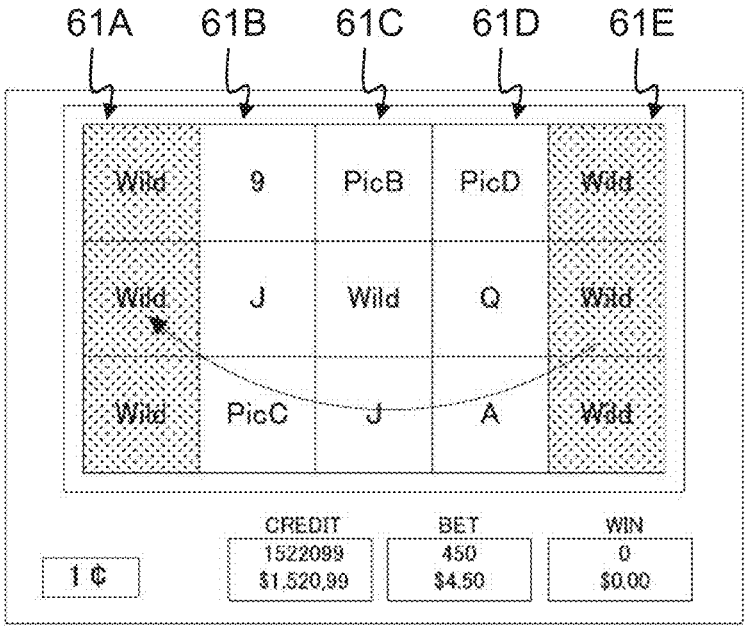
Figure 8I:
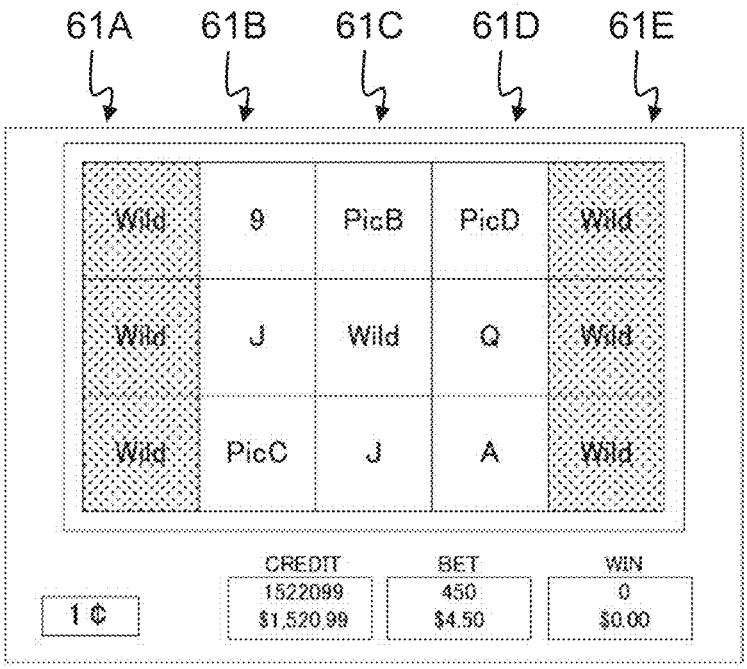

In FIG. 8G, the reel associated with the fifth column 61E has stopped spinning. In the illustrated embodiment, all of the cells 64 of the fifth column contain a Wild symbol, thus the Mirror Copy Feature is triggered. As shown in FIG. 8H, the symbols in the cells 64 of the fifth column are copied into the cells 64 of the mirror column, i.e., the cells 64 of the first column 61A. As shown in FIG. 8I, the symbols in the grid 60 (the copied Wild symbols in the first column 61A and any remaining (or visible) symbols from the interim outcome. The outcome of the game is then evaluated and any award is paid to the player.

Figure 9A:
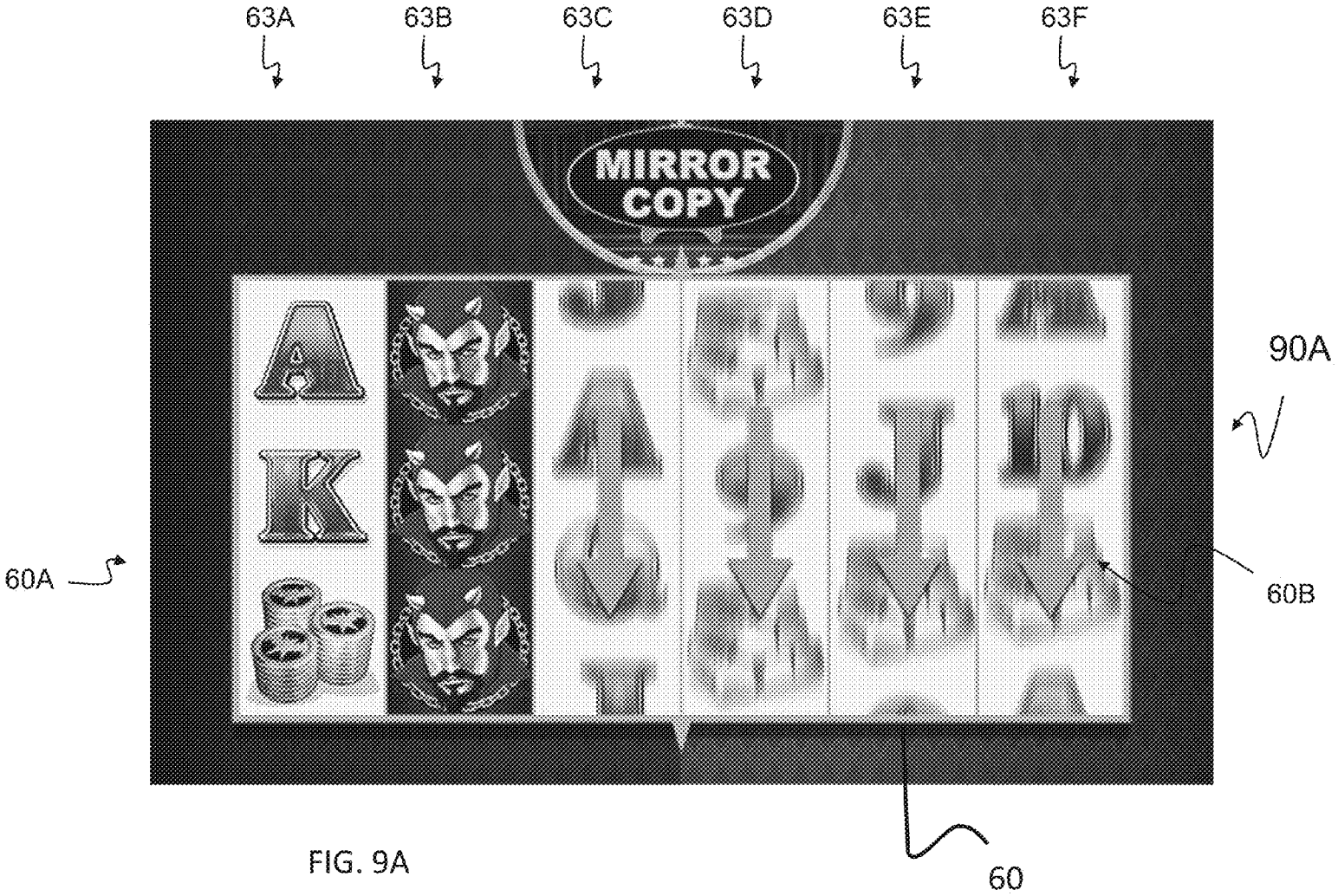
FIGS. 9A-9F are screen shots of the display area of the gaming machine in FIG. 1, according to a first embodiment of the present invention.

With particular reference to FIGS. 9A-9F, screen shots 90A-90F of an instance of a game according to an embodiment of the present invention will be discussed. The game is shown as a video slot game, and may be played on a determination area or grid 60. As shown in FIG. 9A, a 3×6 grid 60 of cells 64 may be used. Thus, the grid 64 has first, second, third, fourth, fifth, and sixth columns 63A, 63B, 63C, 63D, 63E, 63F. The left plurality of columns 60A includes the first, second, and third columns 63A, 63B, 63C, and the right plurality of columns 60B includes the fourth, fifth, and sixth columns 63D, 63E, 63F. The first and sixth columns 63A, 63F are associated (or mirrored). The second and fifth columns 63B, 63E are associated (or mirrored). The third and fourth columns 63C, 63D are associated (or mirrored).

In this embodiment, after initiation of the game all of the reels are spin and the reels are stopped, in turn, from left to right. In the screen shot 90A of FIG. 9A, the reels associated with the first and second columns 63A, 63B have been stopped while the reels associated with the third, fourth, fifth and sixth columns 63C, 63D, 63E, 63F continue to spin. Since the symbols in the cells 64 of the first column 63A do not contain Wild symbols, the Mirror Copy Feature was not triggered with respect to the first column 63A.

As shown, the cells 64 of the second column 63A all contain a Wild symbol (shown as a Devil symbol), and thus, the Mirror Copy Feature has been triggered with respect to the second column 63B.

Figure 9B:
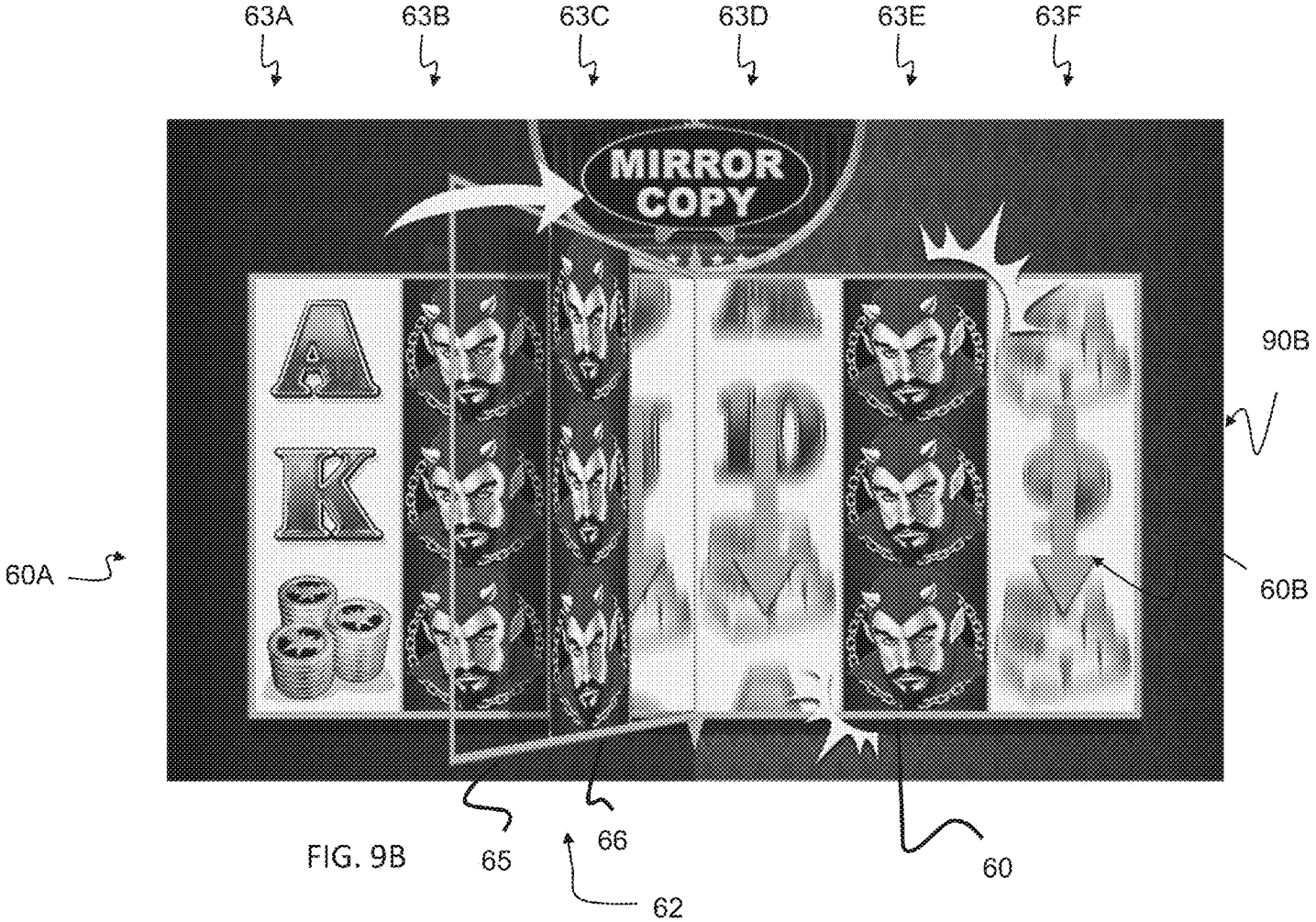

As shown in the screen short 90B of FIG. 9B, the symbols in the cells 64 of the second column 63B are copied to the cells 64 of the mirror or associated column, the fifth column 63E. The control unit 50 may utilize or display an animation 62 to display the steps of copying the contents of the cells 64 of the second column 63B to the cells 64 of the fifth column 63E. In the illustrated embodiment, the animation 62 includes a duplication or copy 65 of the symbols in the second column 64 in a frame 65. The frame 66 including the copied symbols 65 are flipped over from the left side of the grid 60 to the right side of the grid 60 as a visualization of the copying of the symbols.

Figure 9C:
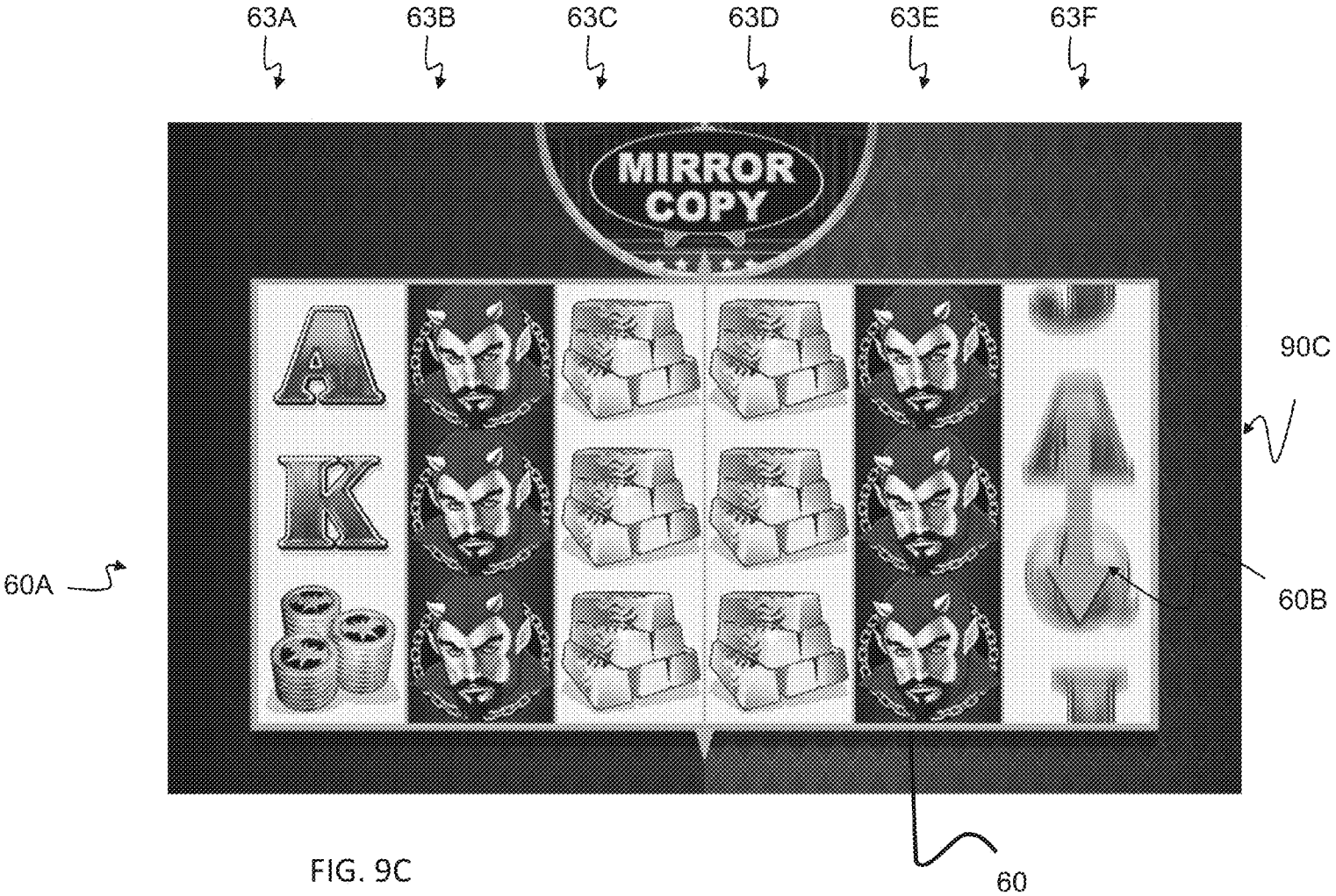

In the screenshot 90C of FIG. 9C, the reels associated with the third, fourth, and fifth columns 63C, 63D, 63E are stopped. The reel associated with the sixth column 63F is still spinning. Since the cells 64 of the third and fourth columns 63D, 63E do not contain Wild symbols, then the Mirror Copy Feature has not been triggered with respect to the third and fourth columns 63C, 63D. It should be noted that while the cells 64 of the third column 63C and the fourth column 63D contain the same symbol, the symbol is not a Wild symbol, so in this embodiment, the Mirror Copy Feature is not triggered. The fifth column 63E already contains the copied Wild symbol, so the underlying reel is not visible.

Figure 9D:
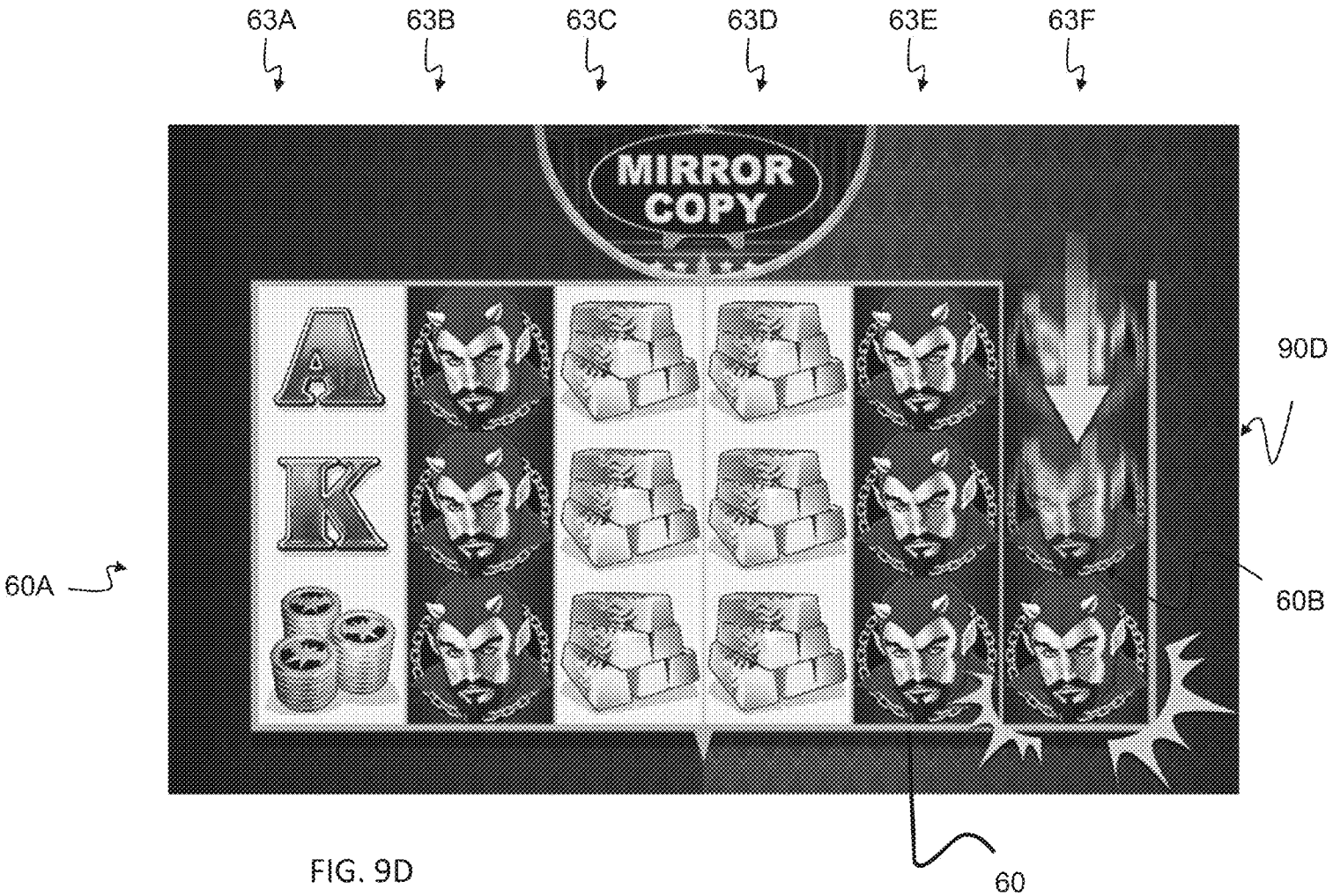
Figure 9E:
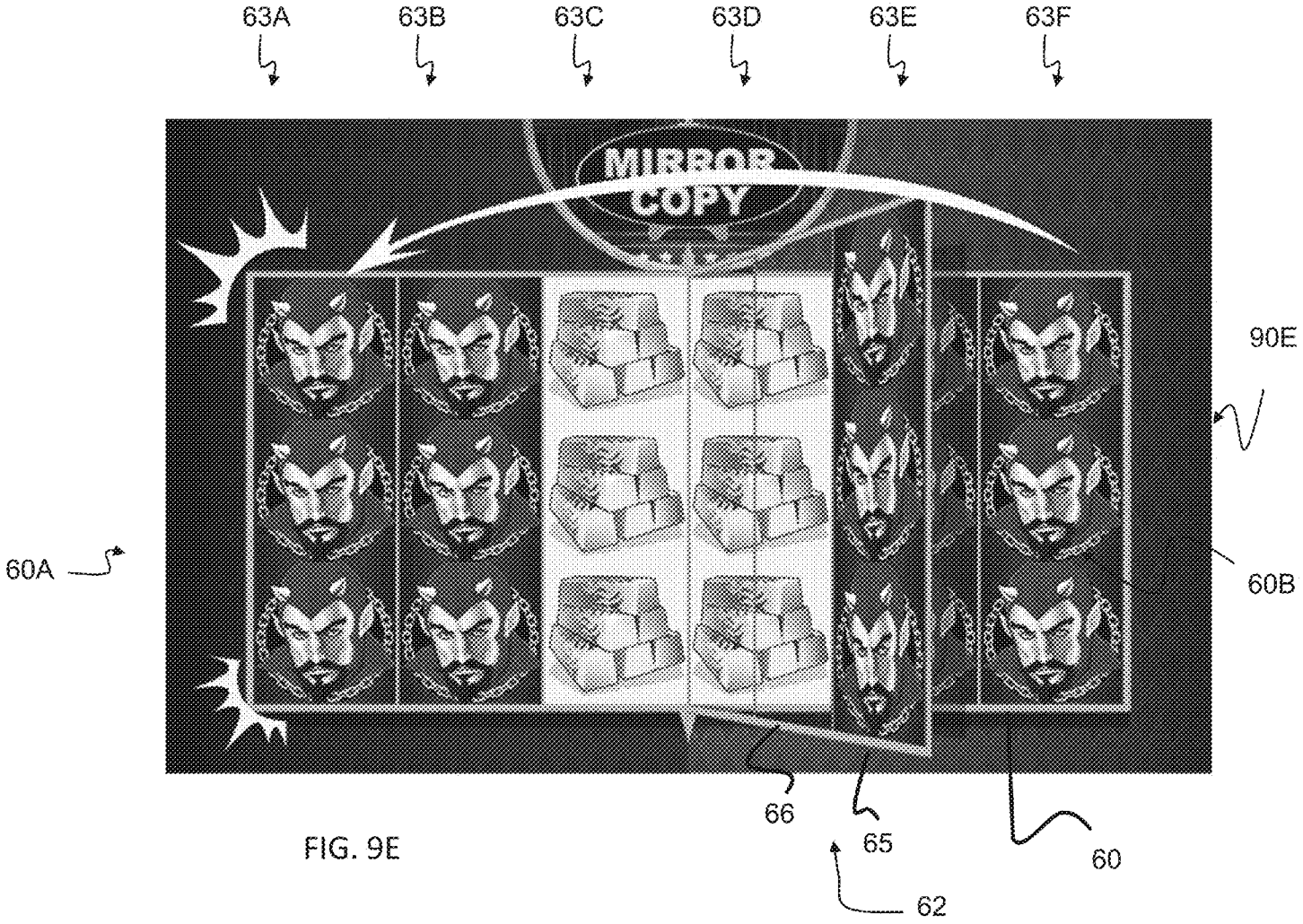

In the screen shot 90D of FIG. 9D, the reel associated with the sixth column 63F is stopped. As shown in the screen shot 90E of FIG. 9E the symbols in the cells 64 of the sixth column 63F are copied to the cells 64 of the mirror or associated column, i.e., the first column 63A. The control unit 50 may utilize or display an animation 62 to display the steps of copying the contents of the cells 64 of the sixth column 63F to the cells 64 of the first column 63A. In the illustrated embodiment, the animation 62 includes a duplication or copy 65 of the symbols in the second column 64 in a frame 65. The frame 66 including the copied symbols 65 are flipped over from the right side of the grid 60 to the left side of the grid 60 as a visualization of the copying of the symbols.

Figure 9F:
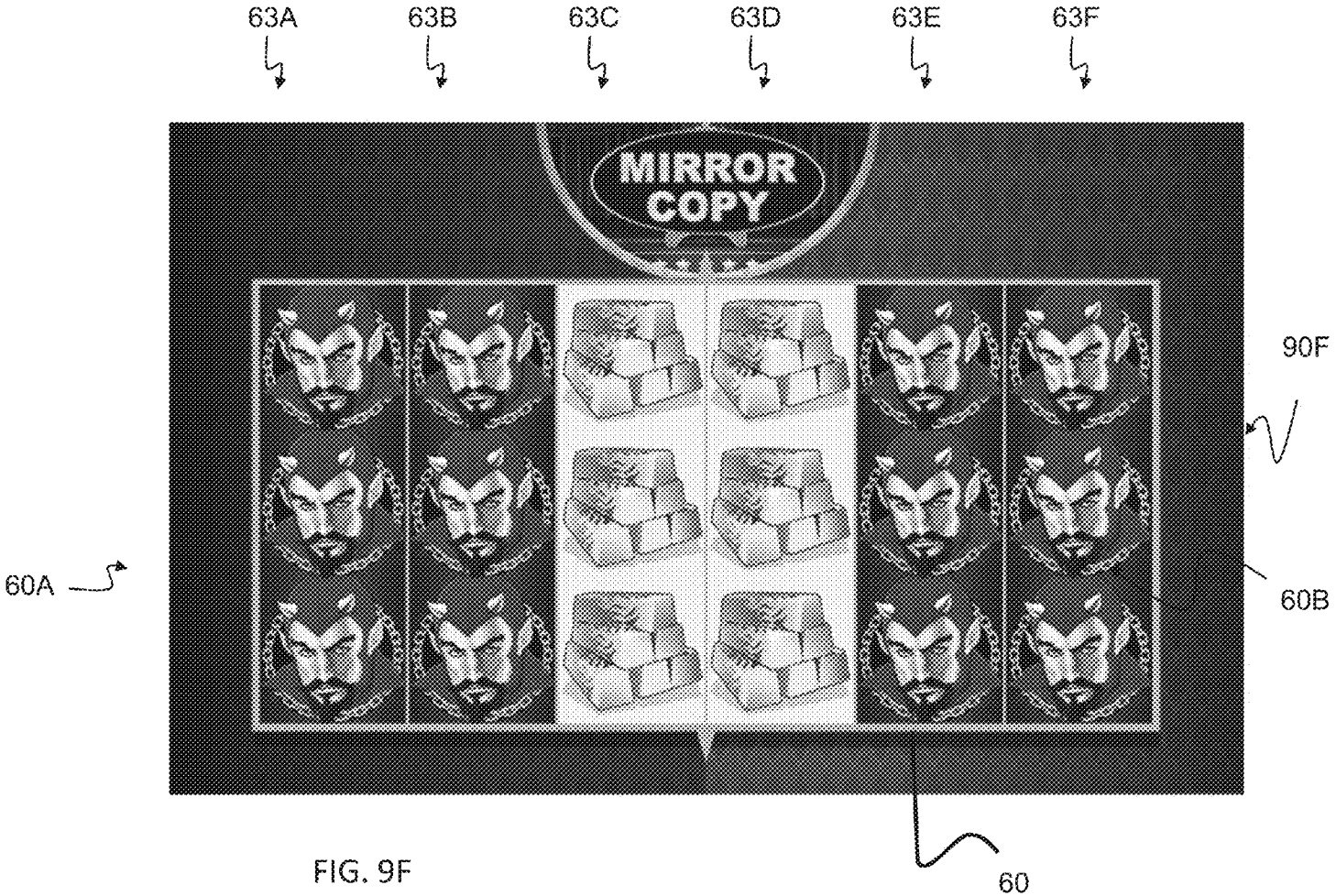

The outcome of the game, comprised of the copied Wild symbols and any remaining symbols from the interim outcome, are shown in the screen shot 90F of FIG. 9F. The outcome of the game is then evaluated and any award is paid to the player.

Figure 10A:
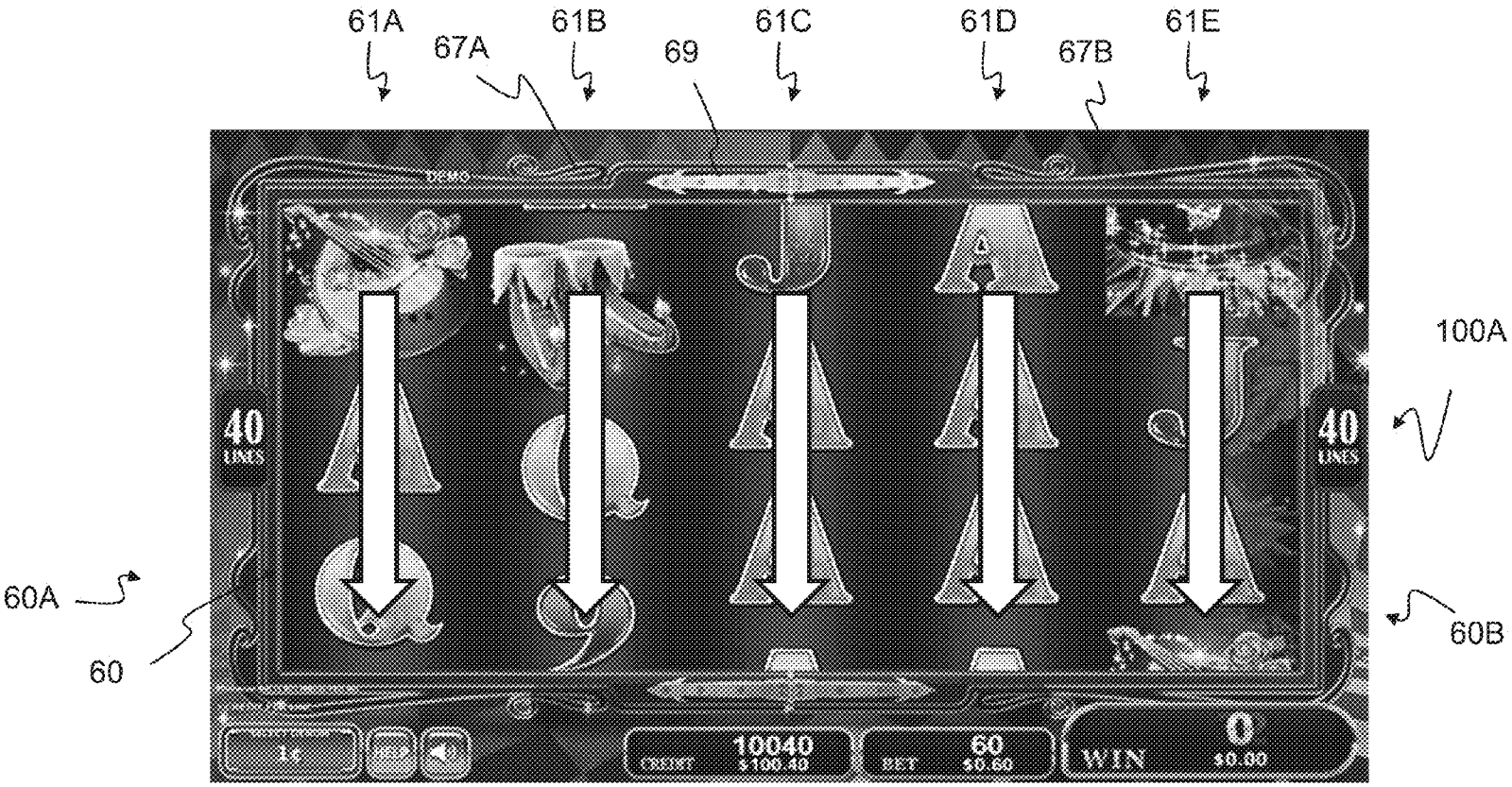
FIGS. 10A-10H are screen shots of the display area of the gaming machine in FIG. 1, according to a second embodiment of the present invention.

With particular reference to FIGS. 10A-10H, screen shots 100A-100H of an instance of a game according to an embodiment of the present invention will be discussed. The game is shown as a video slot game, and may be played on a determination area or grid 60. As shown in FIG. 10A, a 3×5 grid 60 of cells 64 may be used. Thus, the grid 64 has first, second, third, fourth, and fifth columns 61A, 61B, 61C, 61D, 61E, 61F. The left plurality of columns 60A includes the first and second columns 61A, 61B and the right plurality of columns 60B includes the fourth and fifth columns 61D, 61E. The first and fifth columns 61A, 61E are associated (or mirrored). The second and fourth columns 61B, 61D are associated (or mirrored).

In the illustrated embodiment, the grid or display area 60 includes a hinged frame having a left half 67A and a right half 67B that are connected by a hinge 69. In this embodiment, after initiation of the game all of the reels are spun (as shown in the screen shot 100A of FIG. 10A) and the reels are stopped, in turn, from left to right.

Figure 10B:
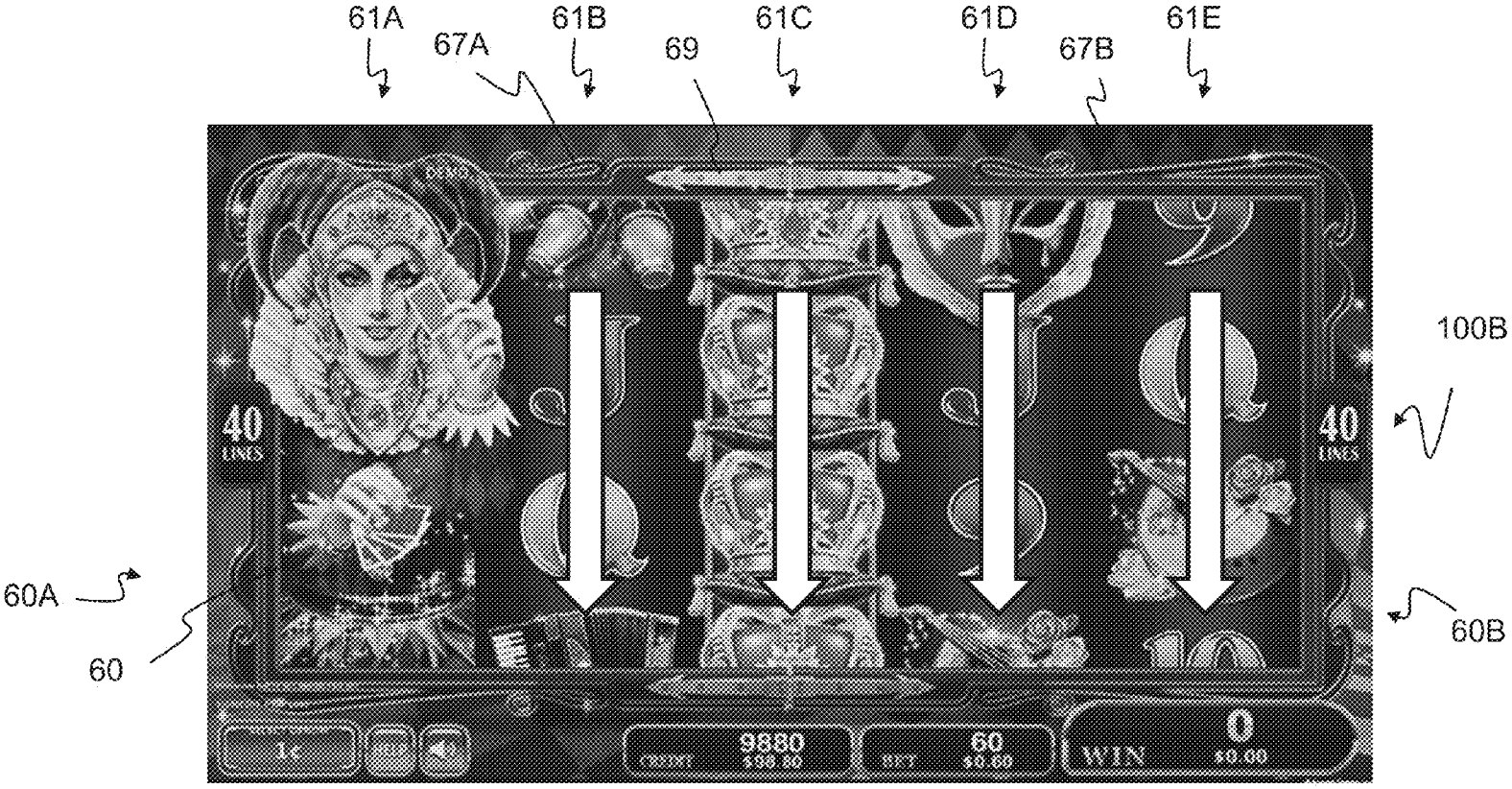
Figure 10C:
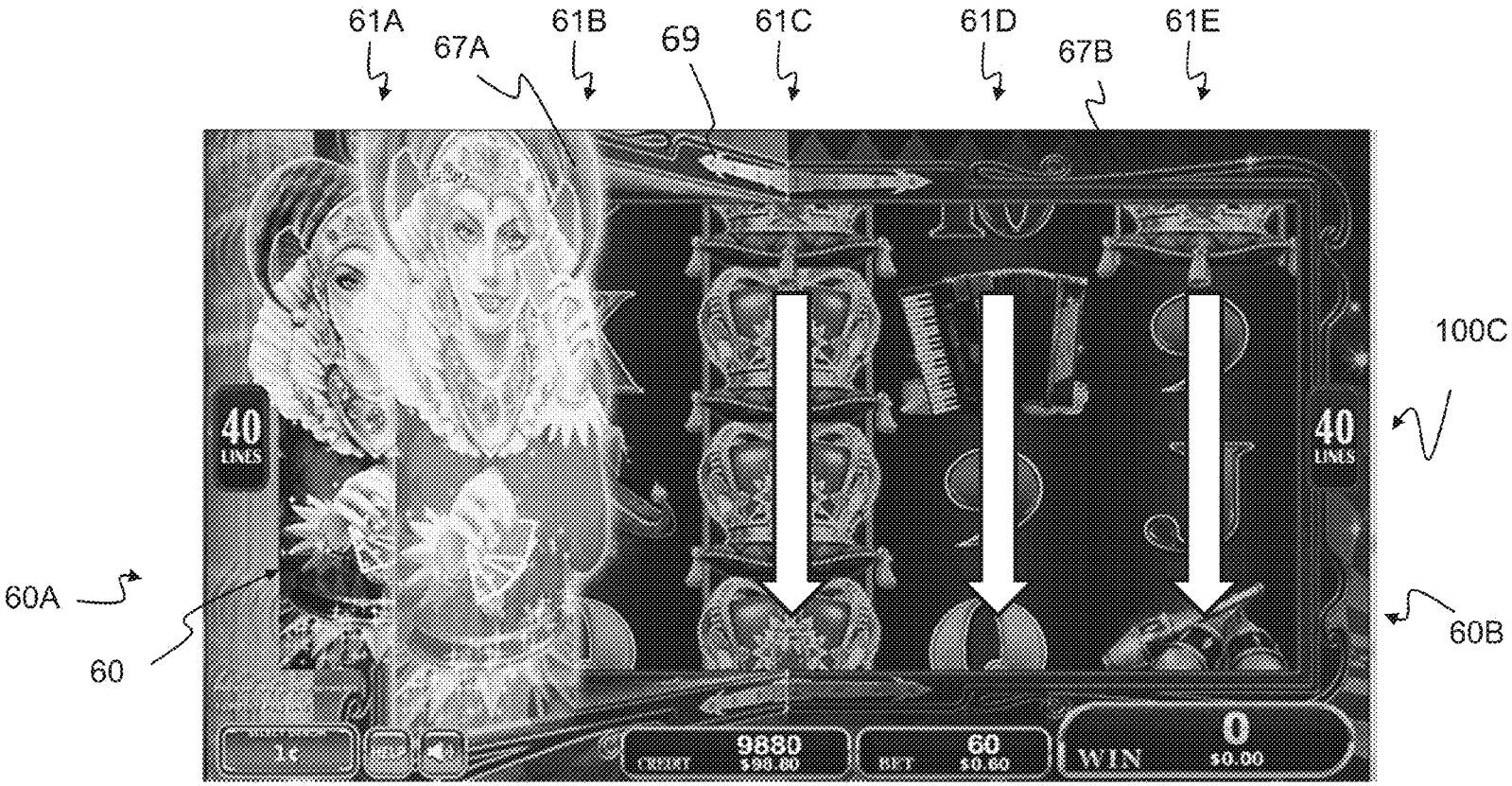
Figure 10D:
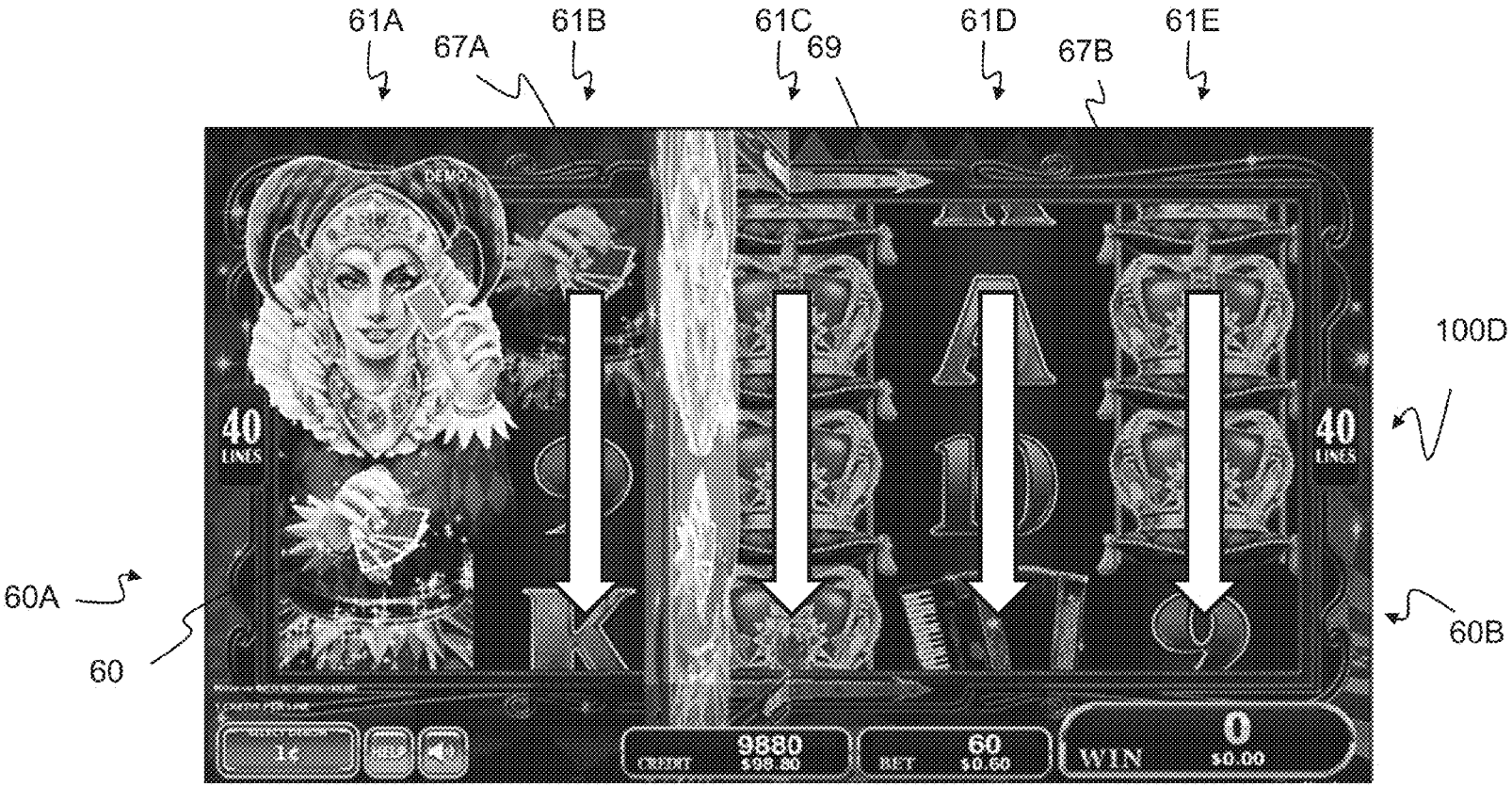
Figure 10E:
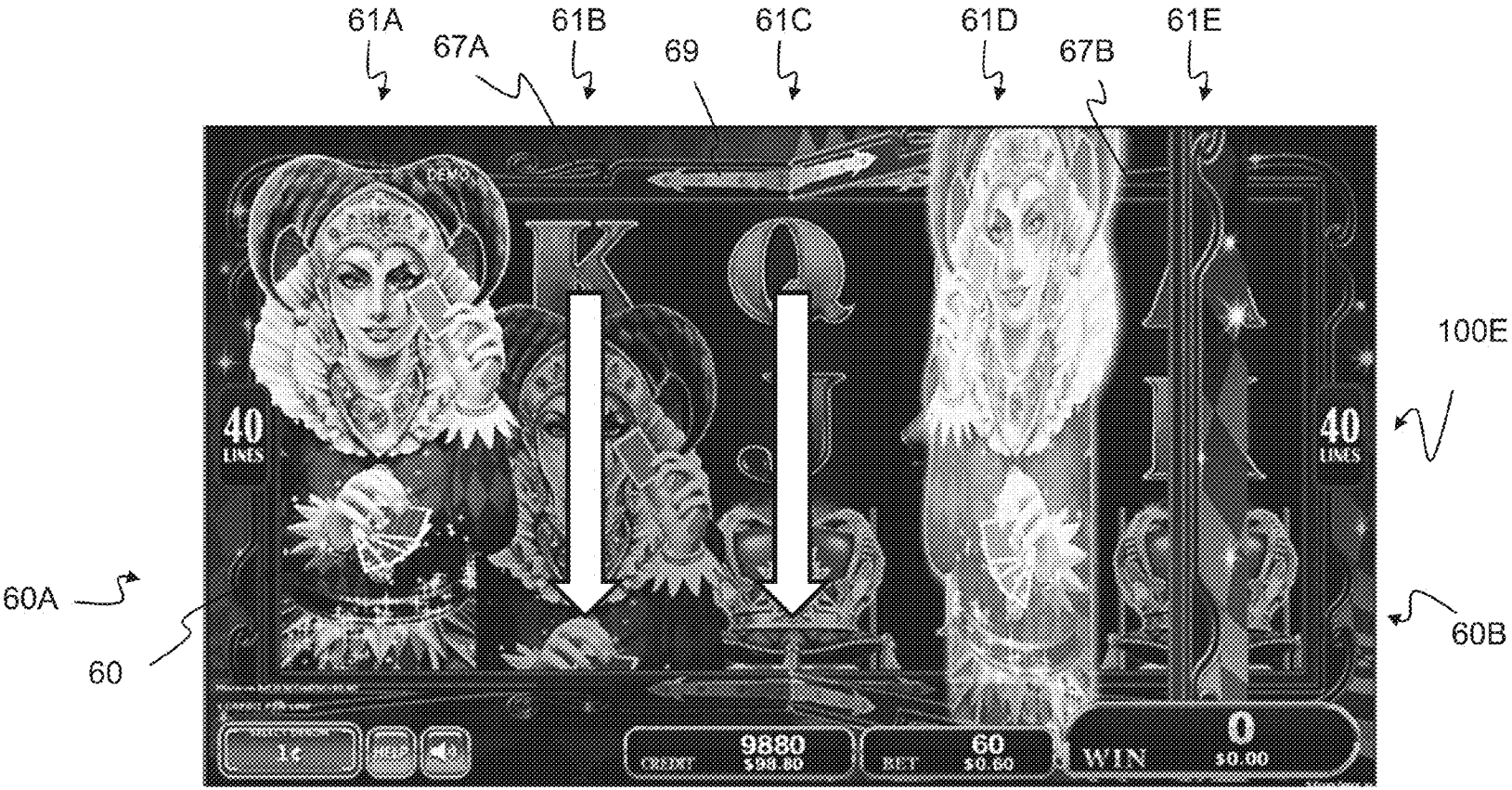
Figure 10F:
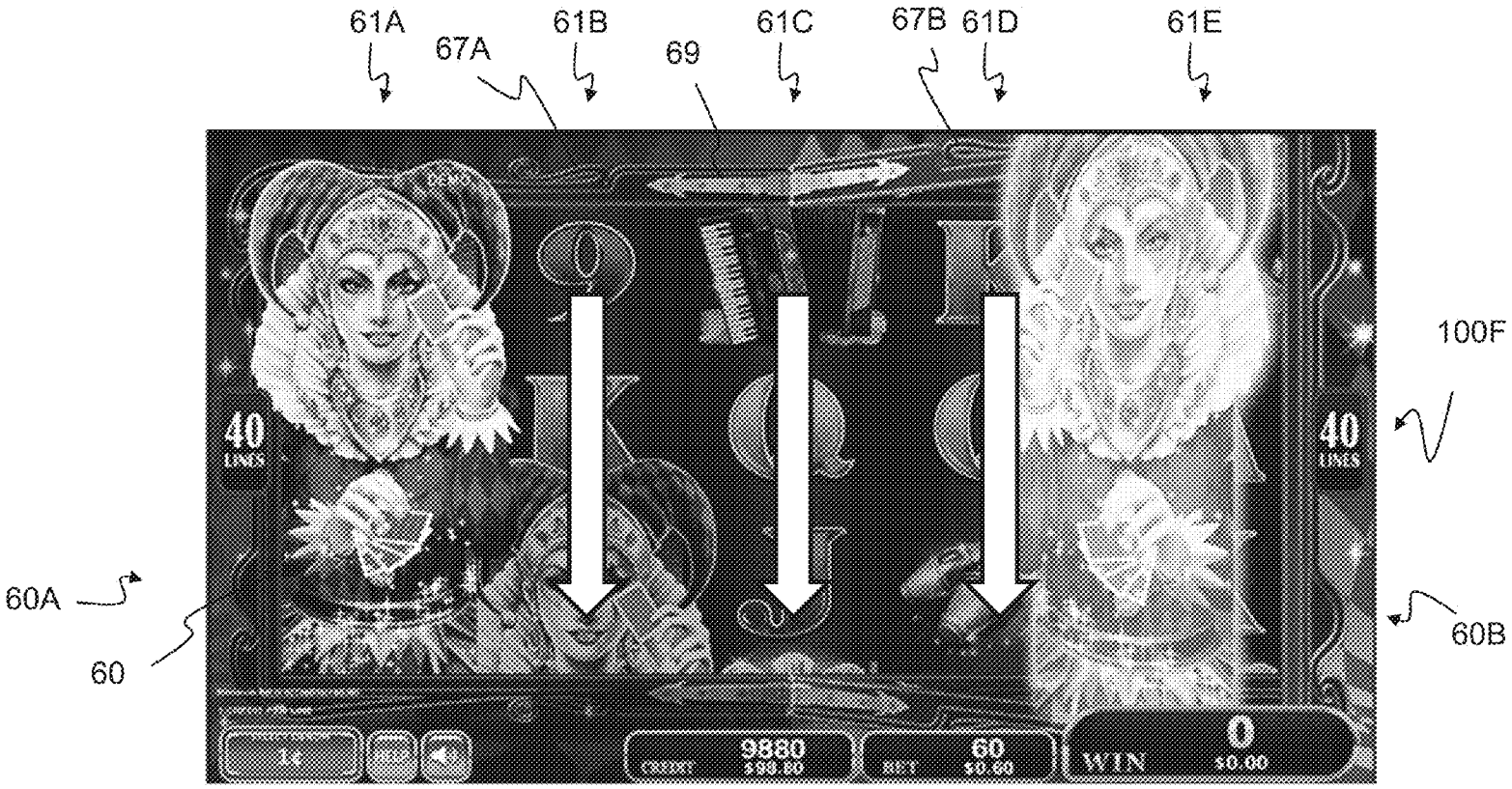
Figure 10G:
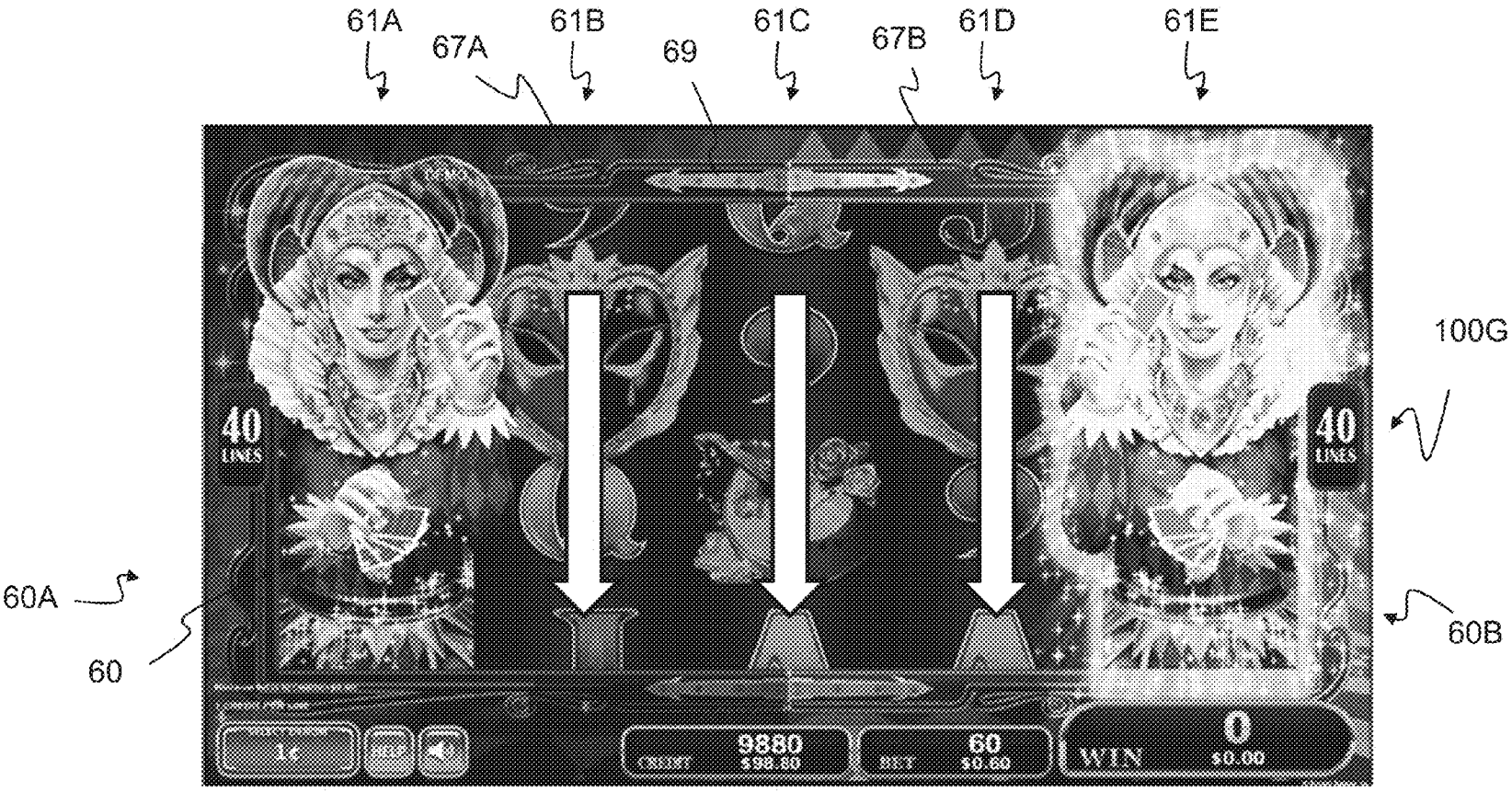

In the screen shot 100B of FIG. 10B, the reel associated with the first column 61A has stopped while the reels associated with the second, third, fourth, and fifth columns 61B, 61C, 61D, 61E continue to spin.

In this embodiment, the identical symbol in the adjacent symbol positions used as a trigger for the Mirror Copy Feature are represented or replaced by a single enlarged symbol that covers all of the adjacent symbol positions. Since all of the cells 64 in the first column 61A are covered by a large Wild symbol or full reel Wild symbol (as shown in FIG. 10B), then a duplicate image of the full reel Wild symbol is generated and the left half 67A of the duplicate image is rotated about the hinge 69 and over to the right half 67B. This animation is shown in the screen shots 100D, 100E, 100F, 100G of FIGS. 10D, 10E, 10F, and 10G.

Figure 10H:
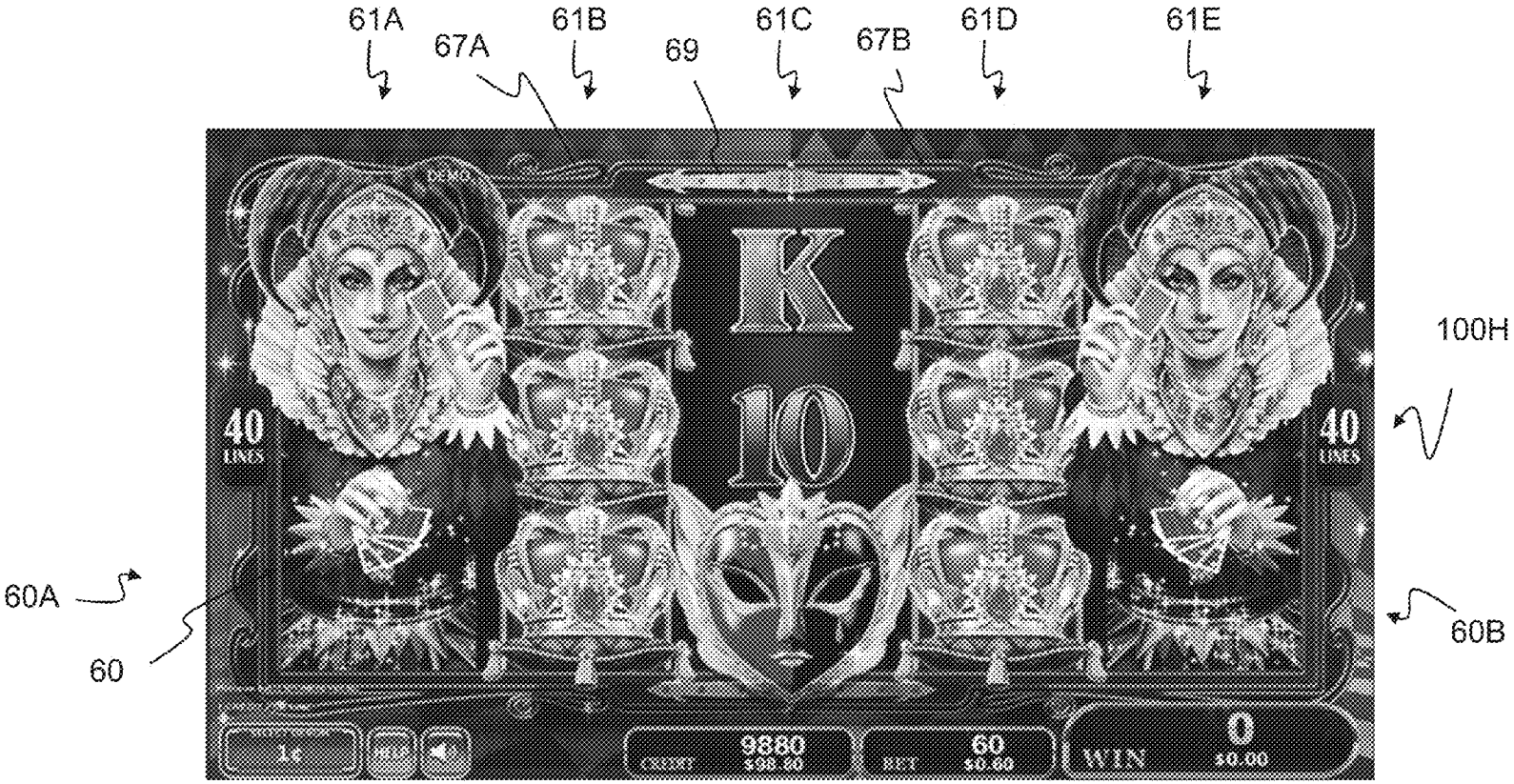

In the screen shot 100H of FIG. 10H, the reels associated with the second, third and fourth columns 61B, 61C, 61D are stopped. Although not visible, the reel associated with the fifth column 61E is also stopped.

The outcome of the game, comprised of the copied full reel Wild symbol and any remaining symbols from the interim outcome, are shown in the screen shot 100H of FIG. 10H. The outcome of the game is then evaluated and any award is paid to the player.

With particular reference to FIGS. 11A-11G, screen shots 110A-110G of another instance of a game according to an embodiment of the present invention will be discussed. The game is shown as a video slot game, and may be played on a determination area or grid 60. As shown in FIG. 10A, a 3×5 grid 60 of cells 64 may be used. Thus, the grid 64 has first, second, third, fourth, and fifth columns 61A, 61B, 61C, 61D, 61E, 61F. The left plurality of columns 60A includes the first and second columns 61A, 61B and the right plurality of columns 60B includes the fourth and fifth columns 61D, 61E. The first and fifth columns 61A, 61E are associated (or mirrored). The second and fourth columns 61B, 61D are associated (or mirrored).

In the illustrated embodiment, the grid or display area 60 includes a hinged frame having a left half 67A and a right half 67B that are connected by a hinge 69. In this embodiment, after initiation of the game all of the reels are spun and the reels are stopped, in turn, from left to right.

Figure 11A:
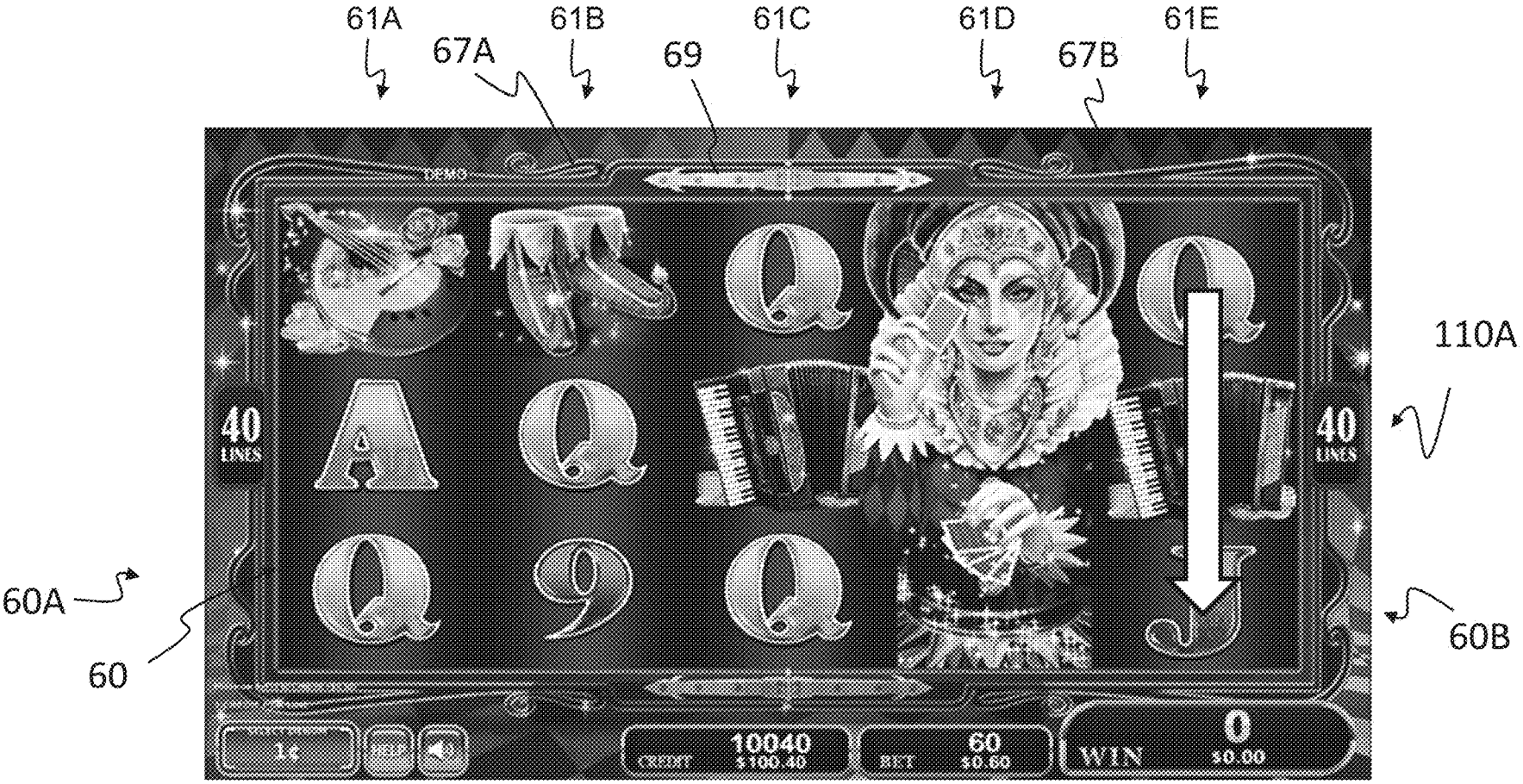
FIGS. 11A-11G are screen shots of the display area of the gaming machine in FIG. 1, according to a third embodiment of the present invention.

In the screen shot 110A of FIG. 11A, the reels associated with the first, second, third and fourth columns 61A, 61B, 61C, 61D have stopped and the reel associated with the fifth column is still spinning.

Figure 11B:
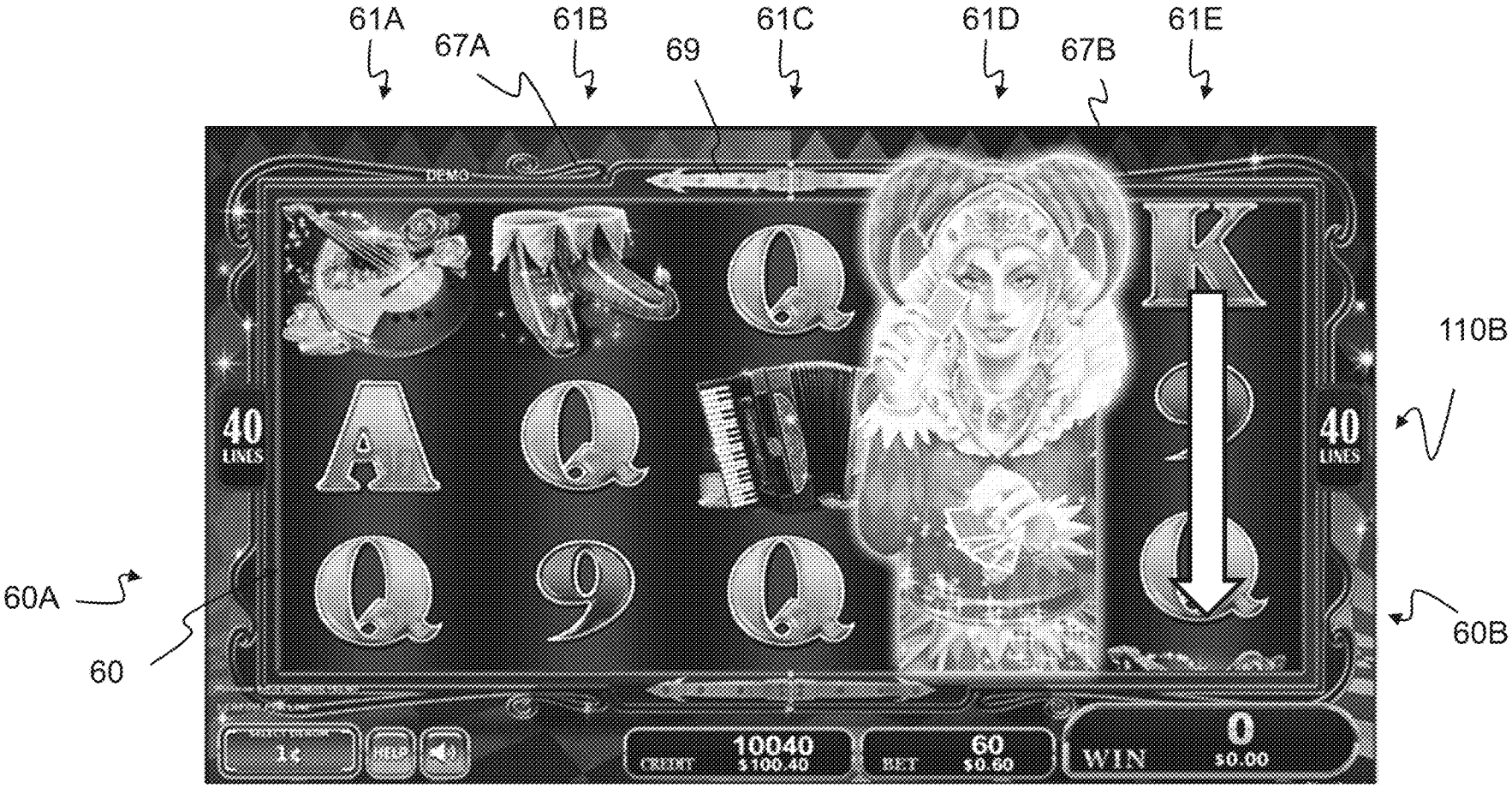
Figure 11C:
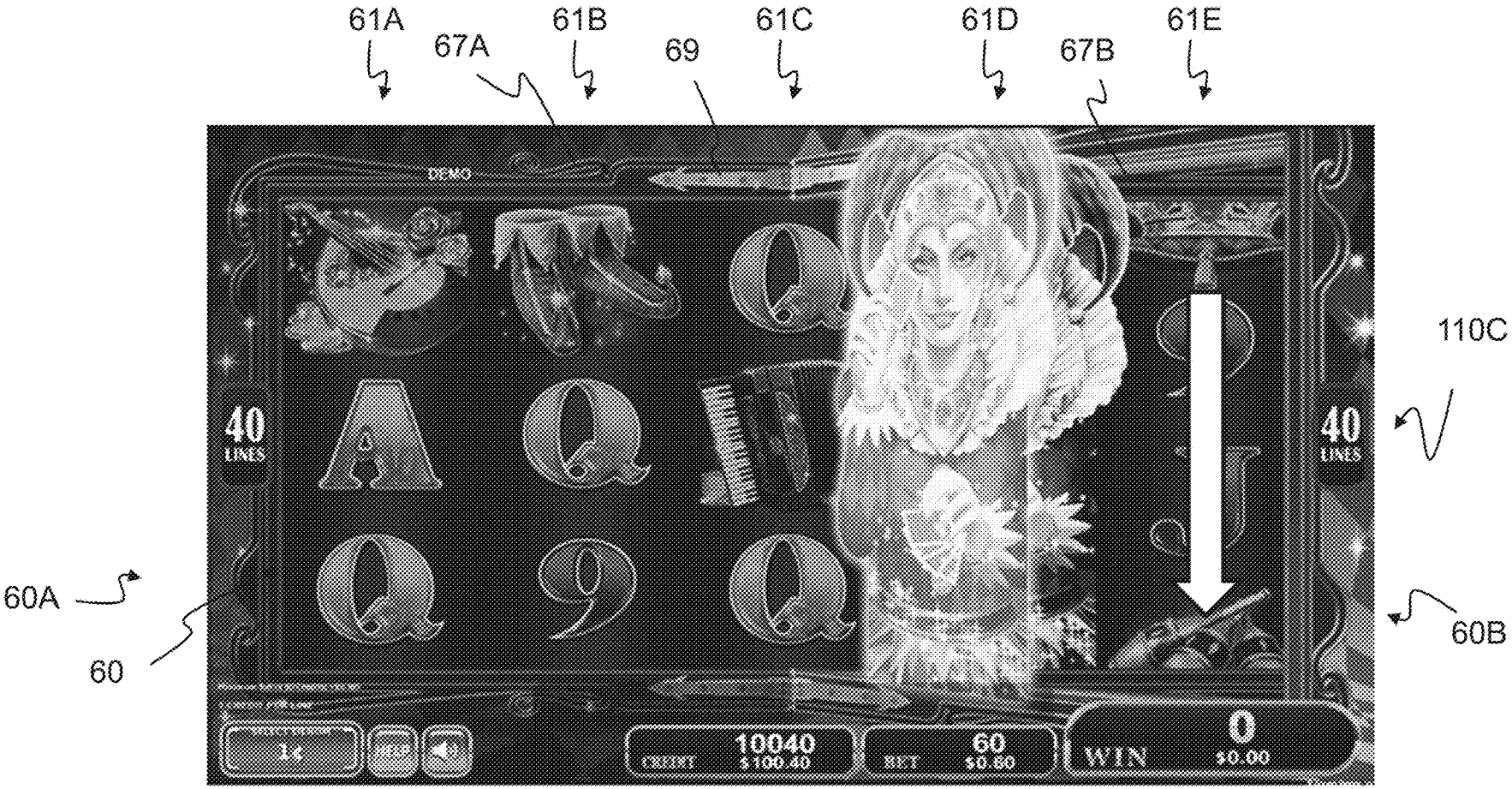
Figure 11D:
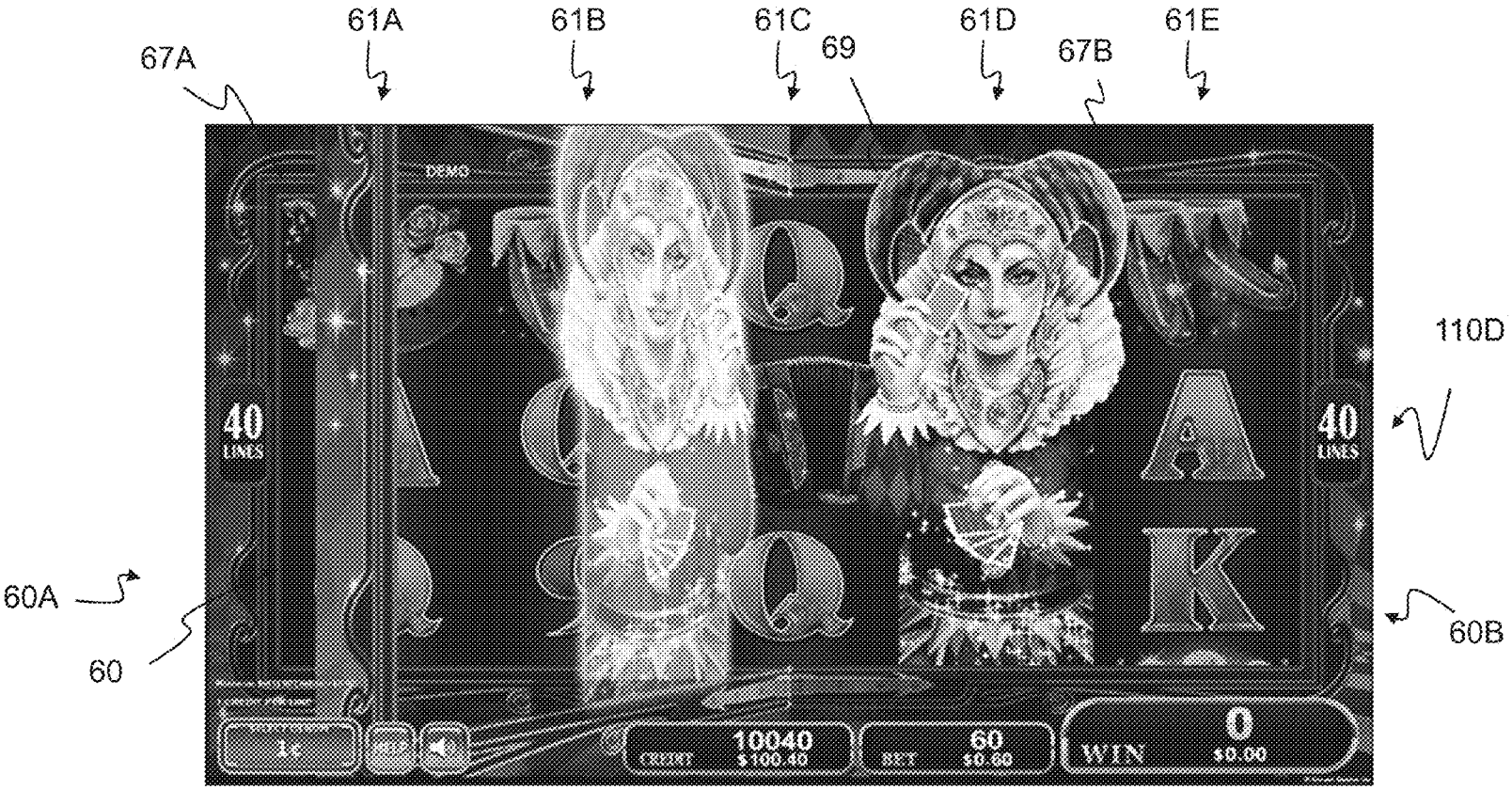
Figure 11E:
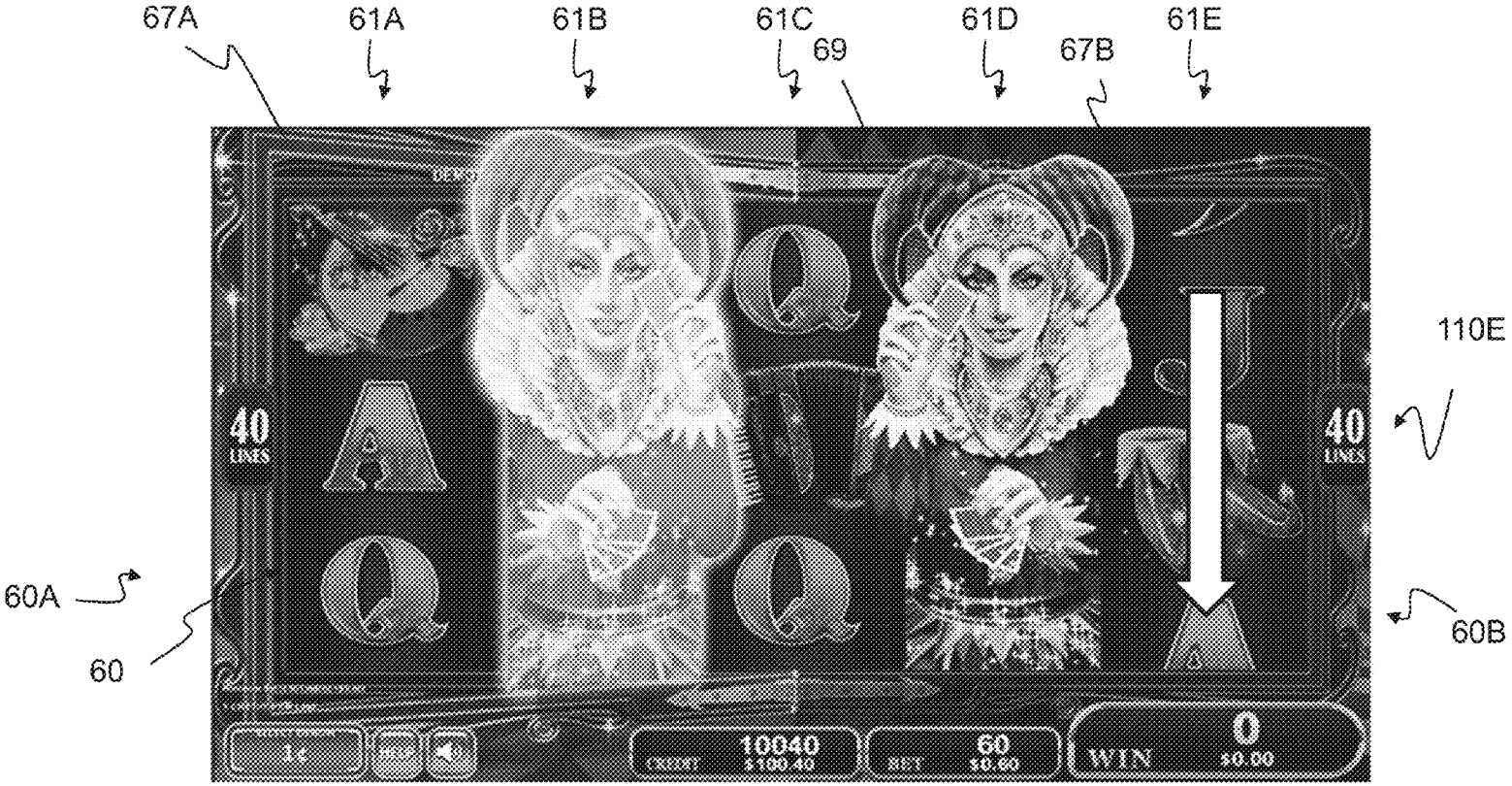
Figure 11F:
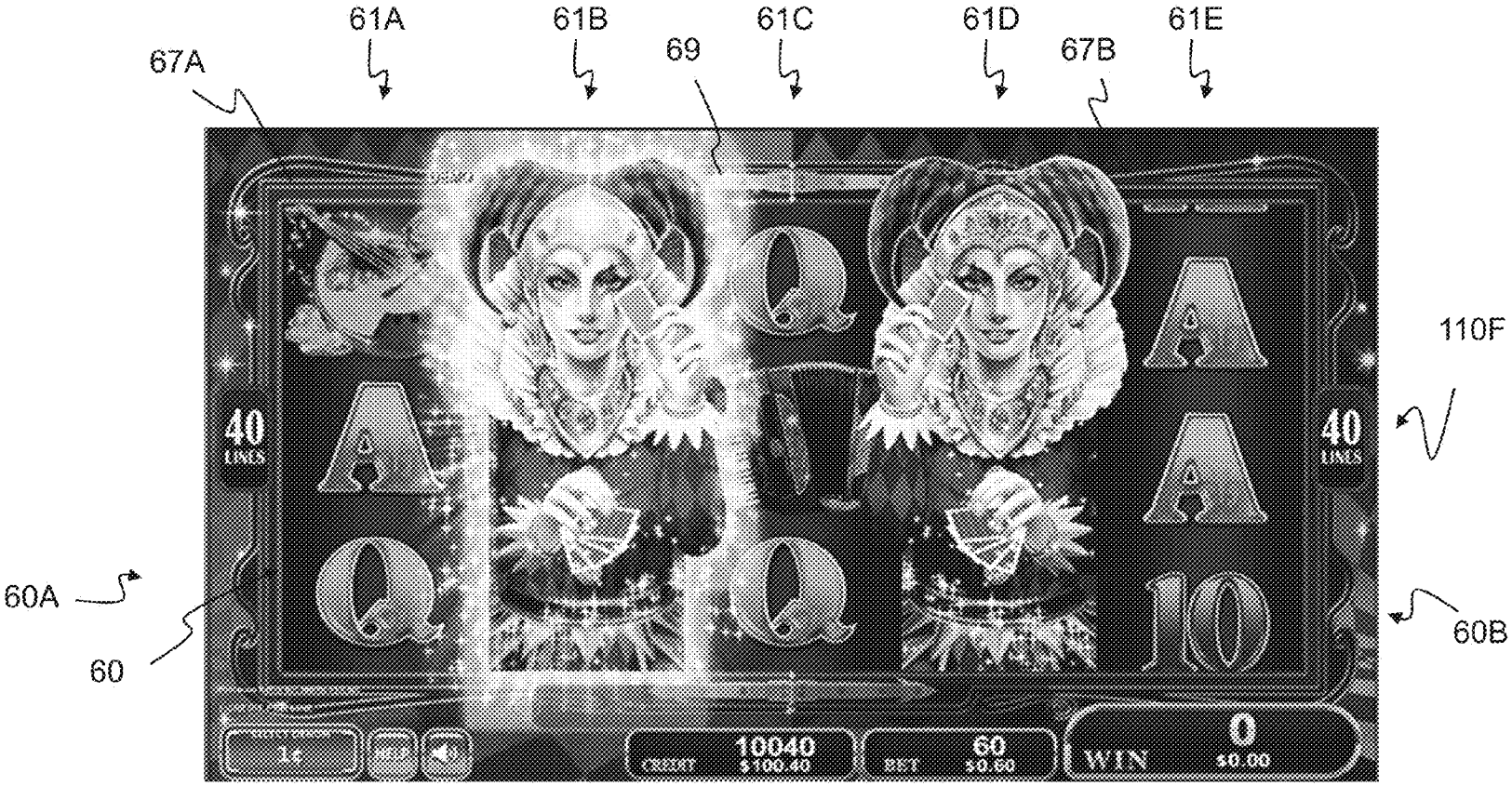

In this embodiment, the identical symbol in the adjacent symbol positions used as a trigger for the Mirror Copy Feature are represented or replaced by a single enlarged symbol that covers all of the adjacent symbol positions. Since all of the cells 64 in the fourth column 61D are covered by a large Wild symbol or full reel Wild symbol (as shown in FIG. 11B), then a duplicate image of the full reel Wild symbol is generated and the right half 67B of the duplicate image is rotated about the hinge 69 and over to the left half 67A. This animation is shown in the screen shots 110B, 110C, 110D, 110E, 110F of FIGS. 11B, 11C, 11D, 11E, and 11F, respectively.

Figure 11G:
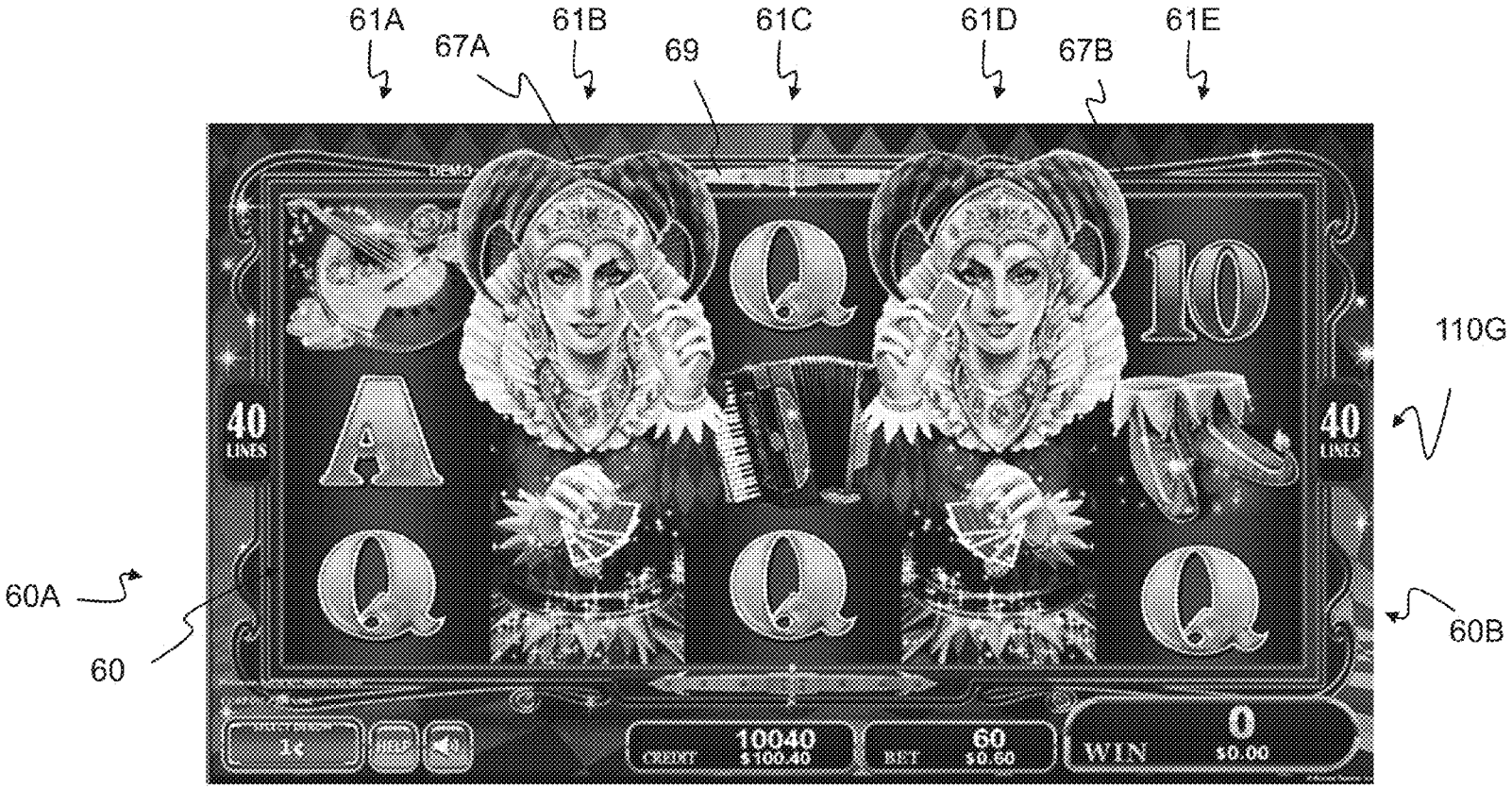

In the screen shot 110G of FIG. 11G, the reel associated with the fifth column 61E is stopped. The outcome of the game, comprised of the copied full reel Wild symbol and any remaining symbols from the interim outcome, are shown in the screen shot 110G of FIG. 11G. The outcome of the game is then evaluated and any award is paid to the player.

Figure 12A:
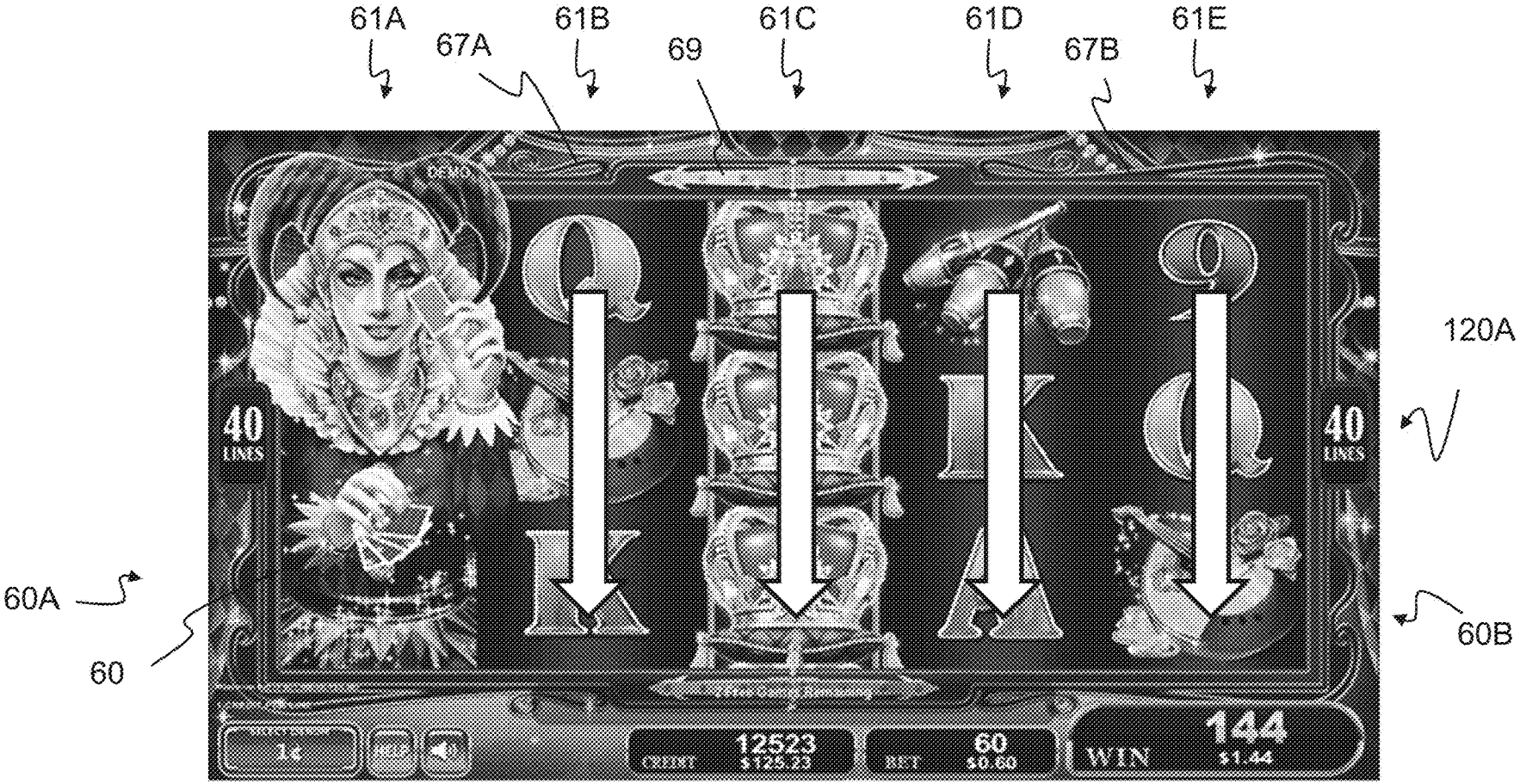
FIGS. 12A-12H are screen shots of the display area of the gaming machine in FIG. 1, according to a fourth embodiment of the present invention.
Figure 12B:
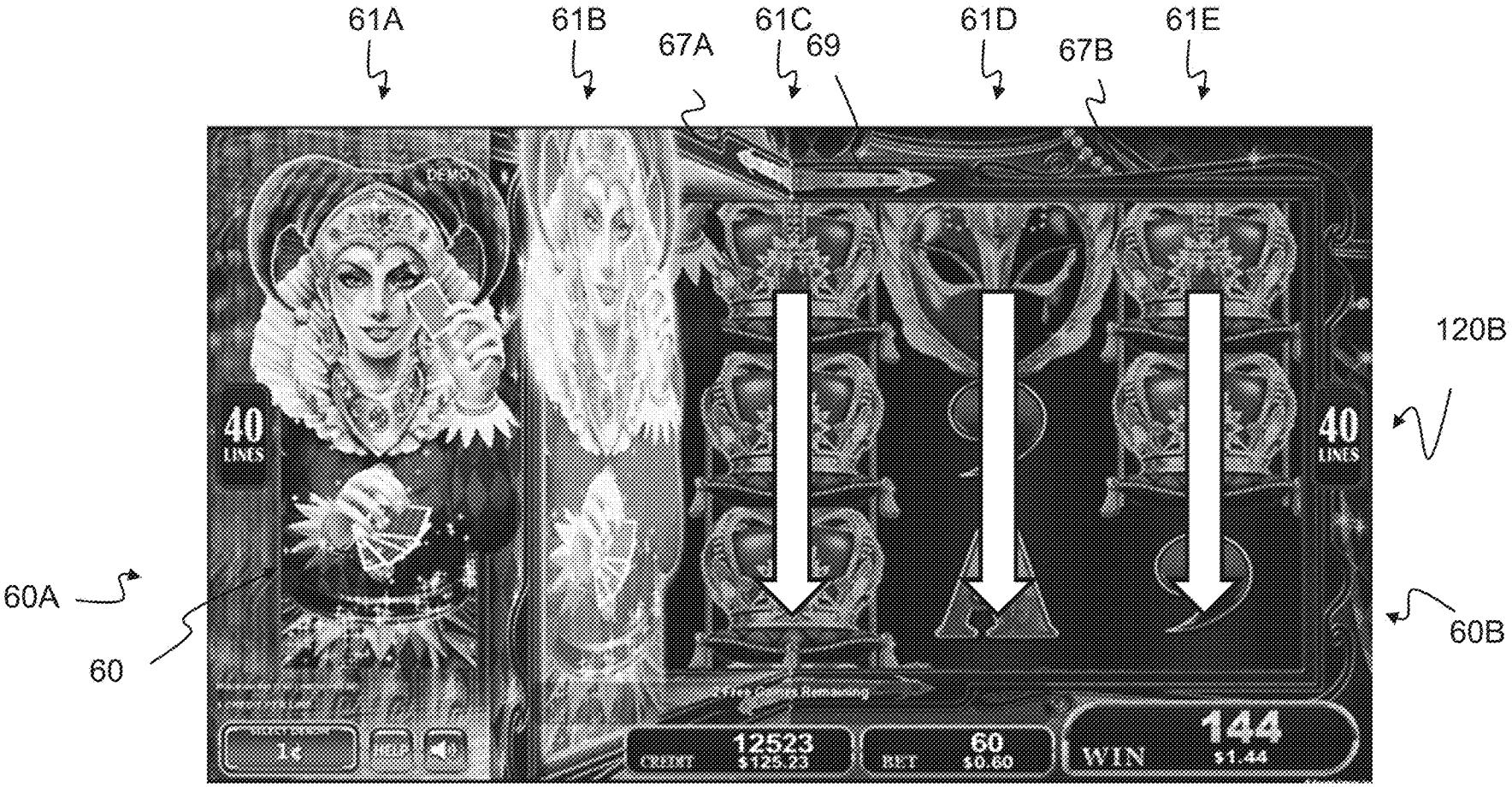
Figure 12C:
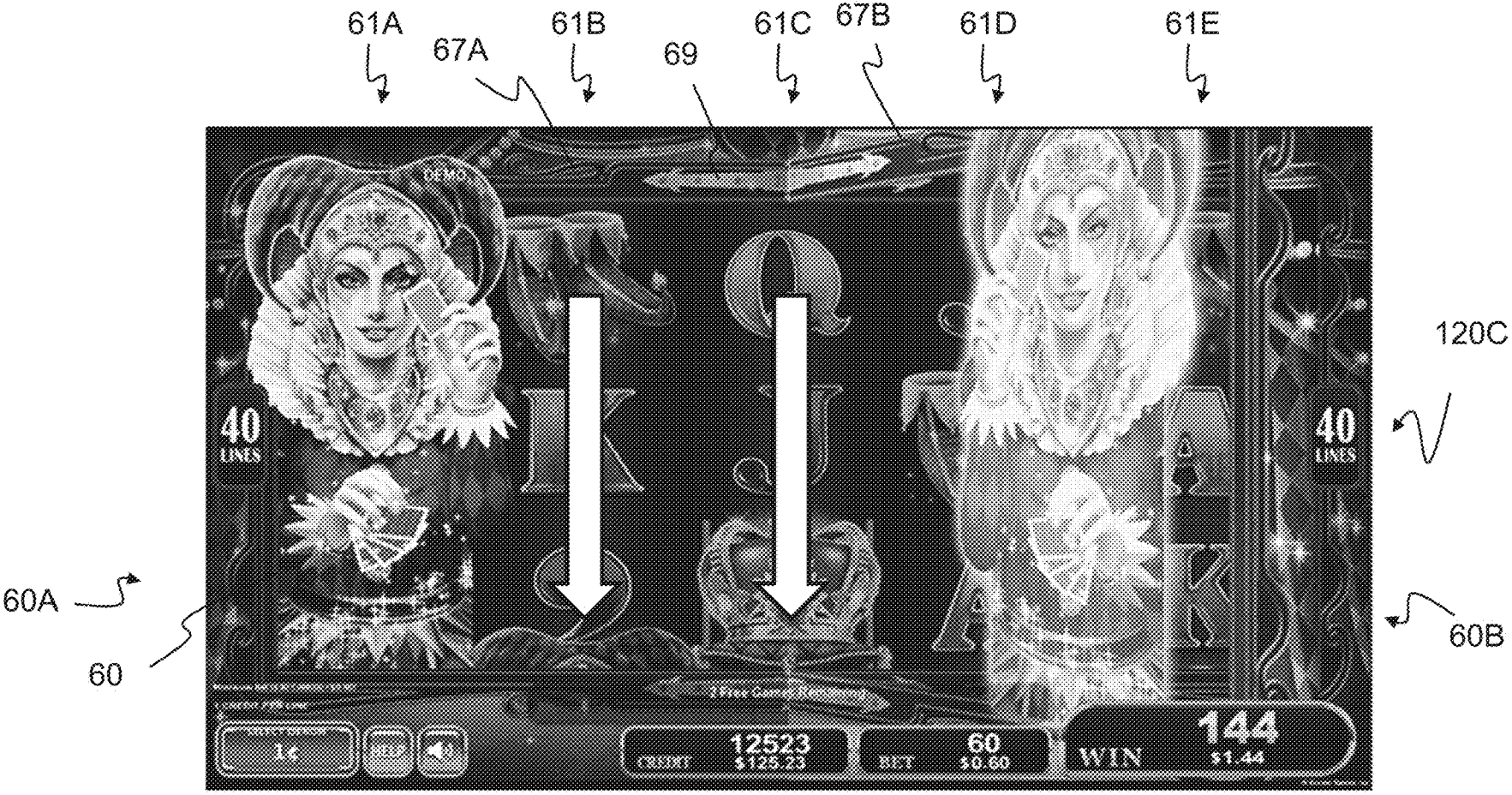
Figure 12D:
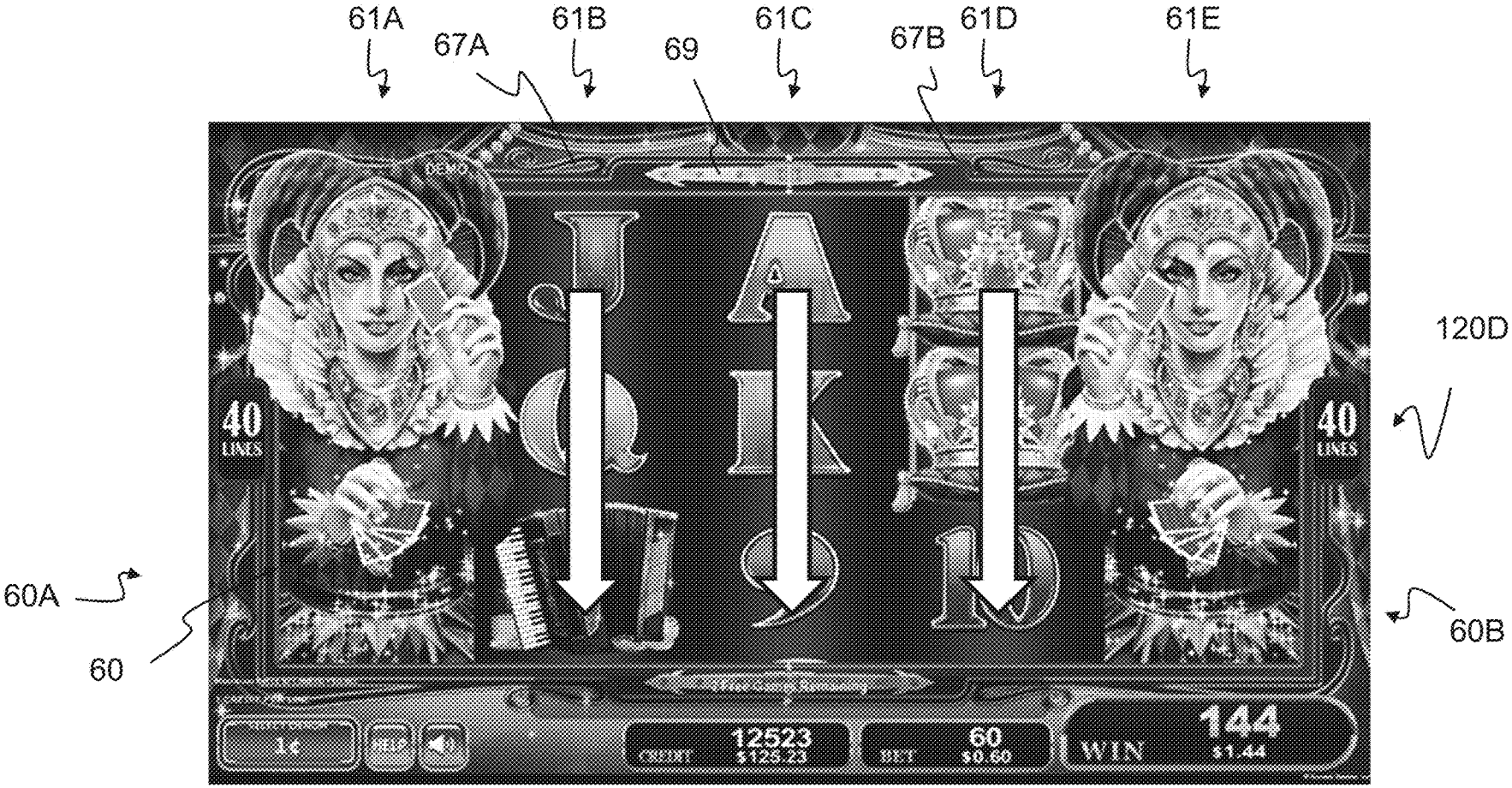

With particular reference to FIGS. 12A-12H, screen shots 120A-120H of an instance of a game according to an embodiment of the present invention will be discussed. The game is shown as a video slot game, and may be played on a determination area or grid 60. As shown in FIG. 12A, a 3×5 grid 60 of cells 64 may be used. Thus, the grid 64 has first, second, third, fourth, and fifth columns 61A, 61B, 61C, 61D, 61E, 61F. The left plurality of columns 60A includes the first and second columns 61A, 61B and the right plurality of columns 60B includes the fourth and fifth columns 61D, 61E. The first and fifth columns 61A, 61E are associated (or mirrored). The second and fourth columns 61B, 61D are associated (or mirrored).

In the illustrated embodiment, the grid or display area 60 includes a hinged frame having a left half 67A and a right half 67B that are connected by a hinge 69. In this embodiment, after initiation of the game all of the reels are spun and the reels are stopped, in turn, from left to right.

In the screen shot 120A of FIG. 12A, the reel associated with the first column 61A has stopped while the reels associated with the second, third, fourth, and fifth columns 61B, 61C, 61D, 61E continue to spin.

In this embodiment, the identical symbol in the adjacent symbol positions used as a trigger for the Mirror Copy Feature are represented or replaced by a single enlarged symbol that covers all of the adjacent symbol positions. Since all of the cells 64 in the first column 61A are covered by a large Wild symbol or full reel Wild symbol (as shown in FIG. 12A), then a duplicate image of the full reel Wild symbol is generated and the left half 67A of the duplicate image is rotated about the hinge 69 and over to the right half 67B. This animation is shown in the screen shots 120B, 120C, 120D of FIGS. 12B, 12C, 12D, respectively.

Figure 12E:
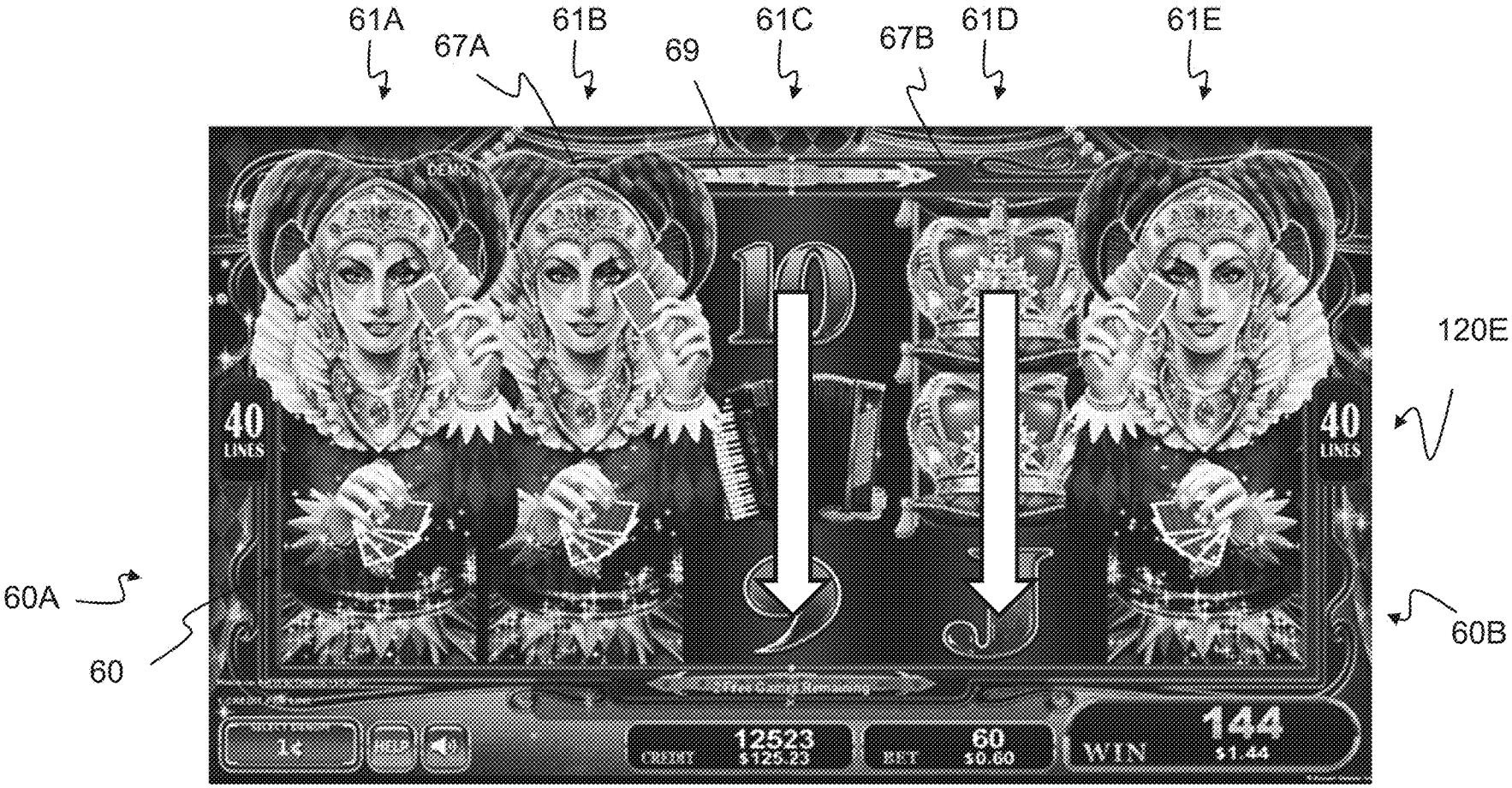
Figure 12F:
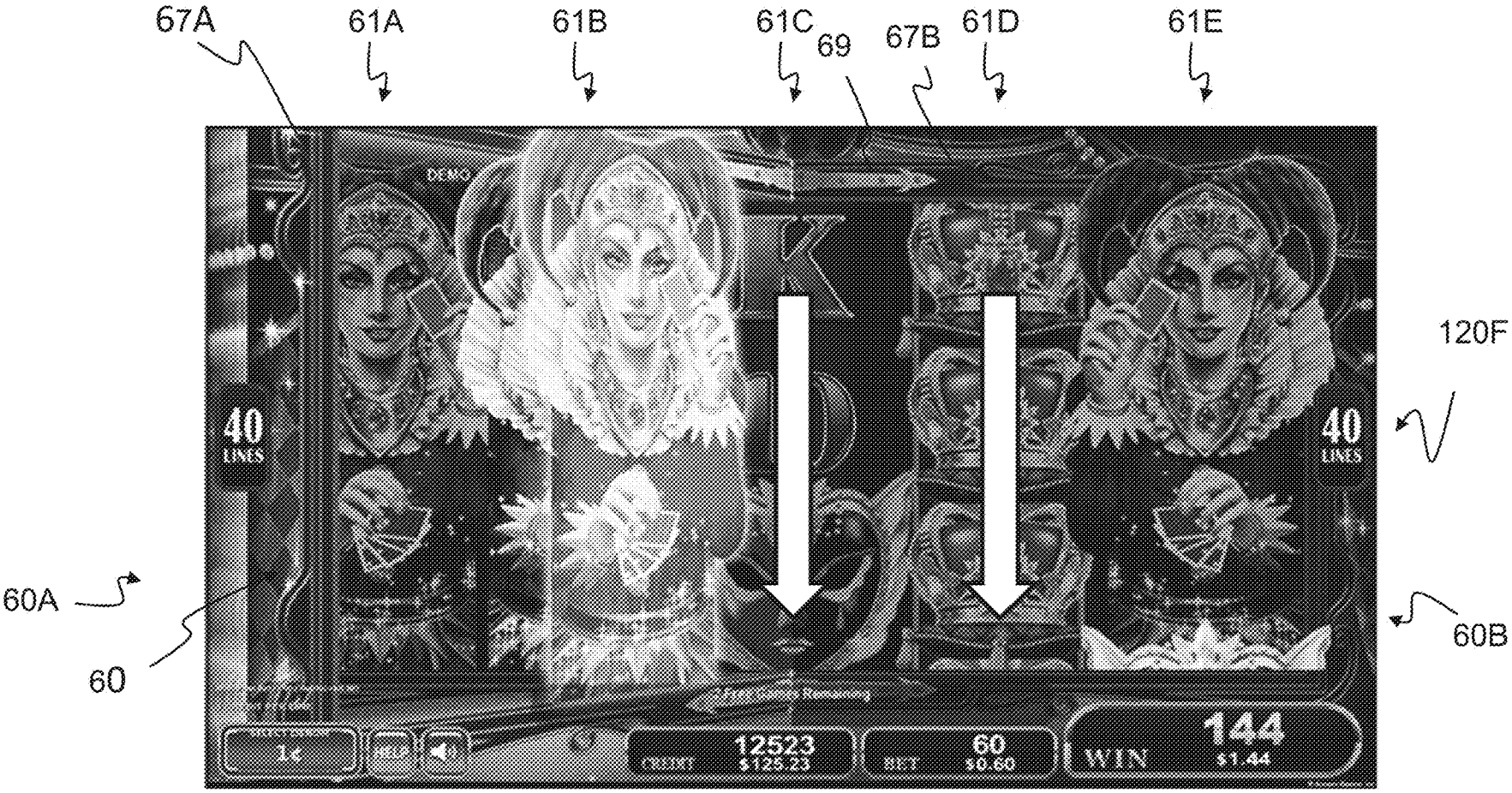
Figure 12G:
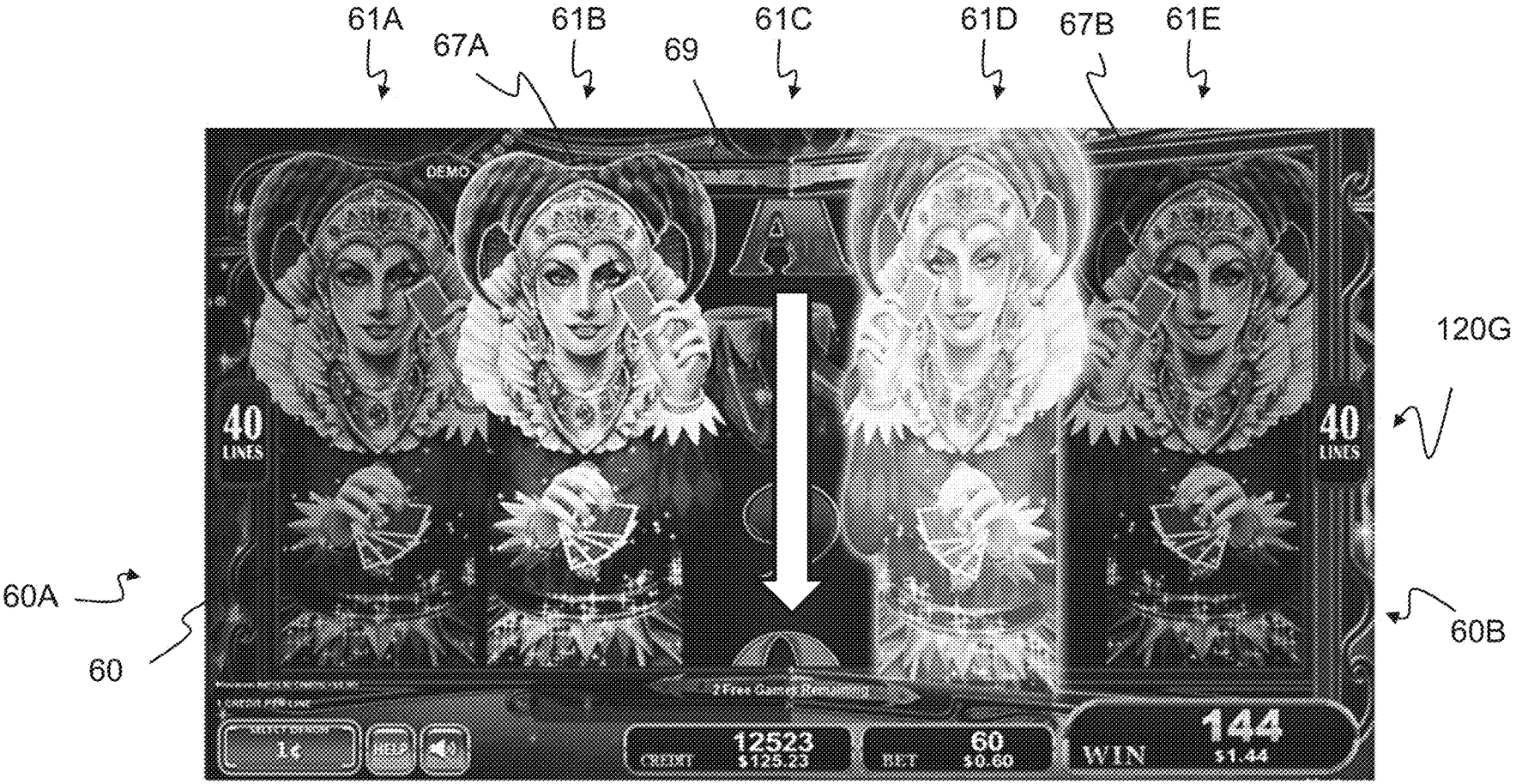

In the screen shot 120E of FIG. 12E, the reel associated with the second column 61B is stopped. Since all of the cells 64 in the second column 61B are covered by a large Wild symbol or full reel Wild symbol (as shown in FIG. 12E), then a duplicate image of the full reel Wild symbol is generated and the left half 67A of the duplicate image is rotated about the hinge 69 and over to the right half 67B. This animation is shown in the screen shots 120F, 120G of FIGS. 12F and 12G, respectively.

Figure 12H:
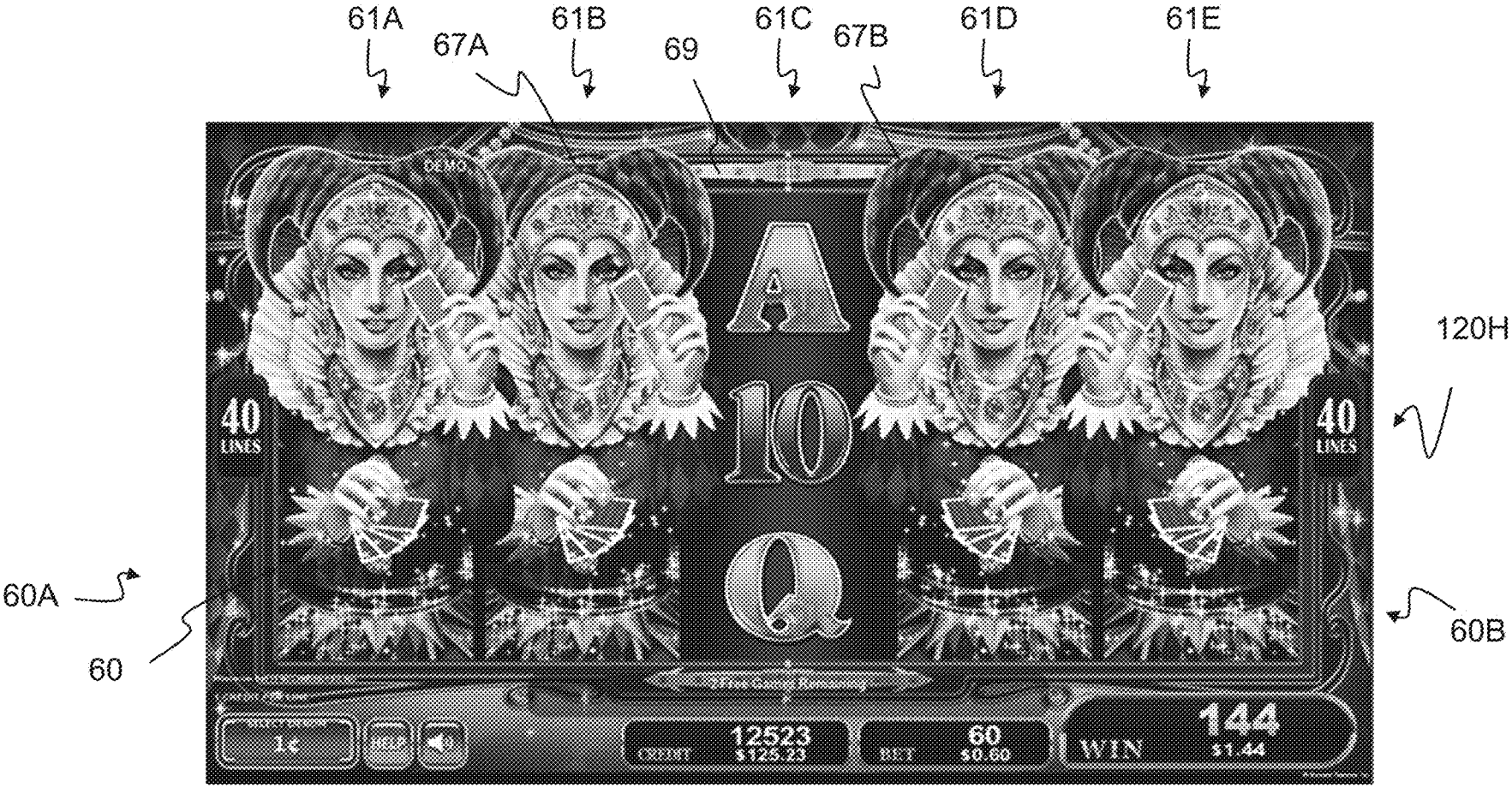

In the screen shot 120H of FIG. 12H, the reels associated with the third, fourth, and fifth columns 61C, 61D, 61E are stopped. The outcome of the game, comprised of the copied full reel Wild symbols and any remaining symbols from the interim outcome, are shown in the screen shot 120G of FIG. 12G. The outcome of the game is then evaluated and any award is paid to the player.

In the embodiments discussed above, if the trigger condition occurs with respect to any column in the left plurality of columns, then the symbols in the cells 64 of the column may be copied to the mirror or associated column in the right plurality of columns while the reel associated with the mirror or associated column in still spinning. However, in other embodiments, the symbols may be copied after all reels have stopped spinning. If symbols from more than one column are to be copied, all of the symbols may be copied simultaneously. Alternatively, the symbols may be copied sequentially, independently, by columns, or some other arrangement.

Figure 13:
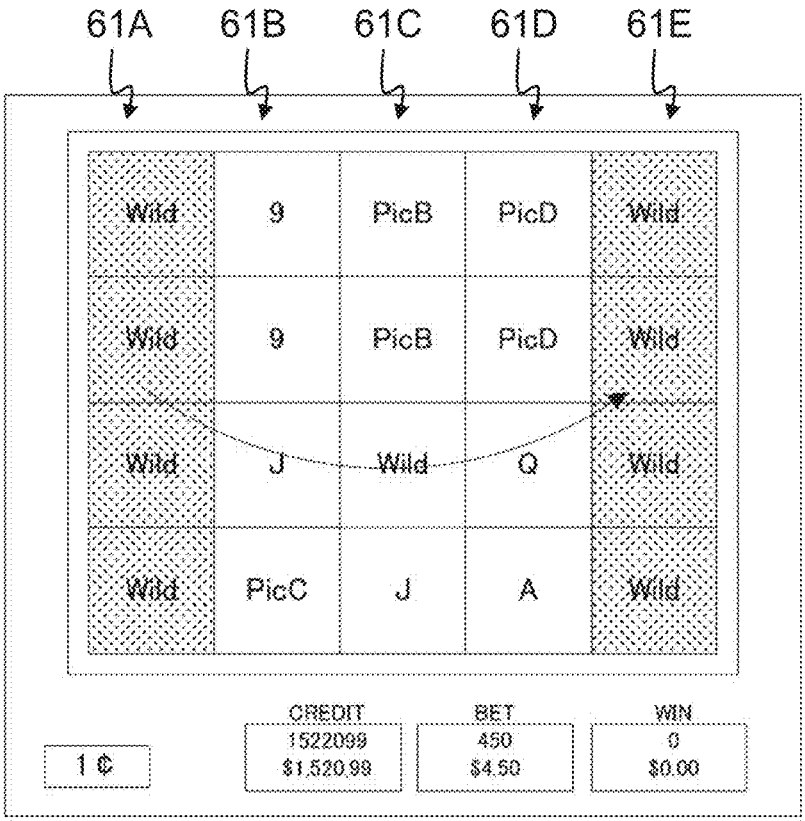
FIG. 13 is a diagrammatic illustration of the primary display area, in a first alternate embodiment.

In the embodiments discussed in detail above, the grid 60 has 3 rows. However, the present invention is not limited to a grid having three rows. For example, in FIG. 13, a 4×5 grid is shown. The number of symbol positions in a plurality of adjacent symbol positions may be less than, equal to, or greater than 4. In the illustrated embodiment, a stack of 4 Wild symbols appears in the cells 64 of the first column 61A. The stack of 4 Wild symbols from the first column 61A are copied to the fifth column as shown.

Figure 14:
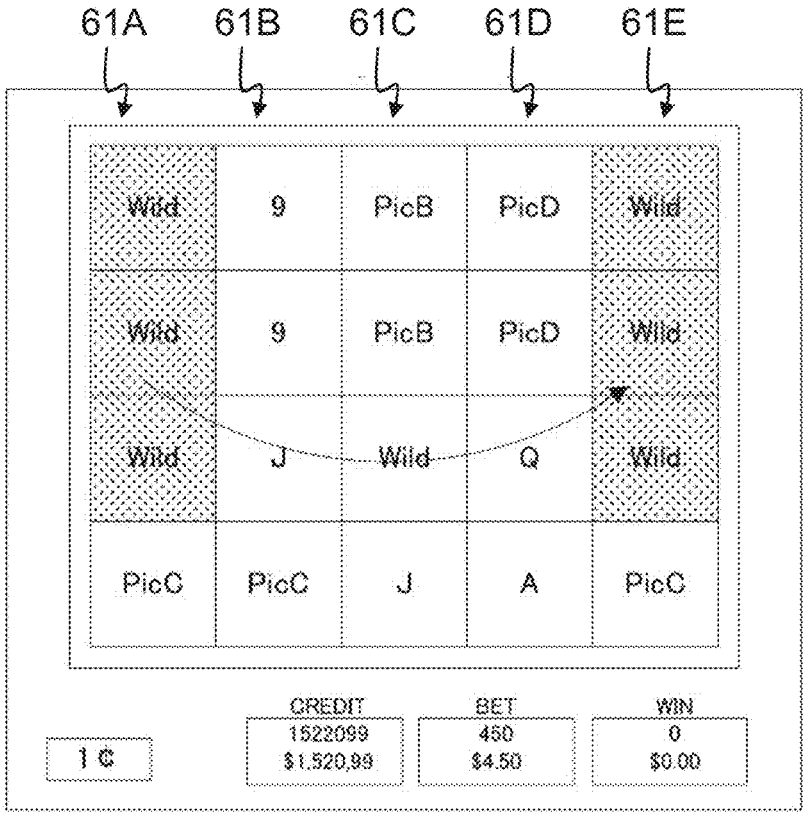
FIG. 14 is a diagrammatic illustration of the primary display area, in a second alternate embodiment.

In the embodiments discussed in detail above, the Mirror Copy Feature is triggered when all of the cells 64 in a column contain a Wild symbol. Further in these embodiment, the size of the stack of Wild symbols is equal to the size of the column. In some embodiment, the size of the stack of Wild symbols may be less than or greater than the size of a column. Additionally, the trigger condition may not require that all cells 64 in a column contain the identical symbol. The trigger condition may require 1, 2 or more symbols in a column. This number may be less than the number of rows, i.e., the size of the column. For example, as shown in FIG. 14, a 4×5 grid is shown. The first column 61A includes 3 Wild symbols. The three Wild symbols in the first column 61A trigger the Mirror Copy Feature and the symbols in the first column are copied to the fifth column 61E.

Figure 15:
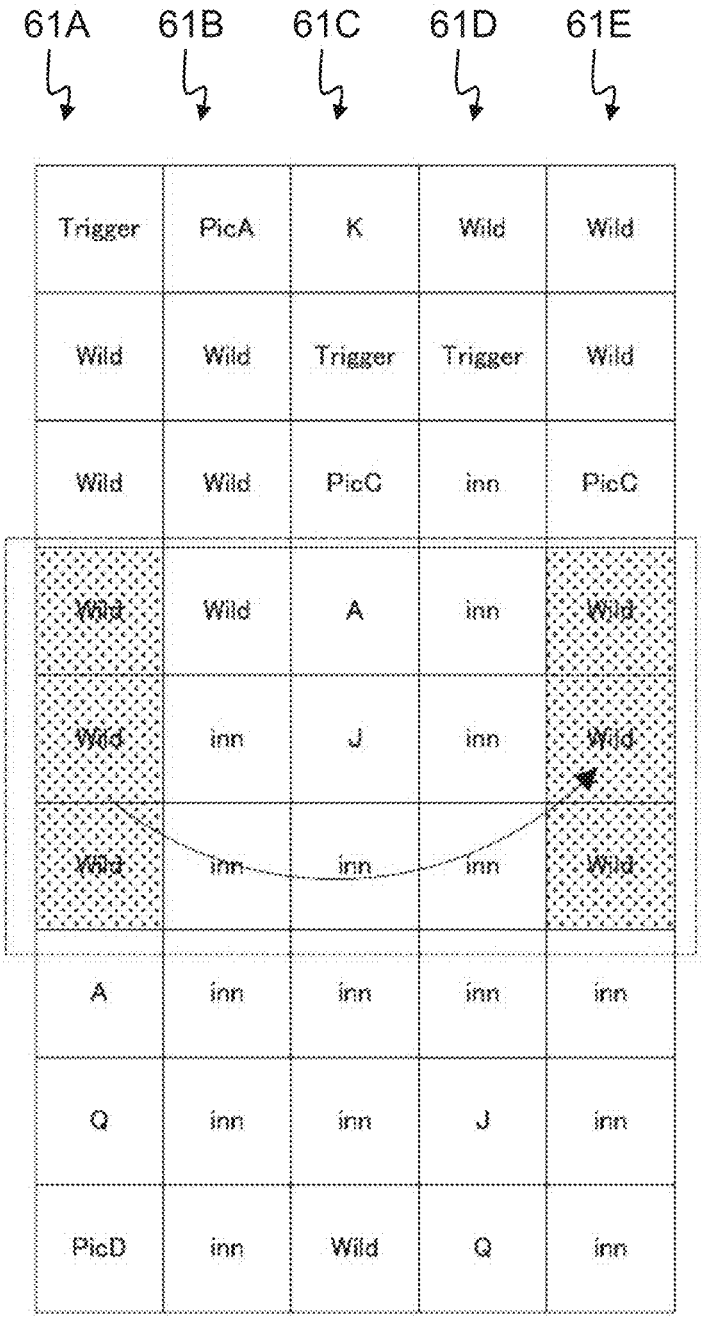
FIG. 15 is a diagrammatic illustration of the primary display area, in a third alternate embodiment.

With reference to FIG. 15, in this embodiment the reel strips may include a plurality of adjacent symbol positions containing the identical symbol, e.g., a Wild symbol, where the plurality of adjacent symbol position is greater than the number of rows or size of the columns.

In another aspect of the present invention, a control method for a gaming machine 10 to provide a game to a player is provided. The gaming machine 10 includes a control unit 50, an operation unit 36, and a display unit 28. The operation unit 36 is configured to receive operation from the player. The display unit 28 is operably coupled to the operation unit 36 and is configured to display a plurality of cells 64. The plurality of cells 64 are arranged in a plurality of rows and columns. The control unit 50 is operably coupled to the operation unit 36 and the display unit 28 and provides a primary game and a feature game. For each instance of the primary game, the control unit 50 is configured to randomly establish a symbol to be displayed within each of the plurality of cells of the primary display area 60. The feature game may be, for example, a number of free spins. During either the primary game or one of the free spins of the feature, a multi-step feature may be provided.

In another aspect of the invention, a control method for a gaming machine 10 provides a game to a player. The gaming machine 10 includes an operation unit 36, a display unit 28, and a control unit 50. The operation unit 36 is configured to receive an operation of a player. The display unit 28 is coupled to the operation unit and is configured to display a symbol display area. The symbol display area includes a plurality of cells 64 arranged in a grid 60. The grid 60 has a plurality of rows and a plurality of columns. The grid further including a left plurality of columns and a right plurality of columns. Each column in the left plurality of columns is associated with a mirror column in the right plurality of columns. The control unit 50 is operably coupled to the operation unit 36 and the display unit 28 and is configured to initiate a game in response to player operation and to establish an outcome of the game. The method including the steps of:

randomly selecting a plurality of symbols associated with the symbol display area, each symbol in the plurality of symbols being associated with one of the plurality of cells in the grid, the plurality of symbols forming an interim outcome;

determining if a trigger condition has occurred in one of the columns in the left plurality of columns;

if the trigger condition has occurred in one of the columns in the left plurality of columns, copying the symbols in the one of the columns in the left plurality of columns to the mirror column in the right plurality of columns;

determining if the trigger condition has occurred in one of the columns in the right plurality of columns;

if the trigger condition has occurred in one of the columns in the right plurality of columns, copying the symbols in the one of the columns in the right plurality of columns to the associated column in the left plurality of columns, the copied symbols and any remaining symbols in the interim outcome forming the outcome of the game; and, awarding a payout to the player as a function of the outcome of the game.

Figure 16A:
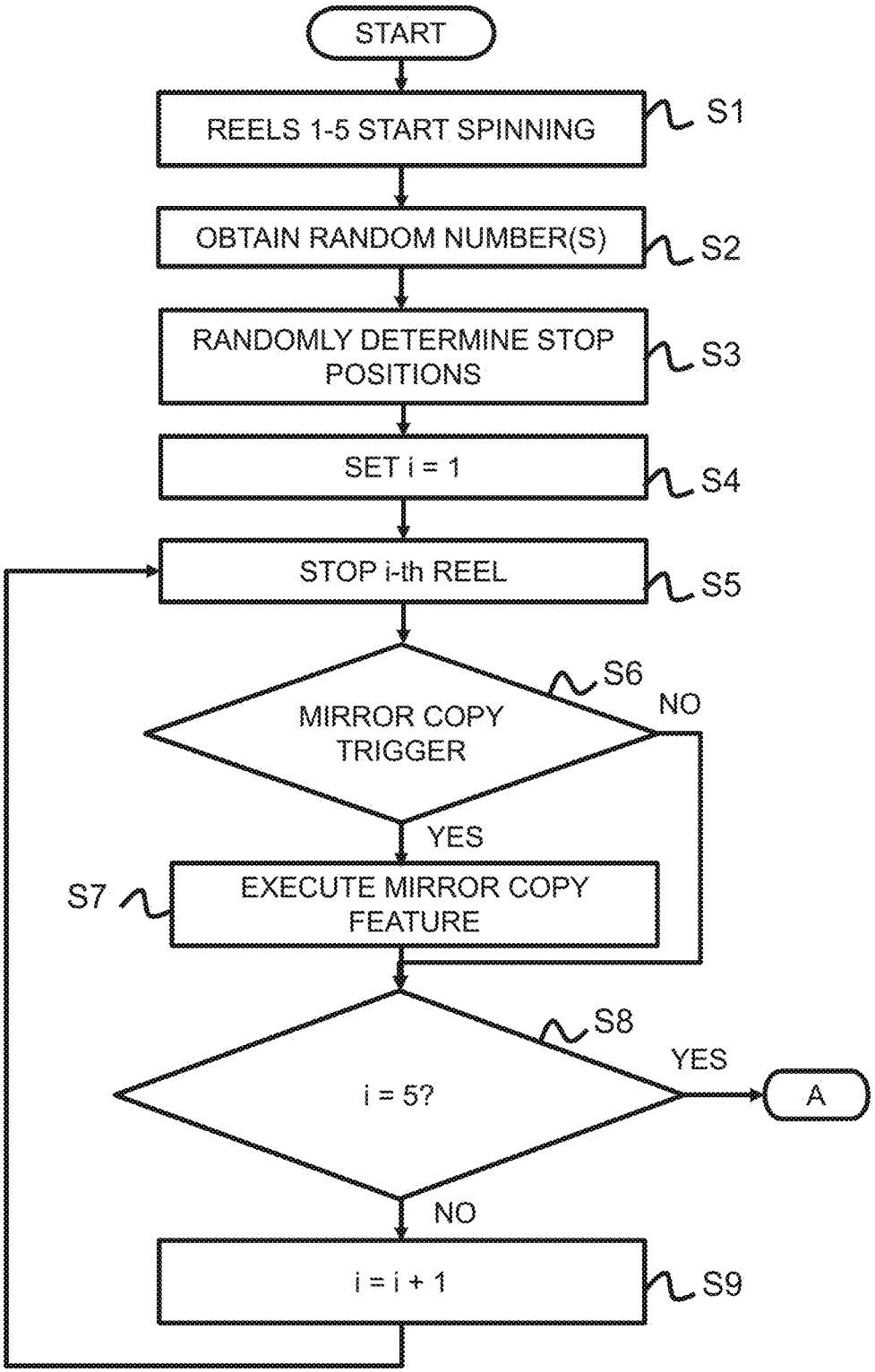
FIGS. 16A-16B are first and second portions of a flow chart describing the operation of the gaming machine in FIG. 1, according to one embodiment of the present invention.
Figure 16B:
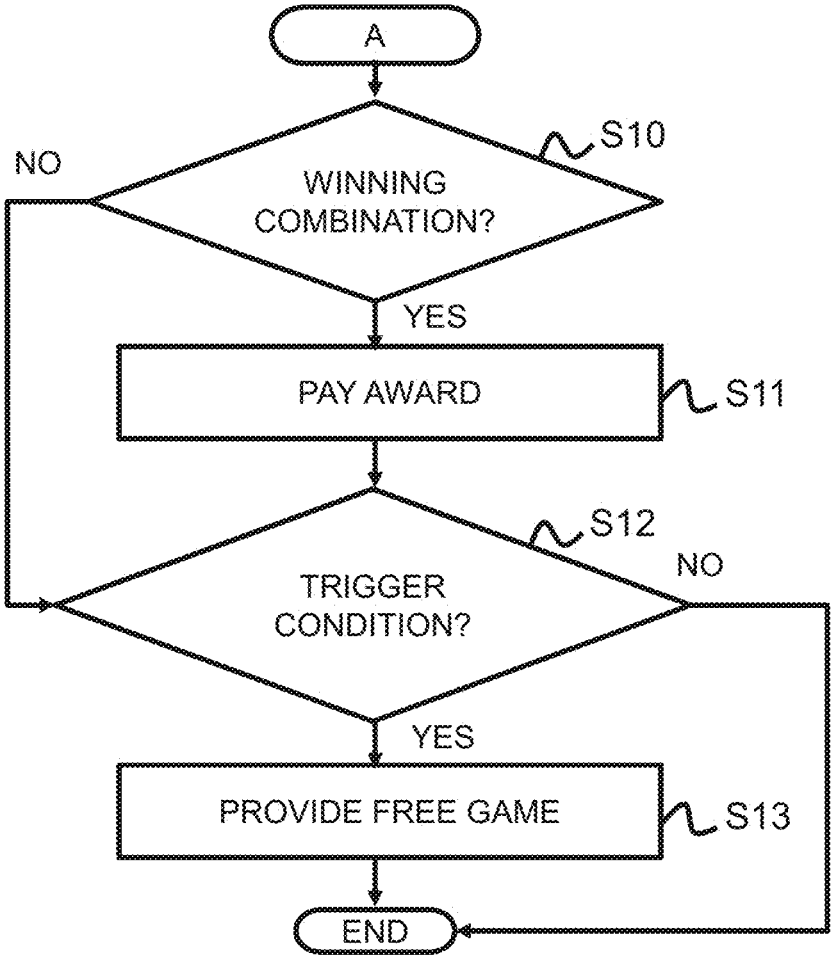

With reference to FIGS. 16A-16B an exemplary flow diagram of a method for operating the gaming machine 10 is shown, according to an embodiment of the present invention.

In a first step S1, the reels start spinning. In a second step S2, a series of random numbers are generated. In the illustrated embodiment, the random numbers represent the stop position of each reel. In a third step S3, the stop position of each reel is determined as a function of the respective random number.

In a fourth step S4, a counter, i, is set to 1. In a fifth step S5, the $i^{th}$ reel is stopped. In a fifth step S5, the column associated with the $i^{th}$ reel is evaluated to determine if the trigger condition has occurred. If the trigger condition has occurred, then the method proceeds to a seventh step S7. Otherwise, the method proceeds to an eighth step S8.

In the seventh step S7, the Mirror Copy Feature with respect to the column associated with the $i^{th}$ reel is executed.

In the eighth step S8, if i does not equal the last column, e.g., 5, then the method proceeds to a ninth step S9. Otherwise the method proceeds tenth step S10.

In the ninth step S9, i is incremented and the method returns to the fifth step S5.

In the tenth step S10, all reels have been stopped and any symbols to be copied have been copied. Thus the outcome of the game, including any copied symbols and any remaining symbols from the interim outcome, is evaluated. If the interim outcome is a winning combination, then an award is paid to the player in an eleventh step S11.

In this embodiment, a bonus game is also provided. Thus, in a twelfth step S12, if a bonus game trigger condition has occurred, then the free or bonus game is provided in a thirteenth step S13. In one embodiment, the bonus game is a plurality of free spins.

Figure 17:
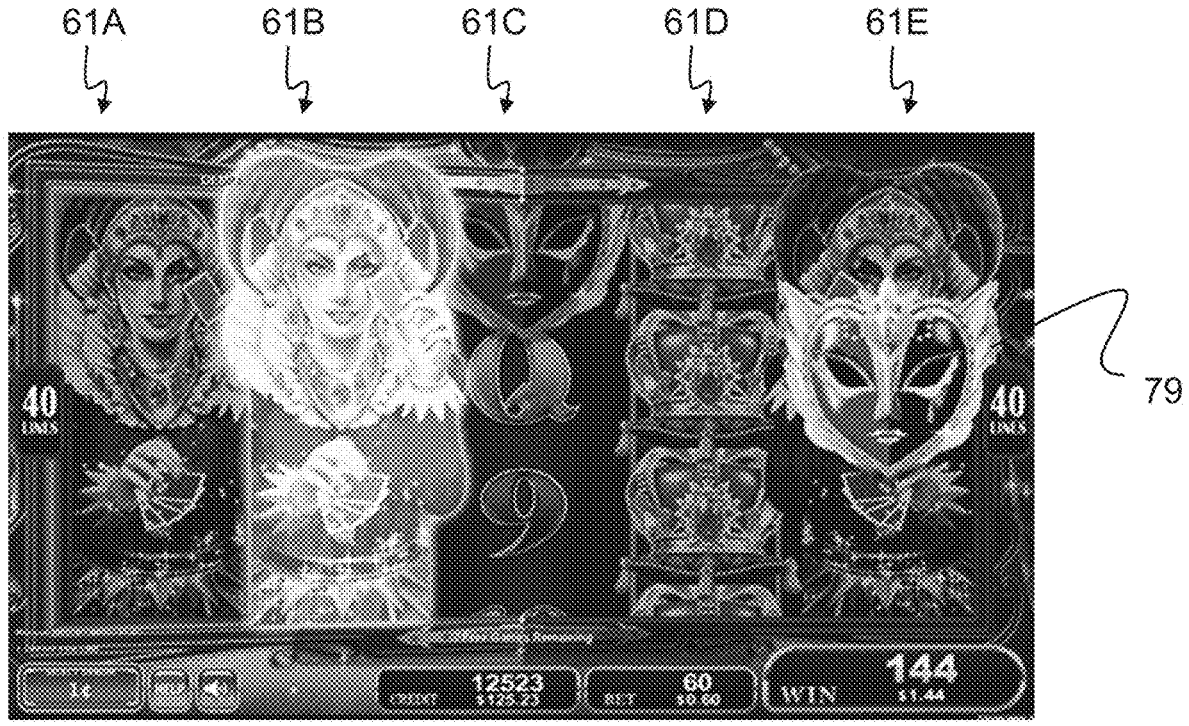
FIG. 17 is a screen shot of the display area of the gaming machine in FIG. 1, according to another embodiment of the present invention.

In one embodiment, the bonus game trigger condition is the appearance of a predetermined number of scatter symbols in the interim outcome. Execution of the Mirror Copy Feature may cover or hide some of the symbols in the interim outcome. However, the hidden scatter symbols must still be used in the evaluation to determine if the bonus game trigger has occurred. Thus, in one embodiment after the Mirror Copy Feature has been executed, if any scatter symbols that have been copied over by the Mirror Copy Feature, the hidden scatter display symbol is displayed over the copied symbols. For example, in FIG. 17, the symbols in the first column 61A have been copied over into the fifth column 61E. After the Mirror Copy Feature has been executed, a scatter symbol 79 in the interim outcome is displayed over the copied symbols.

Next, is a description of a program of the gaming machine 10 for operating one or a plurality of computers as the control unit 50. The gaming machine 10 stores the program in the memory, and can execute the program. The gaming machine 10 can access the program stored in the memory and can operate as the gaming machine 10 of the present embodiment by the program.

Further, the program according to the embodiment may be provided through a network or stored in a recording medium. Recording media such as a floppy (registered trademark) disk, CD-ROM, DVD, or ROM and the like, or semiconductor memory and the like are exemplified as a recording medium. In this case, a program stored in the memory uses a reading device inside the gaming machine 10 such as a floppy (registered trademark) disk drive device, CD-ROM drive device, and DVD drive device and the like.

The embodiments of the present invention are described above, but the present invention is not limited to such an embodiment, a variety of variations are possible.

In such an embodiment, a gaming machine providing a game in the form of a slot machine is described, but this is not limited thereto, and a game in the state of poker, a video card game called black jack, bingo, keno, a wheel game and the like may be provided. Further, it is possible to apply the present invention to a pachinko machine or a pachinko slot machine.

Referring to FIG. 1, in one embodiment, referring to FIG. 1, the control panel 41 includes a plurality of user input devices that may include an acceptor device which accepts media associated with a monetary value to establish a credit balance, a validator configured to identify the physical media, a cash-out button actuatable to cause an initiation of a payout associated with the credit balance. The acceptor device may include a touchscreen display associated with the display unit 28 and/or the player tracking unit 57, the paper money/ticket identification unit 42, the operation unit 36, the player tracking unit 57, a coin slot, a ticket in ticket out (TITO) system, a bill acceptor, and/or any suitable device that enables the gaming machine 10 to receive media associated with a monetary value and establish a credit balance for use in playing the gaming machine 10. In one embodiment, the acceptor device may be configured to receive physical media such as, for example, a coin, a medal, a ticket, a card, a boll, currency, and/or any suitable physical media that enables the gaming machine 10 to function as described herein. The acceptor device may also be configured to accept virtual media such as, for example, a player tracking account, a virtual credit balance, reward points, gaming credits, bonus points, and/or any suitable virtual media that enables the gaming machine 10 to function as described herein. For example, in one embodiment, the coin slot may include an opening that is configured to receive coins and/or tokens deposited by the player into the gaming machine 10. The control unit 50 converts a value of the coins and/or tokens to a corresponding amount of gaming credits that are used by the player to wager on games played on the gaming machine 10. The bill acceptor may include an input and output device that is configured to accept a bill, a ticket, and/or a cash card into the bill acceptor to enable an amount of gaming credits associated with a monetary value of the bills, ticket, and/or cash card to be credited to the gaming machine 10. In one embodiment, the bill acceptor also includes a printer (not shown) that is configured to dispense a printed voucher ticket that includes information indicative of an amount of credits and/or money paid out to the player by the gaming machine 10 during a gaming session. The voucher ticket may be used at other gaming devices, or redeemed for cash, and/or other items as part of a casino cashless system.

In the embodiment, determining the stop position of each reel is described as consecutively acquiring a random number that is used respectively, but the acquisition procedure of the random number is not limited to this. For example, when the game starts, the control unit 50 acquires these random numbers in a batch, and each random number may be stored in the storage area of the non-erasing memory 53 or the storage 54 when power failure occurs. In this type of situation, even when a power failure and the like occurs during a game, because the control unit 50 acquired the random number from the memory 53 or the storage 54 when the game started before the power failure occurred, when resuming the game after recovering from a power failure, the progress of the game can be reproduced. For example, when a game result obtaining a high payout is formed right before a power failure occurs, the player will be greatly dissatisfied if the progress of the game is not similar after recovering from a power failure. However, as mentioned above when the game starts all of the random numbers are acquired in a batch, and by saving these random numbers in the memory 53 or the storage 54, such great dissatisfaction can be avoided for the player because the progress of a game similar to before a power failure occurred can be reproduced after recovering from a power failure.

In another embodiment, the player may initiate a game through actuation of a spin button (or other button). After initiation of the game, the control unit 50 randomly determines the step position of all reels. The control unit 50 may perform the check for the trigger condition before the reels stop spinning, and thus has already determined the outcome of the game. However, the control unit 50 displays the outcome of the game in a step by step process as discussed above. Further, if the trigger condition has occurred with respect to the columns in the left plurality of columns, the check and evaluation of the interim outcome with respect to the columns in the right plurality of columns should be performed in certain embodiments. For example, if the bonus game is provided that is triggered based on the interim outcome, the interim outcome must be established to perform such an evaluation.

Further, in the embodiment, a bill/ticket is displayed as game value, and received by these bill/ticket identification devices (32, 55), and a form where a ticket is output by a printer unit is described, but the present invention is not limited to this. The game value is a concept including tangible objects such as a coin, bill, coin, medal, ticket, and the like, or electronic data that has a value equivalent to these. For example, a coin is received by the coin accepter, and there may be a form where a coin is paid by a coin hopper. A player is identified and credit that is accumulated in an account on a server is used, there may be a form where credit is paid to an account, information of credit stored in a storage medium of a magnetic card, IC card and the like is read and used, and there may be a form where credit is paid by writing to the storage medium.

Further, in the embodiment when showing a free game provided as a bonus game, a bonus game that uses a different virtual reel strip from a regular game may be provided. Further, there could be a provided a feature game according to a value of the random number acquired during a regular game.

Further, set conditions providing a bonus or feature game are not limited to trigger determination or line determination, for example there may be a configuration providing a bonus game when the bet number surpasses a predetermined value. There could be a configuration providing a bonus game according to a value of the random number acquired during a regular game.

Further, in the embodiment, a form providing a free game for a predetermined number of times as a bonus game is shown, and a bonus game that is not limited to a number of times may be provided. In this situation, there could be a configuration providing a bonus game until an end condition is satisfied, as an end condition is a combination of specified symbols, or a determining bonus game based on a random number.

Exemplary embodiments of a gaming device, a gaming system, and a method of providing an award to a player are described above in detail. The gaming device, system, and method are not limited to the specific embodiments described herein, but rather, components of the gaming device and/or system and/or steps of the method may be utilized independently and separately from other components and/or steps described herein. For example, the gaming device may also be used in combination with other gaming systems and methods, and is not limited to practice with only the gaming device as described herein. Rather, an exemplary embodiment can be implemented and utilized in connection with many other gaming system applications. For instance, the present invention is applicable to a gaming system which is a combination of a community gaming system and individual gaming devices. In such a case, the individual gaming device and the community gaming device provide feature game cooperatively by providing 1st and 2nd feature display area on the community gaming system and 3rd feature display area on the individual gaming devices et al. And the predetermined symbol is copied from the 1st and 2nd feature display area on the community gaming system to 3rd feature display area on the individual gaming devices and the like.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the present invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A gaming machine for providing a game, comprising:

an operation unit configured to receive an operation of a player;

a display unit operably coupled to the operation unit and configured to display a symbol display area, the symbol display area including a plurality of cells arranged in a grid, the grid having a plurality of rows and a plurality of columns, the plurality of columns including a left plurality of columns and a right plurality of columns within the grid, each column in the left plurality of columns being associated with a mirror column in the right plurality of columns, each mirror column in the right plurality of columns having a same number of cells as the associated column in the left plurality of columns; and, a control unit operably coupled to the operation unit and the display unit and being configured to initiate a game in response to player operation and to establish an outcome of the game, the control unit, in response to initiation of the game, being further configured to:

display the game including a video slot game, wherein each column defines a reel of the video slot game, and display the set of symbols in the cells of the grid in a manner to simulate rotating reels, the set of symbols being displayed in the cells when the simulated rotating reels are stopped;

randomly select a plurality of symbols associated with the symbol display area, each symbol in the plurality of symbols being associated with one of the plurality of cells in the grid, the plurality of symbols forming an interim outcome;

initiate a spin of each of the plurality of reels and subsequently stop each reel in sequential order from left to right; and upon stopping a corresponding reel:

detect a trigger condition occurring in the interim outcome including a special symbol appearing in each cell of a corresponding column with the corresponding reel in a stop position; and upon determining the trigger condition has occurred in one of the columns in the left plurality of columns, copy the symbols in the one of the columns in the left plurality of columns to the mirror column in the right plurality of columns within the grid; and upon determining the trigger condition has occurred in one of the columns in the right plurality of columns, copy the symbols in the one of the columns in the right plurality of columns to the associated column in the left plurality of columns within the grid, the copied symbols and any remaining symbols in the interim outcome forming the outcome of the game;

wherein any symbols copied from one of the columns in the left plurality of columns to the right plurality of columns are copied before the reels associated with the right plurality of columns stop spinning and any symbols copied from one of the columns in the right plurality of columns to the left plurality of columns are copied after the reels associated with the left plurality of columns stop spinning; and, wherein the control unit is further configured to:

determine whether a scatter symbol has been overlaid by a copied symbol and responsively display the scatter symbol on top of the copied symbol; and award a payout to the player as a function of the outcome of the game.

2. A gaming machine, as set forth in claim 1, wherein the control unit is programmed to provide a bonus game upon detecting a bonus trigger condition occurring in the interim outcome of the game.

3. A gaming machine, as set forth in claim 2, wherein the bonus trigger condition includes the scatter symbol included in the interim outcome.

4. A gaming machine, as set forth in claim 1, wherein each column has an associated reel strip, each reel strip including a plurality of symbol positions populated with a respective symbol.

5. A gaming machine, as set forth in claim 4, wherein the associated reel strip of at least one column in the left plurality of columns includes an identical symbol in a plurality of adjacent symbol positions and the associated reel strip of at least one column in the right plurality of columns includes the identical symbol in a plurality of adjacent symbol positions.

6. A gaming machine, as set forth in claim 5, wherein the identical symbol is a wild symbol.

7. A gaming machine, as set forth in claim 5, wherein the identical symbol is randomly determined.

8. A gaming machine, as set forth in claim 5, wherein the grid includes n rows and the plurality of adjacent symbol positions in the reel strip associated with at least one column in the left plurality of columns and the plurality of adjacent symbol positions in the reel strip associated with at least one column in the right plurality of columns includes at least n adjacent symbol positions.

9. A gaming machine, as set forth in claim 8, wherein the trigger condition includes the identical symbol appearing in the interim outcome.

10. A gaming machine, as set forth in claim 1, wherein the grid includes a 3×5 arrangement of cells.

11. A gaming machine, as set forth in claim 1, wherein the trigger condition includes a full-reel symbol displayed across each cell of the corresponding column.

12. A gaming machine, as set forth in claim 1, wherein the grid includes an odd number of columns.

13. A gaming machine, as set forth in claim 1, wherein the grid includes an even number of columns.

14. A gaming machine, as set forth in claim 1, wherein any symbols copied from one of the columns are copied after the reels associated with the columns stop spinning.

15. A gaming machine, as set forth in claim 1, wherein the control unit is further configured to display an animation illustrating the copying of any symbols.

16. A gaming machine, comprising:

an operation unit configured to receive an operation of a player;

a display unit operably coupled to the operation unit and configured to display a symbol display area, the symbol display area including a plurality of cells arranged in a grid, the grid having a plurality of rows and a plurality of columns, the plurality of columns including a left plurality of columns and a right plurality of columns within the grid, each column in the left plurality of columns being associated with a mirror column in the right plurality of columns, each mirror column in the right plurality of columns having a same number of cells as the associated column in the left plurality of columns; and, a control unit operably coupled to the operation unit and the display unit and being configured to initiate a game in response to player operation and to establish an outcome of the game, the control unit, in response to initiation of the game, being further configured to:

randomly select a plurality of symbols associated with the symbol display area, each symbol in the plurality of symbols being associated with one of the plurality of cells in the grid, the plurality of symbols forming an interim outcome;

initiating a spin of each of the plurality of reels and subsequently stop each reel in sequential order from left to right; and upon stopping a corresponding reel:

detecting a trigger condition occurring in the interim outcome including a special symbol appearing in each cell of a corresponding column with the corresponding reel in a stop position; and upon determining the trigger condition has occurred in one of the columns in the left plurality of columns, copy the symbols in the one of the columns in the left plurality of columns to the mirror column in the right plurality of columns within the grid; and upon determining the trigger condition has occurred in one of the columns in the right plurality of columns, copy the symbols in the one of the columns in the right plurality of columns to the associated column in the left plurality of columns within the grid, the copied symbols and any remaining symbols in the interim outcome forming the outcome of the game;

display an animation illustrating the copying of any symbols, wherein the animation includes:

a. creating a duplicate image of the symbols to be copied above or near the associated originating column, b. folding the duplicate image over the grid to an opposite side of the grid, and c. overlaying the copied symbol onto the cells of the grid of the associated column;

determining whether a scatter symbol has been overlaid by a copied symbol and responsively display the scatter symbol on top of the copied symbol; and, award a payout to the player as a function of the outcome of the game;

wherein any symbols copied from one of the columns in the left plurality of columns to the right plurality of columns are copied before the reels associated with the right plurality of columns stop spinning and any symbols copied from one of the columns in the right plurality of columns to the left plurality of columns are copied after the reels associated with the left plurality of columns stop spinning.

17. A control method for providing a game to a player using a gaming machine, the gaming machine including a control unit, an operation unit, and a display unit, the operation unit configured to receive operation from the player, the display unit operably coupled to the operation unit and being configured to display a symbol display area, the symbol display area including a plurality of cells arranged in a grid, the grid having a plurality of rows and a plurality of columns, the plurality of columns including a left plurality of columns and a right plurality of columns within the grid, each column in the left plurality of columns being associated with a mirror column in the right plurality of columns, each mirror column in the right plurality of columns having a same number of cells as the associated column in the left plurality of columns, the control unit being operably coupled to the operation unit and the display unit and being configured to initiate a game in response to player operation and to establish an outcome of the game, the control method, in response to initiation of the game performing the steps of:

displaying the game including a video slot game, wherein each column defines a reel of the video slot game, and displaying the set of symbols in the cells of the grid in a manner to simulate rotating reels, the set of symbols being displayed in the cells when the simulated rotating reels are stopped;

randomly selecting a plurality of symbols associated with the symbol display area, each symbol in the plurality of symbols being associated with one of the plurality of cells in the grid, the plurality of symbols forming an interim outcome;

initiate a spin of each of the plurality of reels and subsequently stop each reel in sequential order from left to right; and upon stopping a corresponding reel:

detect a trigger condition occurring in the interim outcome including a special symbol appearing in each cell of a corresponding column with a corresponding reel in a stop position; and upon determining the trigger condition has occurred in one of the columns in the left plurality of columns, copying the symbols in the one of the columns in the left plurality of columns to the mirror column in the right plurality of columns within the grid; and upon determining the trigger condition has occurred in one of the columns in the right plurality of columns, copying the symbols in the one of the columns in the right plurality of columns to the associated column in the left plurality of columns within the grid, the copied symbols and any remaining symbols in the interim outcome forming the outcome of the game;

wherein any symbols copied from one of the columns in the left plurality of columns to the right plurality of columns are copied prior to the reels associated with the right plurality of columns stop spinning and any symbols copied from one of the columns in the right plurality of columns to the left plurality of columns are copied after the reels associated with the left plurality of columns stop spinning; and, wherein the control unit is further configured to:

determine whether a scatter symbol has been overlaid by a copied symbol and responsively display the scatter symbol on top of the copied symbol; and awarding a payout to the player as a function of the outcome of the game.

18. A control method, as set forth in claim 17, wherein the grid includes a 3×5 arrangement of cells.

19. A control method, as set forth in claim 17, wherein the trigger condition includes a full-reel symbol displayed across each cell of the corresponding column.

20. A control method, as set forth in claim 17, wherein the grid includes an odd number of columns.

21. A control method, as set forth in claim 17, wherein the grid includes an even number of columns.

22. A control method, as set forth in claim 17, wherein any symbols copied from one of the columns are copied after the reels associated with the columns stop spinning.

23. A control method, as set forth in claim 17, wherein the control method further includes the step of displaying an animation illustrating the copying of any symbols.

24. A control method, as set forth in claim 17, further including the step of providing a bonus game upon detecting a bonus trigger condition occurring in the interim outcome of the game.

25. A control method, as set forth in claim 24, wherein the bonus trigger condition includes the scatter symbol included in the interim outcome.

26. A control method, as set forth in claim 17, wherein each column has an associated reel strip, each reel strip including a plurality of symbol positions populated with a respective symbol.

27. A control method, as set forth in claim 26, wherein the associated reel strip of at least one column in the left plurality of columns includes an identical symbol in a plurality of adjacent symbol positions and the associated reel strip of at least one column in the right plurality of columns includes the identical symbol in a plurality of adjacent symbol positions.

28. A control method, as set forth in claim 27, wherein the identical symbol is a wild symbol.

29. A control method, as set forth in claim 27, wherein the identical symbol is randomly determined.

30. A control method, as set forth in claim 27, wherein the grid includes n rows and the plurality of adjacent symbol positions in the reel strip associated with at least one column in the left plurality of columns and the plurality of adjacent symbol positions in the reel strip associated with at least one column in the right plurality of columns includes at least n adjacent symbol positions.

31. A control method, as set forth in claim 30, wherein the trigger condition includes the identical symbol appearing in the interim outcome.

32. A control method for providing a game to a player using a gaming machine, the gaming machine including a control unit, an operation unit, and a display unit, the operation unit configured to receive operation from the player, the display unit operably coupled to the operation unit and being configured to display a symbol display area, the symbol display area including a plurality of cells arranged in a grid, the grid having a plurality of rows and a plurality of columns, the plurality of columns including a left plurality of columns and a right plurality of columns within the grid, each column in the left plurality of columns being associated with a mirror column in the right plurality of columns, each mirror column in the right plurality of columns having a same number of cells as the associated column in the left plurality of columns, the control unit being operably coupled to the operation unit and the display unit and being configured to initiate a game in response to player operation and to establish an outcome of the game, the control method, in response to initiation of the game performing the steps of:

randomly selecting a plurality of symbols associated with the symbol display area, each symbol in the plurality of symbols being associated with one of the plurality of cells in the grid, the plurality of symbols forming an interim outcome;

initiating a spin of each of the plurality of reels and subsequently stop each reel in sequential order from left to right; and upon stopping a corresponding reel:

detecting a trigger condition occurring in the interim outcome including a special symbol appearing in each cell of a corresponding column with the corresponding reel in a stop position; and upon determining the trigger condition has occurred in one of the columns in the left plurality of columns, copying the symbols in the one of the columns in the left plurality of columns to the mirror column in the right plurality of columns within the grid; and upon determining the trigger condition has occurred in one of the columns in the right plurality of columns, copying the symbols in the one of the columns in the right plurality of columns to the associated column in the left plurality of columns within the grid, the copied symbols and any remaining symbols in the interim outcome forming the outcome of the game;

displaying an animation illustrating the copying of any symbols, wherein the animation includes the steps of:

a. creating a duplicate image of the symbols to be copied above or near the associated originating column, b. folding the duplicate image over the grid to an opposite side of the grid, and c. overlaying the copied symbol onto the cells of the grid of the associated column;

determining whether a scatter symbol has been overlaid by a copied symbol and responsively display the scatter symbol on top of the copied symbol; and, awarding a payout to the player as a function of the outcome of the game wherein any symbols copied from one of the columns in the left plurality of columns to the right plurality of columns are copied before the reels associated with the right plurality of columns stop spinning and any symbols copied from one of the columns in the right plurality of columns to the left plurality of columns are copied after the reels associated with the left plurality of columns stop spinning.

33. A non-transitory computer-readable storage media, having computer-executable instructions embodied thereon for a gaming machine for providing a game to a player, wherein the gaming machine includes a control unit, an operation unit, and a display unit, the operation unit configured to receive operation from the player, the display unit operably coupled to the operation unit and being configured to display a symbol display area, the symbol display area including a plurality of cells arranged in a grid, the grid having a plurality of rows and a plurality of columns, the plurality of columns including a left plurality of columns and a right plurality of columns within the grid, each column in the left plurality of columns being associated with a mirror column in the right plurality of columns, each mirror column in the right plurality of columns having a same number of cells as the associated column in the left plurality of columns, the control unit operably coupled to the operation unit and the display unit, and being configured to initiate a game in response to player operation and to establish an outcome of the game, the computer-executable instructions cause a processor of the gaming machine to perform the steps of:

displaying the game including a video slot game, wherein each column defines a reel of the video slot game, and displaying the set of symbols in the cells of the grid in a manner to simulate rotating reels, the set of symbols being displayed in the cells when the simulated rotating reels are stopped;

randomly selecting a plurality of symbols associated with the symbol display area, each symbol in the plurality of symbols being associated with one of the plurality of cells in the grid, the plurality of symbols forming an interim outcome;

initiate a spin of each of the plurality of reels and subsequently stop each reel in sequential order from left to right; and upon stopping a corresponding reel:

detect a trigger condition occurring in the interim outcome including a special symbol appearing in each cell of a corresponding column with the corresponding reel in a stop position; and upon determining the trigger condition has occurred in one of the columns in the left plurality of columns, copying the symbols in the one of the columns in the left plurality of columns to the mirror column in the right plurality of columns within the grid; and upon determining the trigger condition has occurred in one of the columns in the right plurality of columns, copying the symbols in the one of the columns in the right plurality of columns to the associated column in the left plurality of columns within the grid, the copied symbols and any remaining symbols in the interim outcome forming the outcome of the game;

wherein any symbols copied from one of the columns in the left plurality of columns to the right plurality of columns are copied before the reels associated with the right plurality of columns stop spinning and any symbols copied from one of the columns in the right plurality of columns to the left plurality of columns are copied after the reels associated with the left plurality of columns stop spinning; and, wherein the control unit is further configured to:

determine whether a scatter symbol has been overlaid by a copied symbol and responsively display the scatter symbol on top of the copied symbol; and awarding a payout to the player as a function of the outcome of the game.

* * * * *